US012281277B2

(12) United States Patent
Zhao et al.

(10) Patent No.: US 12,281,277 B2
(45) Date of Patent: Apr. 22, 2025

(54) LUBRICANT COMPOSITIONS CONTAINING STYRENIC BLOCK COPOLYMER

(71) Applicant: Infineum International Limited, Abingdon (GB)

(72) Inventors: Yi Zhao, Edison, NJ (US); Ronald M. Lewis, Glenmore, PA (US); Ewan K. Galbraith, Brooklyn, NY (US); Dominic Collis, Abingdon (GB)

(73) Assignee: Infineum International Limited, Abingdon (GB)

( * ) Notice: Subject to any disclaimer, the term of this patent is extended or adjusted under 35 U.S.C. 154(b) by 0 days.

(21) Appl. No.: 18/466,520

(22) Filed: Sep. 13, 2023

(65) Prior Publication Data

US 2025/0084337 A1 Mar. 13, 2025

(51) Int. Cl.

| | |
|---|---|
| ***C10M 143/12*** | (2006.01) |
| ***C10N 20/02*** | (2006.01) |
| ***C10N 30/02*** | (2006.01) |
| ***C10N 30/04*** | (2006.01) |
| ***C10N 30/10*** | (2006.01) |

(Continued)

(52) U.S. Cl.

CPC .... *C10M 143/12* (2013.01); *C10M 2203/003* (2013.01); *C10M 2205/06* (2013.01); *C10M 2219/044* (2013.01); *C10N 2020/02* (2013.01); *C10N 2030/02* (2013.01); *C10N 2030/04* (2013.01); *C10N 2030/10* (2013.01); *C10N 2040/04* (2013.01); *C10N 2040/25* (2013.01)

(58) Field of Classification Search

CPC ..... C10M 143/12; C10M 2203/003; C10M 2205/06; C10M 2219/044; C10N 2020/02; C10N 2030/02; C10N 2030/04; C10N 2030/10; C10N 2040/04; C10N 2040/25

See application file for complete search history.

(56) References Cited

U.S. PATENT DOCUMENTS

| | | | |
|---|---|---|---|
| 3,231,635 | A | 1/1966 | Holden |
| 4,141,847 | A | 2/1979 | Kiovsky |
| 4,156,673 | A | 5/1979 | Eckert |

(Continued)

FOREIGN PATENT DOCUMENTS

| | | |
|---|---|---|
| CA | 716645 | 8/1965 |
| CN | 102731739 B | 10/2012 |

(Continued)

OTHER PUBLICATIONS

D. Ramirez, R. M. Kowalczyk and C. D. Collins, Characterisation of oil sludges from different sources before treatment: High-field nuclear magnetic resonance (NMR) in the determination of oil and water content, *J. Pet. Sci. Eng.*, 2019, 174, 729-737.

(Continued)

*Primary Examiner* — James C Goloboy
(74) *Attorney, Agent, or Firm* — Robert A. Migliorini

(57) ABSTRACT

This invention relates to a lubricating oil composition, or concentrate therefor, comprising or resulting from the admixing of: (i) base oil, (ii) one or more styrenic block copolymers having a radial structure where one or more blocks derived from conjugated diene monomers are distal to the radial center and one more blocks derived from vinyl aromatic monomers that are proximal to the radial center, and (iii) optionally one or more dispersants and or detergents.

24 Claims, 4 Drawing Sheets

(51) Int. Cl.
*C10N 40/04* (2006.01)
*C10N 40/25* (2006.01)

(56) References Cited

U.S. PATENT DOCUMENTS

| | | | | |
|---|---|---|---|---|
| 4,427,834 | A | 1/1984 | Martin | |
| 4,788,361 | A | 11/1988 | Olson | |
| 4,900,875 | A | 2/1990 | Rhodes | |
| 4,970,009 | A | 11/1990 | Van Zon | |
| 5,070,131 | A | 12/1991 | Rhodes | |
| 5,458,791 | A | 10/1995 | Rhodes | |
| 5,460,739 | A | 10/1995 | Rhodes | |
| 5,496,898 | A | 3/1996 | Sutherland | |
| 5,798,418 | A | 8/1998 | Roderic | |
| 6,034,042 | A * | 3/2000 | Rhodes | C08F 297/044 508/591 |
| 6,713,564 | B1 | 3/2004 | Nobuhara | |
| 6,715,473 | B2 | 4/2004 | Ritchie | |
| 6,818,601 | B1 | 11/2004 | Lange | |
| 6,869,919 | B2 | 3/2005 | Ritchie | |
| 7,163,913 | B2 | 1/2007 | Briggs | |
| 7,625,851 | B2 | 12/2009 | St. Clair | |
| 8,524,645 | B2 | 9/2013 | Chor | |
| 8,999,905 | B2 | 4/2015 | Duggal | |
| 9,133,413 | B2 | 9/2015 | Oberoi | |
| 9,951,160 | B2 | 4/2018 | van der Huizen | |
| 10,053,609 | B2 | 8/2018 | Bening | |
| 10,479,956 | B2 | 11/2019 | Ortiz | |
| 11,414,618 | B2 | 8/2022 | Zhao | |
| 2004/0259742 | A1 | 12/2004 | Mishra | |
| 2008/0085847 | A1 | 4/2008 | Tse | |
| 2011/0207642 | A1 | 8/2011 | Strickland | |
| 2014/0162924 | A1 | 6/2014 | Watts | |
| 2014/0287970 | A1 | 9/2014 | Smythe | |
| 2015/0184105 | A1 | 7/2015 | Taribagil | |
| 2015/0344805 | A1 | 12/2015 | Dance et al. | |
| 2017/0073613 | A1 | 3/2017 | Galic Raguz | |
| 2020/0157456 | A1 | 5/2020 | Notari | |
| 2021/0380894 | A1 | 12/2021 | Smith | |

FOREIGN PATENT DOCUMENTS

| | | | |
|---|---|---|---|
| CN | 103833945 | | 6/2014 |
| CN | 104710624 | | 6/2015 |
| CN | 105732920 | | 7/2016 |
| CN | 105754055 | | 7/2016 |
| CN | 106336490 | B | 1/2017 |
| CN | 110862856 | | 3/2020 |
| CN | 111944591 | | 11/2020 |
| CN | 109181813 | | 7/2021 |
| CN | 113461881 | | 10/2021 |
| EP | 0425027 | B1 | 6/1995 |
| EP | 2649164 | | 6/2012 |
| JP | 7393938 | B2 | 2/2021 |
| WO | WO 2008/013753 | | 1/2008 |
| WO | WO 2009/102387 | | 8/2009 |
| WO | WO 2021/064059 | | 4/2021 |

OTHER PUBLICATIONS

D. Rogers, W. Rice and F. Jonach, Mechanism of Engine Sludge, *SAE Tech. Paper*., 1956, 64, 782-811.

B. I. Kosteteskii, Y. M. Tarasov, N. P. Khalyavka, I. V. Vyazovaya and E. P. Phalyavka, Chemmotology of Fuels and Lubricants., *Chem. Technol. Fuels Oils*, 1977, 13, 667-668.

C. Xu, Y. Zhang, H. Zhao and Q. Shi, Molecular investigation of crude oil sludge from an electric dehydrator, *Energy Fuels*, 2011, 25, 3116-3124.

L. S. Khuong, N. W. M. Zulkifli, H. H. Masjuki, E. Niza Mohamad, A. Arslan, H. M. Mosarof and A. Azham, A review on the effect of bioethanol dilution on the properties and performance of automotive lubricants in gasoline engines, *RSC Adv*., 2016, 6, 66847-66869.

G. Aguilar, G. Mazzamaro and M. Rasberger, in *Chemistry and Technology of Lubricants*, 3rd edn., 2010, pp. 99-143.

M. Kawamura, H. Moritani, M. Nakada and M. Oohori, *Sludge Formation and Engine Oil Dispersancy Evaluation with Laboratory Scale Sludge Simulator*, SAE Technical Paper, 892105, AP-799 International Fuels and Lubricants Meeting and Exposition Baltimore Maryland, USA Sep. 25-28, 1989.

D. R. Coultas, The Role of NOx in Engine Lubricant Oxidation, *SAE Tech. Pap*., 2020, DOI:10.4271/2020-01-1427.

U.S. Appl. No. 11/479,736, filed Oct. 25, 2022, Dingwell, L..

EPO Search Report EP 24198822.9, Feb. 14, 2025.

* cited by examiner

Figure 1 (Fig. 1)
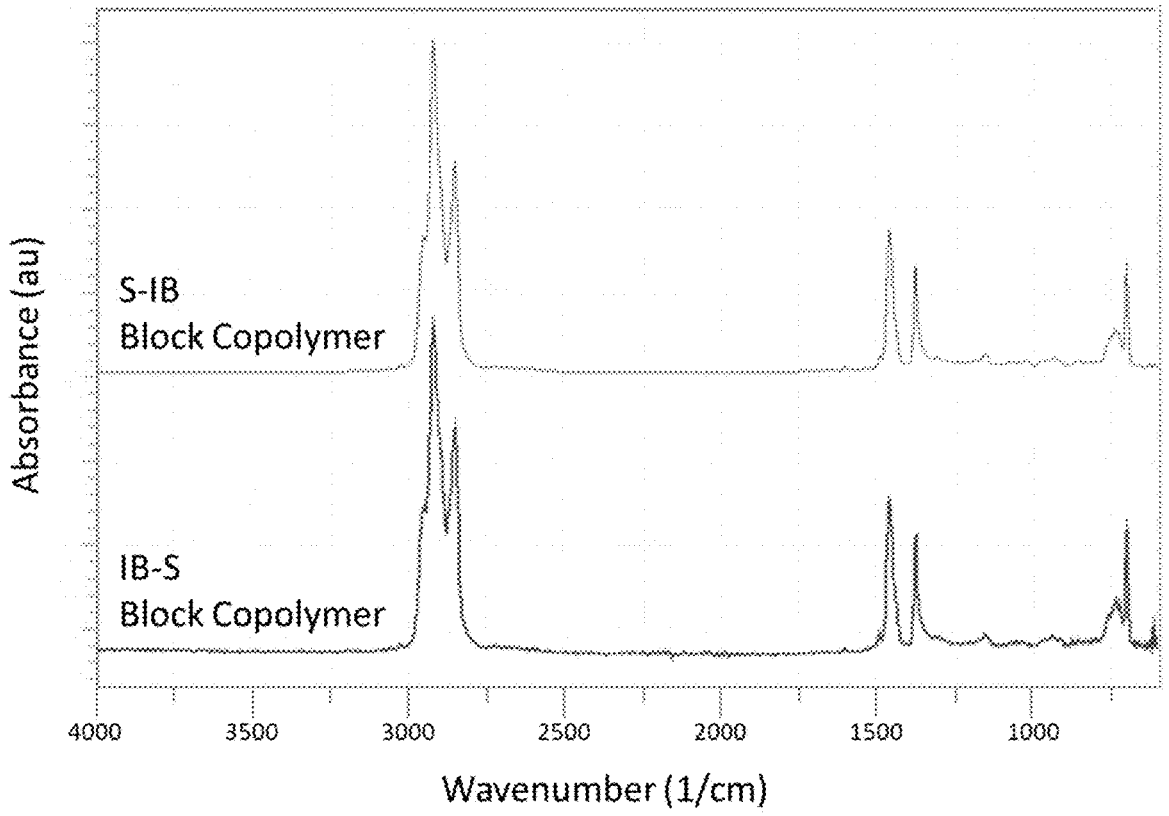
Figure (Fig.) 2
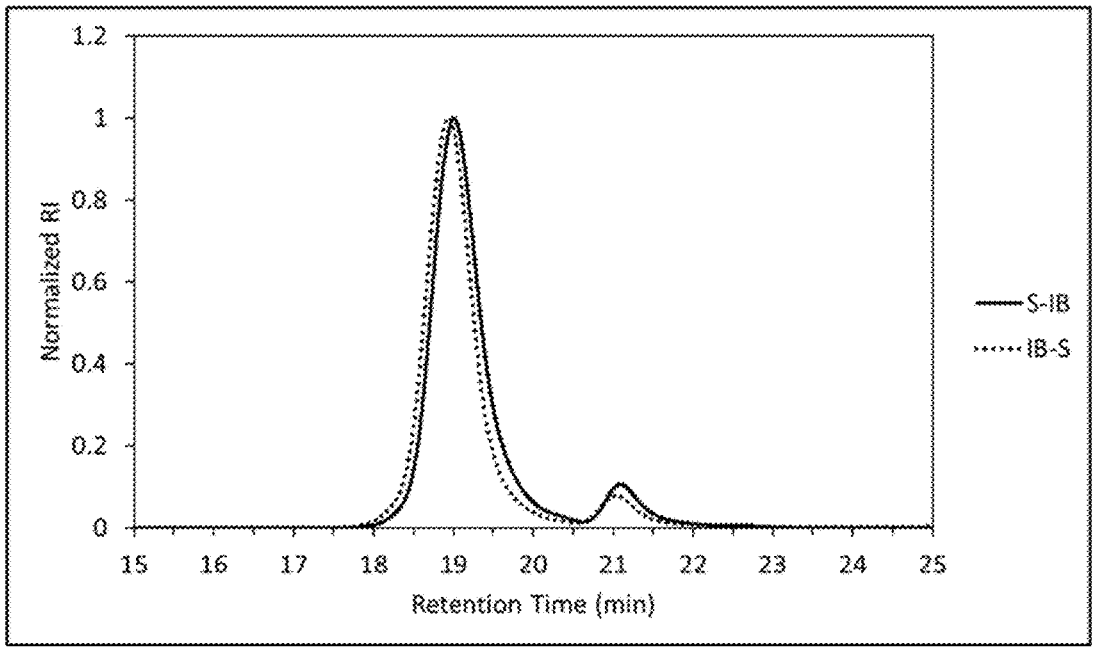

Figure (Fig) 3
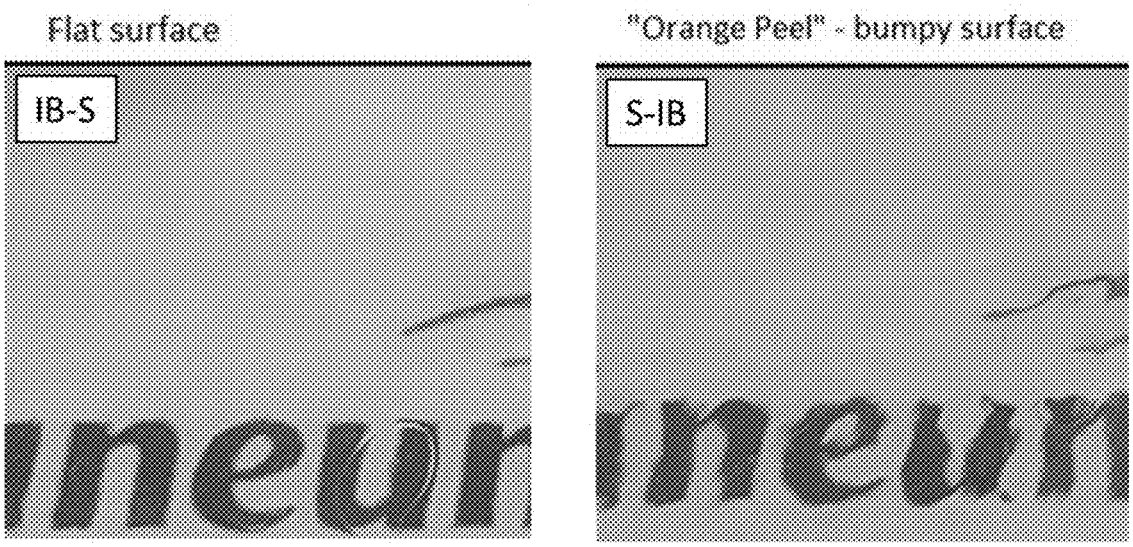
Figure 4 (Fig.4) Line Depth Profiles
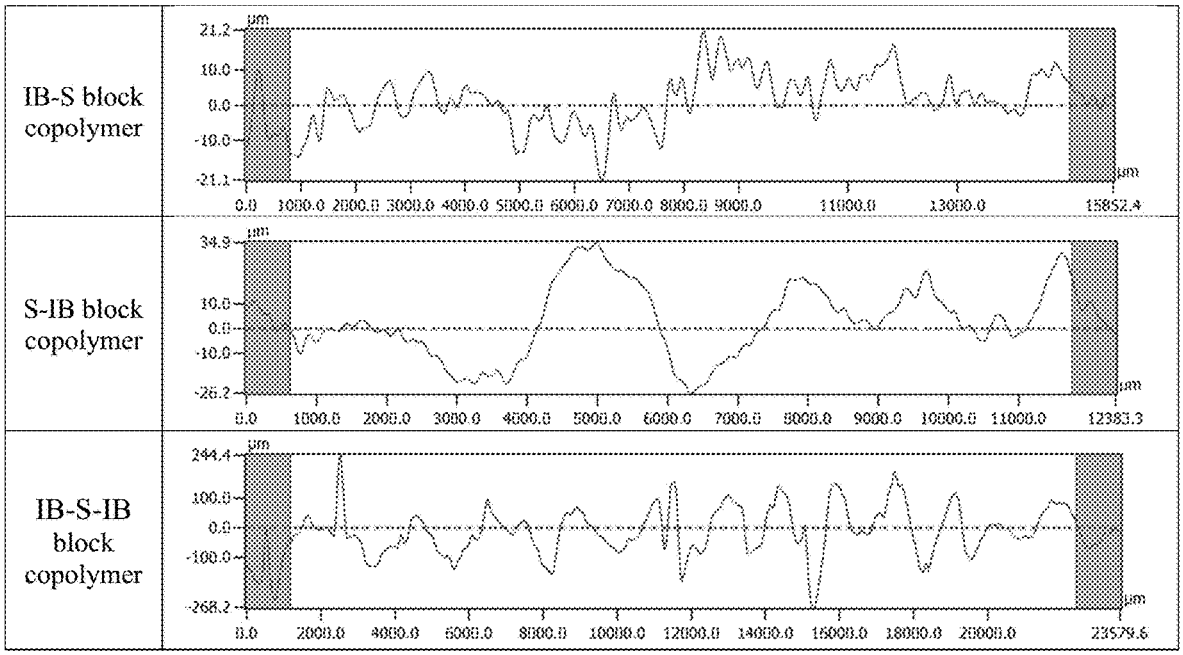

Figure 5A Area Depth Profiles
S-IB
Block Copolymer
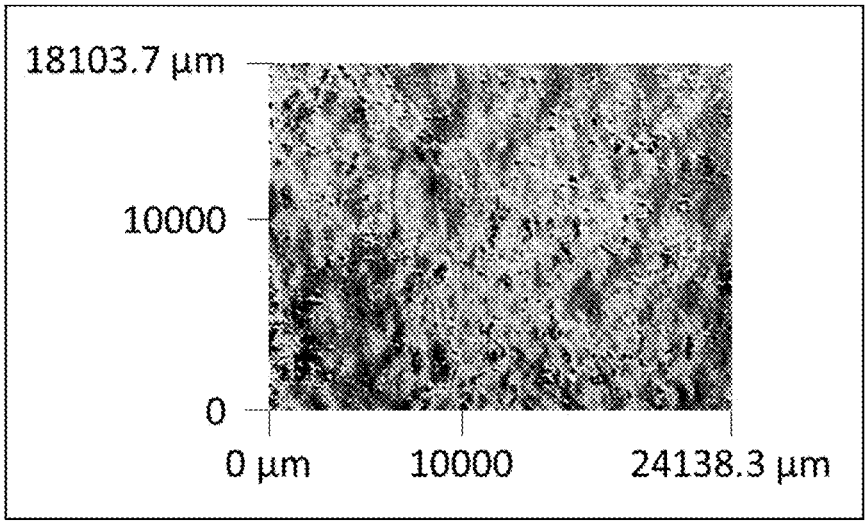
IB-S
Block Copolymer
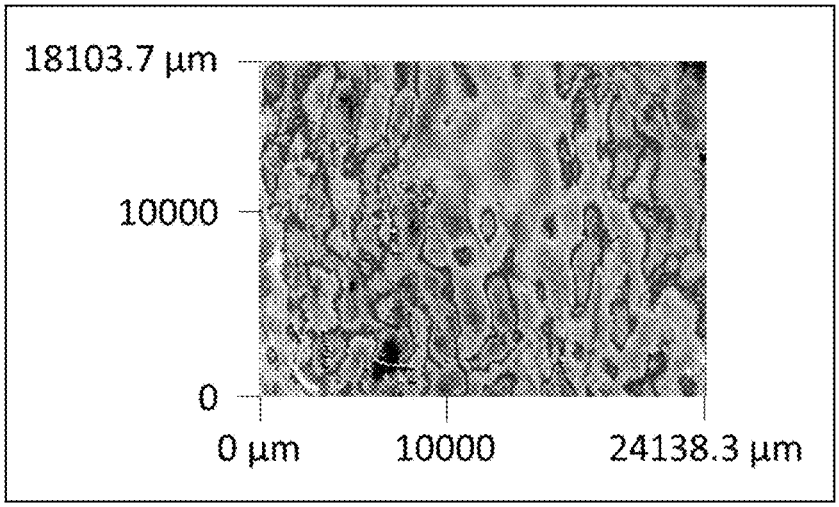

Figure 5B Area Depth Profile
SBS Block Copolymer
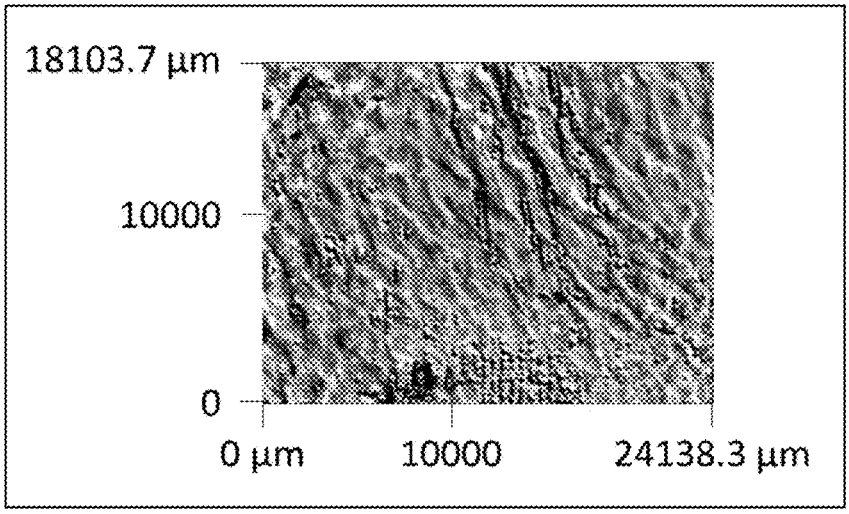
Figure 6 (Fig. 6) Hydrodynamic radius
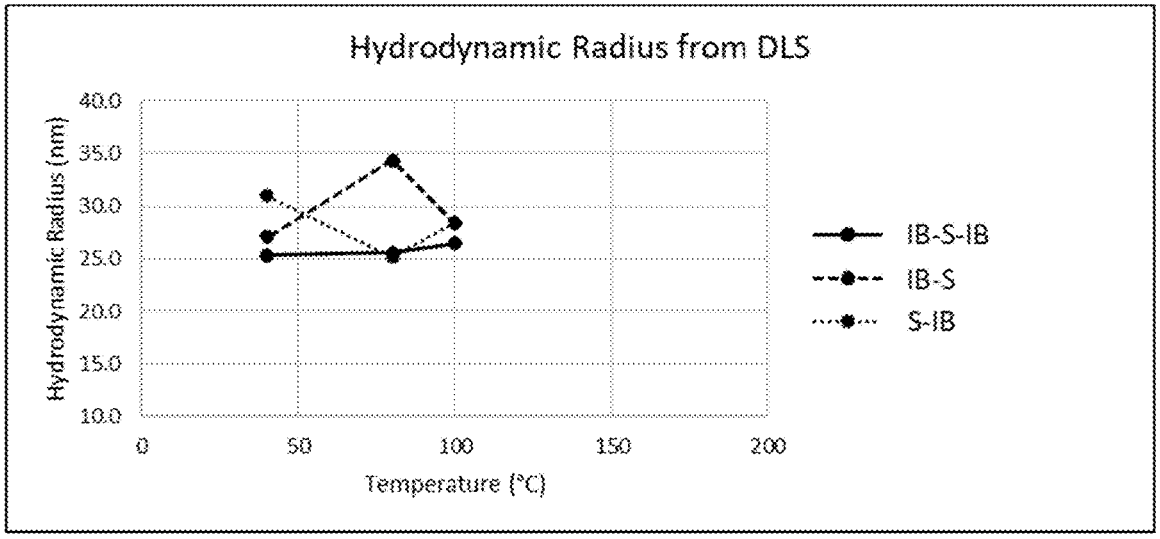

LUBRICANT COMPOSITIONS CONTAINING STYRENIC BLOCK COPOLYMER

FIELD OF THE INVENTION

This disclosure relates to the use of radial styrenic block copolymers as additives in lubricant compositions in engine crankcase applications, especially in compression ignited engine and/or spark ignited applications.

BACKGROUND OF THE INVENTION

The present invention relates to lubricating oil compositions which exhibit improved sludge handling characteristics. More specifically, the present invention relates to automotive crankcase lubricating oil compositions for use in gasoline (spark-ignited) and diesel (compression-ignited) internal combustion engines, such compositions being referred to as crankcase lubricants; and to the use of additives in such lubricating oil compositions for reducing sludge formation in use of such engines and/or improving the performance of an engine lubricated with the lubricating oil composition.

Sludge that forms as the oil is heated to temperatures greater than 100° C. is referred to as black sludge, or high-temperature sludge, and is found in hotter parts of the engine when relatively little water is present such as the oil pan and crankcase. White sludge, or low temperature sludge, is formed in cooler parts of the engine such as the oil cap and at low operating temperatures, where water can condense and form an emulsion with the oil.

There are many different theories as to why black sludge forms with internal combustion engines, see for example:

1. D. Ramirez, R. M. Kowalczyk and C. D. Collins, Characterisation of oil sludges from different sources before treatment: High-field nuclear magnetic resonance (NMR) in the determination of oil and water content, *J. Pet. Sci. Eng.,* 2019, 174, 729-737.
2. D. Rogers, W. Rice and F. Jonach, Mechanism of Engine Sludge, *SAE Tech. Pap.,* 1956, 64, 782-811.
3. B. I. Kosteteskii, Y. M. Tarasov, N. P. Khalyavka, I. V. Vyazovaya and E. P. Phalyavka, Chemmotology of Fuels and Lubricants., *Chem. Technol. Fuels Oils,* 1977, 13, 667-668.
4. C. Xu, Y. Zhang, H. Zhao and Q. Shi, Molecular investigation of crude oil sludge from an electric dehydrator, *Energy Fuels,* 2011, 25, 3116-3124.
5. L. S. Khuong, N. W. M. Zulkifli, H. H. Masjuki, E. Niza Mohamad, A. Arslan, H. M. Mosarof and A. Azham, A review on the effect of bioethanol dilution on the properties and performance of automotive lubricants in gasoline engines, *RSC Adv.,* 2016, 6, 66847-66869.
6. G. Aguilar, G. Mazzamaro and M. Rasberger, in *Chemistry and Technology of Lubricants,* 3rd edn., 2010, pp. 99-143.
7. M. Kawamura, H. Moritani, M. Nakada and M. Oohori, *Sludge Formation and Engine Oil Dispersancy Evalustion with Laboratory Scale Slidge Simulator*, SAE Technical Paper, 892105, AP-799 International Fuels and Lubricants Meeting and Exposition Baltimore Maryland, USA Sep. 25-28, 1989.
8. B. D. Vineyard and A., Coran, in *ACS New York City Meeting*, Div. Petrol. Chem., 1969, p. A25.
9. D. R. Coultas, The Role of NOx in Engine Lubricant Oxidation, *SAE Tech. Pap.,* 2020, DOI.10.4271/2020-01-1427.

Recently certain original equipment manufacturers have issued new specifications that require better black sludge handling capability, such as Mercedes Benz specification M271EVO. The M271EVO specification is a key formulation defining test for sludge handling in European passenger car motor oil applications.

Thus, there is a need to provide new engine oils having sludge handling capabilities that meet these and other requirements.

While not wishing to be bound by any specific theory, it has been found that when block copolymers having a block derived from monoalkenyl arene (such as a block derived from styrene) covalently linked to a hydrogenated polydiene block (such as a block derived from isoprene, butadiene or a mixture thereof) are dispersed in highly saturated diluent oils, the polystyrene blocks of the block copolymer chains aggregate (associate) to form micelles having an oil-devoid region at the core, surrounded by a brush-like layer, called a corona, made up of the polydiene chains. Micelle formation appears to be driven primarily by an unfavorable interaction (incompatibility) between the polystyrene blocks and the highly saturated diluent oil. This incompatibility also may dictate certain morphological attributes, such as the number of chains per micelle, which, in turn, may influence the number density of micelles and the thickening efficiency of the associated polymer chains. An excessively high level of incompatibility may prevent the formation of a kinetically stable concentrate, (a concentrate with which performance is uninfluenced by the temperature at which, or the time the concentrate is stored). Conversely, an excessively low level of incompatibility can reduce the degree to which the polystyrene blocks aggregate and can adversely impact the thickening efficiency of the copolymer. US 2015/184105A1 discloses that to provide an optimized viscosity index improver concentrate, the level of incompatibility between the polyarene blocks of the block copolymer and the selected highly saturated diluent oil can be controlled to be within an optimum range and, that the level of compatibility can be controlled by controlling the size of the block derived from monoalkenyl arene monomer.

U.S. Pat. No. 9,133,413 discloses polymers suitable for use as viscosity index improvers for lubricating oil compositions, which polymers comprise linear triblock polymers and/or star-polymers having multiple triblock arms coupled to a central core, such as a divinylbenzene (DVB) core, wherein the triblock polymers or triblock arms contain a block derived from monoalkenyl arene monomer positioned between two partially or fully hydrogenated blocks derived from diene, wherein at least one of the diene blocks is a copolymer derived from mixed diene monomer, in which from about 65 wt. % to about 95 wt. % of the incorporated monomer units are from isoprene and from about 5 wt. %, up to about 35 wt. % of the incorporated monomer units are from butadiene, and wherein at least about 80 wt. %, preferably at least about 90 wt. %, of butadiene is incorporated into the random copolymer block in a 1, 4-configuration.

U.S. Pat. No. 11,414,618 discloses polymers suitable for use as viscosity index improvers or viscosity modifiers for lubricating oil compositions, which polymers comprise linear triblock copolymers containing a block derived from monoalkenyl arene monomer (PA) positioned between two partially or fully hydrogenated blocks derived from diene.

U.S. Pat. No. 5,458,791 discloses multi-arm star polymers having triblock copolymer arms of hydrogenated polyisoprene-polystyrene-polyisoprene.

U.S. Pat. No. 10,479,956 discloses use of star shaped and block hydrogenated polyisoprene-polystyrene-polyisoprene in formulating high fuel economy engine oils.

CN 106336490B discloses hydrogenated styrene diene copolymer (dispersant) viscosity index improvers and preparation method thereof where the copolymer is functionalized with a nitrogen containing monomer.

Other references of interest include: WO 2008/013753; WO 2021/064059; U.S. Pat. Nos. 7,163,913, 5,458,791; 6,869,919; 6,715,473; US 2020/0157456; US 2004/0259742; U.S. Pat. No. 6,869,919; and WO 2009/102387.

It has now surprisingly been found by the present inventors that certain styrenic block copolymers can be used in a lubricant composition, such as in internal combustion engines, to provide enhanced sludge handling.

SUMMARY OF THE INVENTION

This invention relates to a lubricating oil composition comprising or resulting from the admixing of: (i) base oil, (ii) styrenic radial block copolymer (where one or more blocks derived from conjugated diene monomers are distal to the radial center and one more blocks derived from vinyl aromatic monomers that are proximal to the radial center), (iii) detergent, (iv) dispersant, (v) optional antioxidant.

This invention further relates to a lubricating oil composition comprising or resulting from the admixing of:

(i) at least 50 mass % of one or more base oils, based upon the weight of the lubricating oil composition;

(ii) one or more dispersants;

(iii) one or more detergents (such as Group II metal containing detergents, such as calcium and or magnesium containing detergents); and (iv) one or more styrenic block copolymers having:

a) a radial structure where one or more blocks derived from conjugated diene monomers are distal to the radial center and one more blocks derived from vinyl aromatic monomers that are proximal to the radial center;

b) line roughness, Ra, of 7 μm or more, as determined by Keyence surface analysis of a film of the neat (i.e., no solvent or diluent) polymer; and c) an intrinsic viscosity, [η], measured at a shear rate of $2\times10^6$ $s^{-1}$ at 40° C. that is less than the intrinsic viscosity measured at the same shear rate at 80° C., as determined by Ultra Shear Viscometry on a blend of 99.8 mass % of Group III base stock having a viscosity index of greater than 120 and a $KV_{100}$ of about 4.0 cSt (such as Yubase™ 4) and 0.2 mass % copolymer.

According to another aspect of the present invention, there is provided the use of the lubricating oil composition described herein for providing improved sludge handling properties as measured by the MB M271 EVO test performed according to CEC L-107 M271 EVO Sludge Deposit Test.

BRIEF DESCRIPTION OF THE DRAWINGS

FIG. 1 (FIG. 1) is FTIR spectra of the block copolymers of Example 1. S-I-B block copolymer is the top spectra and I-B-S block copolymer is the bottom spectra.

FIG. 2 (FIG. 2) is GPC trace of the block copolymers of Example 1. S-I-B block copolymer is the top spectra and I-B-S block copolymer is the bottom spectra.

FIG. 3 (FIG. 3) is a picture of two film samples illustrating clarity (Flat surface) versus distortion ("Orange Peel"—bumpy surface) in film samples from Example 3.

FIG. 4 (FIG. 4) shows line depth profiles for polymers used in Example 4. Note the differences in y-axis values.

FIGS. 5A and 5B (FIG. 5A, FIG. 5B) show depth profiles for polymers similar to those used in Example 4.

FIG. 6 (FIG. 6) shows hydrodynamic radius for polymers similar to those used in Example 4.

DEFINITIONS

For purposes of this specification and all claims to this invention, the following words and expressions, if and when used, have the meanings ascribed below.

For purposes herein, the new numbering scheme for the Periodic Table of the Elements is used as set out in CHEMICAL AND ENGINEERING NEWS, 63(5), 27 (1985), i.e., Alkali metals are group 1 metals (e.g., Li, Na, K, etc.) and Alkaline earth metals are group 2 metals (e.g., Mg, Ca, Ba, etc.).

The term "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies.

The term "LOC" means lubricating oil composition.

The term "mass %" means mass percent of a component, based upon the mass of the composition as measured in grams, unless otherwise indicated, and is alternately referred to as weight percent ("weight %", "wt %", or "% w/w").

The term "major amount" means more than 50 mass % of a composition, such as more than 60 mass % of a composition, such as more than 70 mass % of a composition, such as from 80 to 99.009 mass % of a composition, such as from 80 to 99.9 mass % of a composition, of a composition based upon the mass of the composition.

The term "minor amount" means 50 mass % or less of a composition; such as 40 mass % or less of a composition; such as 30 mass % or less of a composition, such as from 20 to 0.001 mass %, such as from 20 to 0.1 mass %, based upon the mass of the composition.

The term "active ingredient" (also referred to as "a.i." or "A.I.") refers to additive material that is neither diluent nor solvent. Unless otherwise indicated, amounts herein are described as active ingredient.

The terms "oil-soluble" and "oil-dispersible," or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired.

The term "hydrocarbon" means a compound of hydrogen and carbon atoms. A "heteroatom" is an atom other than carbon or hydrogen. When referred to as "hydrocarbons," in the context of "refined hydrocarbons," the hydrocarbons may also contain one or more heteroatoms or heteroatom-containing groups (such as halo, especially chloro and fluoro, amino, alkoxyl, mercapto, alkylmercapto, nitro, nitroso, sulfoxy, etc.) in minor amounts (e.g., where the heteroatom(s) do not substantially alter the hydrocarbon properties of the hydrocarbon composition).

The terms "group" and "radical" are used interchangeably herein.

The term "hydrocarbyl" means a radical/group that contains hydrogen and carbon atoms. Preferably, the group consists essentially of, more preferably consists only of, hydrogen and carbon atoms, unless specified otherwise. Preferably, the hydrocarbyl group comprises an aliphatic hydrocarbyl group. The term "hydrocarbyl" includes "alkyl," "alkenyl," "alkynyl," and "aryl" as defined herein. Hydrocarbyl groups may contain one or more atoms/groups other than carbon and hydrogen provided they do not affect the essentially hydrocarbyl nature of the hydrocarbyl group. Those skilled in the art will be aware of such atoms/groups (e.g., halo, especially chloro and fluoro, amino, alkoxyl, mercapto, alkylmercapto, nitro, nitroso, sulfoxy, etc.).

The term "alkyl" means a radical of carbon and hydrogen (such as a $C_1$ to $C_{30}$, such as a $C_1$ to $C_{12}$ group). Alkyl groups in a compound are typically bonded to the compound directly via a carbon atom. Unless otherwise specified, alkyl groups may be linear (i.e., unbranched) or branched, be cyclic, acyclic, or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl.

The term "alkenyl" means a radical of carbon and hydrogen (such as a $C_2$ to $C_{30}$ radical, such as a $C_2$ to $C_{12}$ radical) having at least one double bond. Alkenyl groups in a compound are typically bonded to the compound directly via a carbon atom. Unless otherwise specified, alkenyl groups may be linear (i.e., unbranched) or branched, be cyclic, acyclic or part cyclic/acyclic.

The term "alkylene" means a $C_1$ to $C_{20}$, preferably a $C_1$ to $C_{10}$, bivalent saturated aliphatic radical, which may be linear or branched. Representative examples of alkylene include methylene, ethylene, propylene, butylene, pentylene, hexylene, heptylene, octylene, nonylene, decylene, 1-methyl ethylene, 1-ethyl ethylene, 1-ethyl-2-methyl ethylene, 1,1-dimethyl ethylene, and 1-ethyl propylene.

An "olefin", alternatively referred to as "alkene," is a linear, branched, or cyclic compound of carbon and hydrogen having at least one double bond. For purposes of this specification and the claims appended thereto, when a polymer or copolymer is referred to as comprising an olefin, the olefin present in such polymer or copolymer is the polymerized form of the olefin. For example, when a copolymer is said to have an "isoprene" content of 55 wt % to 95 wt %, it is understood that the mer unit in the copolymer is derived from isoprene in the polymerization reaction and said derived units are present at 55 wt % to 95 wt %, based upon the weight of the copolymer. A "polymer" has two or more of the same or different mer units. A "homopolymer" is a polymer having mer units that are the same. A "copolymer" is a polymer having two or more mer units that are different from each other. "Different" as used to refer to mer units indicates that the mer units differ from each other by at least one atom or are different isomerically. An "isoprene polymer" or "isoprene copolymer" is a polymer or copolymer comprising at least 50 mol % isoprene derived units, a "butadiene polymer" or "butadiene copolymer" is a polymer or copolymer comprising at least 50 mol % butadiene derived units, and so on. Likewise, when a polymer is referred to as a "partially or fully saturated polymer comprising $C_{4-8}$ olefins," the $C_{4-8}$ olefin(s) present in such polymer or copolymer are the polymerized form of the olefin(s), and the polymer has been partially or fully saturated (such as by hydrogenation) after polymerization of the monomers.

The term "alkynyl" means a $C_2$ to $C_{30}$ (such as a $C_2$ to $C_{12}$) radical, which includes at least one carbon-to-carbon triple bond.

The term "aryl" means a group containing at least one aromatic ring, such a cyclopentadiene, phenyl, naphthyl, anthracenyl, and the like. Aryl groups are typically $C_5$ to $C_{40}$ (such as $C_5$ to $C_{18}$, such as $C_6$ to $C_{14}$) aryl groups, optionally substituted by one or more hydrocarbyl groups, heteroatoms, or heteroatom-containing groups (such as halo, hydroxyl, alkoxy and amino groups). Preferred aryl groups include phenyl and naphthyl groups and substituted derivatives thereof, especially phenyl, and alkyl substituted derivatives of phenyl.

The term "substituted" means that a hydrogen atom has been replaced with hydrocarbon group, a heteroatom, or a heteroatom-containing group. An alkyl substituted derivative means a hydrogen atom has been replaced with an alkyl group. An "alkyl substituted phenyl" is a phenyl group where a hydrogen atom has been replaced by an alkyl group, such as a $C_1$ to $C_{20}$ alkyl group, such as methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and/or triacontyl.

The term "halogen" or "halo" means a group 17 atom or a radical of group 17 atom, such as fluoro, chloro, bromo, and iodo.

The term "ashless" in relation to an additive means the composition does not include a metal.

The term "ash-containing" in relation to an additive means the composition includes a metal.

The term "effective amount" in respect of an additive means an amount of such an additive in a lubricating oil composition so that the additive provides the desired technical effect.

The term "effective minor amount" in respect of an additive means an amount of such an additive of less than 50 mass % of the lubricating oil composition so that the additive provides the desired technical effect.

The term "effective major amount" in respect of an additive means an amount of such an additive of 50 mass % or more of the lubricating oil composition so that the additive provides the desired technical effect.

The term "ppm" means parts per million by mass, based on the total mass of the lubricating oil composition, unless otherwise indicated.

The term "metal content" of a lubricating oil composition or of an additive component, for example, magnesium content, molybdenum content or total metal content (i.e., the sum of all individual metal contents), is measured by ASTM D5185.

The term "aliphatic hydrocarbyl fatty acid" means a monocarboxylic acid having an aliphatic $C_7$ to $C_{29}$, preferably a $C_9$ to $C_{27}$, most preferably a $C_{11}$ to $C_{23}$ hydrocarbyl chain. Such compounds may be referred to herein as aliphatic ($C_7$ to $C_{29}$), more preferably ($C_9$ to $C_{27}$), most preferably ($C_{11}$ to $C_{23}$), hydrocarbyl monocarboxylic acid(s) or hydrocarbyl fatty acid(s) (wherein Cx to Cy designates the total number of carbon atoms in the aliphatic hydrocarbyl chain of the fatty acid, the fatty acid itself due to the presence of the carboxyl carbon atom includes a total of Cx+1 to Cy+1 carbon atoms). Preferably, the aliphatic hydrocarbyl fatty acid, inclusive of the carboxyl carbon atom, has an even number of carbon atoms. The aliphatic hydrocarbyl chain of the fatty acid may be saturated or unsaturated (i.e., includes at least one carbon-to-carbon double bond); preferably, the aliphatic hydrocarbyl chain is unsaturated and includes at least one carbon-to-carbon double bond—such fatty acids may be obtained from natural sources (e.g., derived from animal or vegetable oils) and/or by reduction of the corresponding saturated fatty acid. It will be appreciated that a proportion of the aliphatic hydrocarbyl chain(s) of the corresponding aliphatic hydrocarbyl fatty acid ester(s) is unsaturated (i.e., includes at least one carbon-to-carbon double bond) to permit reaction with other agents, such as sulfur, to form the corresponding functionalized, such as sulfurized, aliphatic hydrocarbyl fatty acid ester(s).

The term "aliphatic hydrocarbyl fatty acid ester" means an ester obtainable by converting the monocarboxylic acid functional group of the corresponding aliphatic hydrocarbyl fatty acid into an ester group. Suitably, the monocarboxylic acid functional group of the aliphatic hydrocarbyl fatty acid is converted to a hydrocarbyl ester, preferably a $C_1$ to $C_{30}$ aliphatic hydrocarbyl ester, such as an alkyl ester, preferably a $C_1$ to $C_6$ alkyl ester, especially a methyl ester. Alternatively, or additionally, the monocarboxylic acid functional group of the aliphatic hydrocarbyl fatty acid may be in the form of the natural glycerol ester. Accordingly, the term "aliphatic hydrocarbyl fatty acid ester" embraces aliphatic hydrocarbyl fatty acid glycerol ester(s) and aliphatic hydrocarbyl fatty acid $C_1$ to $C_{30}$ aliphatic hydrocarbyl ester(s), [e.g., aliphatic hydrocarbyl fatty acid alkyl ester(s), more preferably aliphatic hydrocarbyl fatty acid $C_1$ to $C_6$ alkyl ester(s), especially aliphatic hydrocarbyl fatty acid methyl ester(s)]. Suitably, the term "aliphatic hydrocarbyl fatty acid ester" embraces aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid glycerol ester(s) and aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid $C_1$ to $C_{30}$ aliphatic hydrocarbyl ester(s). Suitably, to permit functionalization, such as sulfurization, of the aliphatic hydrocarbyl fatty acid ester(s) a proportion of the aliphatic hydrocarbyl chain(s) of the fatty acid ester(s) is unsaturated and includes at least one carbon-to-carbon double bond.

The term "sulfurized aliphatic hydrocarbyl fatty acid ester" means a compound obtained by sulfurizing an aliphatic hydrocarbyl fatty acid ester as defined herein.

The term "absent" as it relates to components included within the lubricating oil compositions described herein and the claims thereto means that the particular component is present at 0 wt %, based upon the weight of the lubricating oil composition, or if present in the lubricating oil composition the component is present at levels that do not impact the lubricating oil composition properties, such as less than 10 ppm, or less than 1 ppm or less than 0.001 ppm. When the term "absent" is used in relation to monomer reactants and/or to repeat units in (co)polymers described herein, it means present at 0 wt %, based upon the weight of all (co)monomers in the (co)polymer, or, if present at all, at levels so low that they do not substantially impact the physical properties of the (co)polymer, such as at 0.2 wt % or less or at 0.1 wt % or less.

As used herein, Mn is number average molecular weight, Mw is weight average molecular weight, and Mz is z average molecular weight. Molecular weight distribution (MWD), also referred to as polydispersity index (PDI), is defined to be Mw divided by Mn. Unless otherwise noted, all molecular weight units (e.g., Mw, Mn, Mz) are reported in g/mol.

Total Base Number also referred to as "TBN," in relation to an additive component or of a lubricating oil composition (i.e., unused lubricating oil composition) means total base number as measured by ASTM D2896 and reported in units of mgKOH/g.

Total Acid Number ("TAN") is determined by ASTM D664.

Phosphorus, Boron, Calcium, Zinc, Molybdenum, Sodium, Silicon, and Magnesium content are measured by ASTM D5185.

Sulfur content in oil formulations is measured by ASTM D5185.

Sulfated ash ("SASH") content is measured by ASTM D874.

Kinematic viscosity (KV100, KV40) is determined pursuant to ASTM D445-19a and reported in units of cSt, unless otherwise specified.

Viscosity index is determined according to ASTM D2270.

Saponification number is determined by ASTM D94, and reported in units of mgKOH/g.

"HTCBT, high temperature corrosion bench test, is determined pursuant to ASTM D6594.

Unless otherwise indicated, all percentages reported are mass % on an active ingredient basis, i.e., without regard to carrier or diluent oil, unless otherwise indicated.

Also, it will be understood that various components used, essential as well as optimal and customary, may react under conditions of formulation, storage or use and that the disclosure also provides the product obtainable or obtained as a result of any such reaction.

Further, it is understood that any upper and lower quantity, range and ratio limits set forth herein may be independently combined.

Also, it will be understood that the preferred features of each aspect of the present disclosure are regarded as preferred features of every other aspect of the present disclosure. Accordingly, preferred and more preferred features of one aspect of the present disclosure may be independently combined with other preferred and/or more preferred features of the same aspect or different aspects of the present disclosure.

DETAILED DESCRIPTION OF THE INVENTION

The features of the disclosure relating, where appropriate, to each and all aspects of the disclosure, will now be described in more detail as follows.

The lubricating oil compositions of the disclosure comprise components that may or may not remain the same chemically before and after mixing with an oleaginous carrier (such as a base oil) and/or other additives. This disclosure encompasses compositions which comprise the components before mixing, or after mixing, or both before and after mixing.

Lubricating Oil Compositions

This disclosure relates to lubricating oil compositions (also referred to as "LOC," "lubricant compositions," "lubricating compositions," or "lubricant oil compositions") comprising or resulting from the admixing of:

(a) from 1 to 99 mass % (alternately 30 to 95 mass %, alternately 50 to 90 mass %, alternately 60 to 95 mass %, alternately 70 to 85 mass %) of one or more base oils, based upon the weight of the lubricating composition;

(b) from 0.10 to 20 mass % (in particular 0.15 to 10 mass %, alternately 0.20 mass % to 5 mass %, alternately 0.25 to 2 mass %, alternately 0.5 to 1 mass %), based upon the weight of the composition, of one or more styrenic block copolymers having:

i) a radial structure where one or more blocks derived from conjugated diene monomers are distal to the radial center and one more blocks derived from vinyl aromatic monomers that are proximal to the radial center;

ii) line roughness, Ra, of 7 μm or more, as determined by Keyence surface analysis of a film of the neat (i.e., no solvent or diluent) polymer; and iii) an intrinsic viscosity, [η], measured at a shear rate of $2\times10^6$ $s^{-1}$ at 40° C. that is less than the intrinsic viscosity measured at a shear rate of $2\times10^6$ $s^{-1}$ at 80° C., as determined by Ultra Shear Viscometry on a blend of 99.8 mass % of Group III base stock having a viscosity index of greater than 120 and a $KV_{100}$ of about 4.0 cSt (such as Yubase™ 4) and 0.2 mass % copolymer.

where the lubricating oil composition may preferably exhibit greater than 9.2 credits (such as 9.4 credits or more, such as 10 credits or more) in sludge handling properties as measured by the MB M271 EVO test performed according to CEC L-107 M271 EVO Sludge Deposit Test.

This disclosure also relates to lubricating oil compositions comprising or resulting from the admixing of:

(i) from 1 to 99 mass % (alternately 30 to 95 mass %, alternately 50 to 90 mass %, alternately 60 to 95 mass %, alternately 70 to 85 mass %) of one or more base oils, based upon the weight of the lubricating composition;

(ii) from 0.01 to 20 mass % (in particular 0.1 to 12 mass %, alternately 0.1 to 8 mass %), based on total weight of the lubricating composition, of one or more dispersants (such as blends of dispersants);

(iii) from 0.10 to 20 mass % (in particular 0.15 to 10 mass %, alternately 0.20 mass % to 5 mass %, alternately 0.25 to 2 mass %), based upon the weight of the composition, of one or more detergents;

(iv) from 0.001 to 10 wt % (in particular, 0.01 to 5 wt %, alternately 0.1 to 3 mass %, alternately 0.25 to 1.5 mass %, alternately 0.5 to 1.0 mass %), based on total weight of the lubricating composition, of one or more styrenic block copolymers having:

a) a radial structure where one or more blocks derived from conjugated diene monomers are distal to the radial center and one more blocks derived from vinyl aromatic monomers that are proximal to the radial center;

b) line roughness, Ra, of 7 μm or more, as determined by Keyence surface analysis of a film of the neat (i.e., no solvent or diluent) polymer; and c) an intrinsic viscosity, [η], measured at a shear rate of $2\times10^6$ $s^{-1}$ at 40° C. that is less than the intrinsic viscosity measured at a shear rate of $2\times10^6$ $s^{-1}$ at 80° C., as determined by Ultra Shear Viscometry on a blend of 99.8 mass % of Group III base stock having a viscosity index of greater than 120 and a $KV_{100}$ of about 4.0 cSt (such as Yubase™ 4) and 0.2 mass % copolymer;

d) optionally, from 0.01 to 10 wt % (in particular, 0.01 to 5 wt %, alternately 0.01 to 3 mass %, alternately 0.1 to 1.5 mass %), based on total weight of the lubricating oil composition, of one or more antioxidants (such as blends of antioxidants):

where the lubricating oil composition may preferably exhibit where the lubricating oil composition may preferably exhibit greater than 9.2 credits (such as 9.4 credits or more, such as 10 credits or more) in sludge handling properties as measured by the MB M271 EVO test performed according to CEC L-107 M271 EVO Sludge Deposit Test.

This disclosure also relates to lubricating oil compositions comprising or resulting from the admixing of:

A) from 1 to 99 mass % (alternately 30 to 95 mass %, alternately 50 to 90 mass %, alternately 60 to 95 mass %, alternately 70 to 85 mass %) based upon the weight of the lubricating oil composition, of one or more base oils;

B) from 0.10 to 20 mass % (in particular, 0.15 to 10 mass %, alternately 0.20 mass % to 5 mass %, alternately 0.25 to 2 mass %), based on total weight of the lubricating oil composition, of one or more styrenic block copolymers having:

a) a radial structure where one or more blocks derived from conjugated diene monomers are distal to the radial center and one more blocks derived from vinyl aromatic monomers that are proximal to the radial center;

b) line roughness, Ra, of 7 μm or more, as determined by Keyence surface analysis of a film of the neat (i.e., no solvent or diluent) polymer; and c) an intrinsic viscosity, [η], measured at a shear rate of $2\times10^6$ $s^{-1}$ at 40° C. that is less than the intrinsic viscosity measured at a shear rate of $2\times10^6$ $s^{-1}$ at 80° C., as determined by Ultra Shear Viscometry on a blend of 99.8 mass % of Group III base stock having a viscosity index of greater than 120 and a $KV_{100}$ of about 4.0 cSt (such as Yubase™ 4) and 0.2 mass % copolymer;

C) from 0.10 to 20 mass % (in particular, 0.15 to 10 mass %, alternately 0.20 mass % to 5 mass %, alternately 0.25 to 2 mass %), based upon the weight of the lubricating oil composition, of one or more detergents (such as blends of detergents);

D) optionally, from 0.01 to 5 wt % (in particular 0.1 to 4 mass %, alternately 0.25 to 3 mass %, alternately 0.045-0.15 mass %), based on total weight of the lubricating oil composition, of one or more friction modifiers (such as blends of friction modifiers);

E) optionally, from 0.01 to 10 wt % (in particular, 0.01 to 5 wt %, alternately 0.01 to 3 mass %, alternately 0.1 to 1.5 mass %), based on total weight of the lubricating oil composition, of one or more antioxidants (such as blends of antioxidants);

F) optionally, from 0.01 to 5 wt % (in particular, 0.01 to 3 mass %, alternately 0.1 to 1.5 mass %), based on total weight of the lubricating oil composition, of one or more pour point depressants (such as blends of pour point depressants);

G) optionally, from 0.001 to 5 wt % (in particular, 0.01 to 3 mass %, alternately 0.1 to 1.5 mass %), based on total weight of the lubricating oil composition, of one or more anti-foam agents (such as blends of anti-foam agents);

H) optionally, from 0.001 to 10 wt % (in particular, 0.01 to 6 wt %, alternately 0.01 to 5 mass %, alternately 0.1 to 4 mass %, alternately 0.1 to 2 mass %, alternately 0.1 to 1 mass %), based on total weight of the lubricating oil composition, of one or more viscosity modifiers (such as blends of viscosity modifiers) other than the styrenic block copolymers of B) above;

I) optionally, from 0.01 to 20 wt % (in particular, 0.1 to 12 mass %, alternately 0.1 to 8 mass %), based on total weight of the lubricating oil composition, of one or more dispersants (such as blends of dispersants);

J) optionally, from 0.01 to 5 wt % (in particular, 0.1 to 3 mass %, alternately 0.1 to 1.5 mass %), based on total weight of the lubricating oil composition, of one or more inhibitors and/or anti-rust agents (such as blends of inhibitors and/or anti-rust agents);

K) from 0.001 to 10 wt % (in particular, 0.01 to 5 wt %, alternately 0.1 to 3 mass 00 alternately 0. to 1.5 mass %), based on total weight of the lubricating oil composition, of one or more anti-wear agents (such as blends of anti-wear agents, such as ZDDP);

M) optionally, from 0.01 to 5 wt % (in particular, 0.05 to 2 mass %, alternately 0.1 to 1 mass %), based on total weight of the lubricating oil composition, of one or more seal compatibility agents, such as seal swell agents, and/or O) optionally, from 0.01 to 5 wt % (in particular, 0.1 to 3 mass %, alternately 0.1 to 1.5 mass %), based on total weight of the lubricating oil composition, of one or more unsaturated $C_{12}$-$C_{60}$ hydrocarbons (such as $C_{12}$-$C_{24}$ linear alpha-olefins (LAOs), oligomers/polymers of polyisobutylenes, and/or blends thereof).

For purposes of this disclosure, component B) styrenic block copolymers are not added in the elements C, D, E, F G, H, I, J, K, M, and/or O above for determining weight percentages, even though they may show similar properties, e.g., element B) styrenic block copolymers may function to modify viscosity, but are not added into element H) for determining weight percent of viscosity modifiers.

Suitably, the lubricant composition may have a total base number (TBN) of 4 to 15 mgKOH/g, preferably 5 to 12 mgKOH/g, such as 7 to 12 mgKOH/g, such as 8 to 11 mgKOH/g, as measured by ASTM D2896.

The lubricating compositions of the present disclosure may contain low levels of phosphorus, namely not greater than 1600, preferably not greater than 1200, more preferably not greater than 800, such as 1 to 1600, such as 50 to 1200, such as 100 to 800 parts per million (ppm) by mass of phosphorus, expressed as atoms of phosphorus, based on the total mass of the lubricating compositions, as measured by ASTM D5185.

Suitably, the lubricant composition may have a phosphorus level of 1200 ppm or less, alternately 1000 ppm or less, alternately 800 ppm or less, as measured by ASTM D5185.

The lubricating compositions of the present disclosure may contain a ratio of atoms of Magnesium to atoms of Calcium based on the total mass of the lubricating compositions, as measured by ASTM D5185, of at least to 0.5, preferably at least 0.6, more preferably at least 0.65.

Typically, the lubricating compositions may contain low levels of sulfur. Preferably, the lubricating composition contains up to 0.4, more preferably up to 0.3, most preferably up to 0.2, such as 0.1 to 0.4 mass % sulfur, based on the total mass of the lubricating oil composition, as measured by ASTM D5185.

Typically, the lubricating compositions may contain low levels of sulfated ash, such as 1.2% or less, such as 1.0 mass % or less, preferably 0.9 mass or less %, preferably 0.8 mass % or less, alternately 0.0001 to 0.5 mass % or less sulfated ash, based on the total mass of the lubricating composition, as measured by ASTM D874-13a (2018).

Generally, the kinematic viscosity at 100° C. ("KV100") of the lubricating composition may range from 2 to 30 cSt, such as 2 to 20 cSt, such as 5 to 15 cSt as determined according to ASTM D 445-19a).

In embodiments, the kinematic viscosity at 100° C. ("KV100") of the lubricating composition may range from 6 to 17 cSt, such as 9 to 16.3 cSt, such as 9.3 to less than 12.5 cSt, such as 12.5 to less than 16.3 cSt, as determined according to ASTM D 445-19a).

Generally, the total base number of the lubricating composition may range from 1 to 30, such as 5 to 15 mgKOH/g, (as determined according to ASTM D2896).

Preferably, the lubricating composition of the present disclosure may be a multigrade oil identified by the viscometric descriptor SAE 20W-X, SAE 15W-X, SAE 10W-X, SAE 5W-X or SAE 0W-X, where X represents any one of 8, 12, 16, 20, 30, 40, and 50; the characteristics of the different viscometric grades can be found in the SAE J300 classification. Alternately, the lubricating composition may be the form of viscosity grade SAE 15W-X, SAE 10W-X, SAE 5W-X or SAE 0W-X, such as in the form of SAE 15W-X or SAE 10W-X, wherein X represents any one of 8, 12, 16, 20, 30, 40, and 50. Preferably X is 8, 12, 16, or 20. Alternately, the lubricating composition of the present disclosure may be a multigrade oil identified by the viscometric descriptor SAE 10W-30, 15W-40, 5W-30, 5W-40, 10W-40, 5W-50. (See standard SAE J300 published January 2015 by SAE International, formerly known as Society of Automotive Engineers).

Alternately, the lubricating composition may have a SAE viscosity grade of 0W-Y, wherein Y may be 12, 16, or 20. In one embodiment, the lubricating composition has an SAE viscosity grade of 0W-12.

Optionally, the lubricating composition may be absent phenolic antioxidant.

In embodiments, the lubricating oil composition may comprise less than 75 ppm boron, alternately less than 60 ppm boron, alternately from 1 to 70 ppm boron. Alternately, the LOC may be absent boron.

In embodiments, the lubricating oil composition may comprise acylated polymers, such as polyisobutylene succinic acid (PIBSA), optionally having an Mn of 500 to 50,000 g/mol, such as 600 to 5,000 g/mol, such as 700 to 3000 g/mol. In embodiments, the lubricating oil composition may comprise acylated polymers, such as polyisobutylene succinic acid, having an Mn of 500 to 1600 g/mol, such as 700 to 1200 g/mol. In embodiments, the lubricating oil composition comprises more than 0.1 (such as 0.1 to 10, such as 0.5 to 8) mass %, functionalized (such as aminated) polybutene (such as polyisobutylene), such as PIBSA-PAM.

In embodiments, the lubricating oil composition may have a total saponification number (SAP) of 25 (such as 28, such as 30, such as 32) mgKOH/g or more, as determined by ASTM 94.

In embodiments, the lubricating compositions of the present disclosure may be a heavy-duty diesel oil (e.g., for use in an engine for a heavy-duty diesel vehicle, i.e., a heavy-duty diesel vehicle having a gross vehicle weight rating of 10,000 pounds or more.)

In embodiments, the lubricating compositions of the present disclosure may be a passenger car motor oil.

In embodiments, the lubricating compositions of the present disclosure may be a passenger car diesel oil.

In embodiments, the lubricating composition of the present disclosure may be a diesel engine lubricating composition comprising: an oil of lubricating viscosity having greater than 50 wt % of Group I, II, III, IV, and/or V oil (such as a Group III base oil, a Group IV base oil, a Group V base oil, or mixtures thereof); a first PIB succinimide dispersant derived from an 1800 to 2500 Mn PIB; a second PIB succinimide dispersant derived from a PIB with an Mn less than 1600, where at least one of the first PIB succinimide dispersant(s) and the second PIB succinimide dispersant is boron-free (optionally, at least one of the first PIB succinimide dispersant(s) and the second PIB succinimide dispersant is borated); a amide, imide, and/or ester functionalized partially or fully saturated polymer comprising $C_{45}$ olefins as described herein; an alkaline earth metal salicylate detergent; an alkaline earth metal sulfonate detergent present in an amount to deliver 0.1 wt % to 1.2 wt % of alkaline earth metal soap to the lubricating composition; and a phosphorus anti wear agent present in an amount to deliver 300 to 900 ppm phosphorous to the lubricating composition, the lubricating composition having a total sulfated ash of between 0.3 to 1.1 wt %; a kinematic viscosity at 100° C. of less than 8.3 cSt; a total alkaline earth metal soap of from 0.6 wt % to 2.1 wt %, and a HTHS150 measured according to ASTM D4683 of less than 2.7 mPa s.

The lubricating compositions disclosed herein, such as diesel engine lubricating compositions, may have a kinematic viscosity as measured by ASTM D-445 at 100° C. of from 2.5 to 8.3 (such as 2.5 to 6.5, or 3 to 5.5, or 3.5 to 6.5) cSt ($mm^2/s$) and a kinematic viscosity at 40° C. of from 15 to 30 (such as 15 to 25) cSt ($mm^2/s$).

The lubricating composition disclosed herein, such as diesel engine lubricating compositions, may have a high temperature, high shear viscosity (HTHS) as measured by ASTM D4683 at 150° C. of less than 2.6 mPa s, or less than 2.5 mPa s, or less than 2.4 mPa s, or less than 2.3 mPa s, or less than 2.2 mPa s, or less than 2.1 mPa s. In another embodiment, the HTHS of the lubricating composition is from 1.4 to 2.5 mPa s, or from 1.6 to 2.1 mPa s, or from 1.8 to 2.1 mPa s, or from 1.9 to 2.0 mPa s.

The lubricating composition, such as diesel engine lubricating compositions, may have a SAE viscosity grade of 0W-Y, wherein Y may be 12, 16, or 20. In one embodiment, the lubricating composition has an SAE viscosity grade of 0W-12.

The lubricating compositions disclosed herein, such as diesel engine lubricating compositions, may have: 1) a kinematic viscosity as measured by ASTM D-445 at 100° C. of from 2.5 to 8.3 (such as 2.5 to 6.5, or 3 to 5.5, or 3.5 to 6.5) cSt ($mm^2/s$); 2) a high temperature, high shear viscosity (HTHS) as measured by ASTM D4683 at 150° C. of less than 2.6 mPa s, or less than 2.5 mPa s, or less than 2.4 mPa s, or less than 2.3 mPa s, or less than 2.2 mPa s, or less than 2.1 mPa s (alternately from 1.4 to 2.5 mPa s, or from 1.6 to 2.1 mPa s, or from 1.8 to 2.1 mPa s, or from 1.9 to 2.0 mPa s); and 3) a SAE viscosity grade of 0W-Y, wherein Y may be 12, 16, or 20 (such as 0W-12).

Even still further additionally or alternatively, lubricant compositions according to the present disclosure, particularly those formulated to meet SAE 5W50 or 5W-60 lubricant specifications, may exhibit a soot dispersancy, as measured in the presence of an additional approximately 6 wt % carbon black in the lubricant composition, so as to achieve an apparent yield stress (APY non-linear rheological model) value of at most 9 Pa, e.g., at most 8.5 Pa, at most 8 Pa, at most 7 Pa, at most 6 Pa, at most 5 Pa, at most 4, at most 5 Pa, at most 2 Pa, at most 1.75 Pa. There is not necessarily a lower limit for soot dispersancy in APY terms, as a minimum measured APY value of 0.00 Pa reflects a very highly soot-dispersant composition.

Even still further additionally or alternatively, lubricant compositions according to the present disclosure, particularly those formulated to meet SAE 5W50 or 5W-60 lubricant specifications, may exhibit a soot dispersancy, as measured in the presence of an additional approximately 9 wt % carbon black in the lubricant composition, so as to achieve an apparent yield stress (APY non-linear rheological model) value of at most 40 Pa, e.g., at most 37 Pa, at most 30 Pa, at most 20 Pa, at most 15 Pa, at most 10 Pa, at most 5, at most 1 Pa, at most 0.1 Pa, at most 0.05 Pa.

Even still further additionally or alternatively, lubricant compositions according to the present disclosure, particularly those formulated to meet SAE 5W50 or 5W-60 lubricant specifications, may exhibit a soot dispersancy, as measured in the presence of an additional approximately 12 wt % carbon black in the lubricant composition, so as to achieve an apparent yield stress (APY non-linear rheological model) value of at most 78 Pa, e.g., at most 63 Pa, at most 30 Pa, at most 20 Pa, at most 15 Pa, at most 11 Pa.

Additive Concentrates

Additive concentrate, also referred to as an additive package, adpak, or addpack, is a composition having less than 50 mass % (such as less than 40 mass %, such as less than 30 mass %, such as less than 25 mass %, such as less than 20 mass %) base oil and lubricant composition additives (such as described herein) which is typically then further blended with additional base oil to form a lubricating oil product.

This disclosure relates to additive concentrate compositions comprising or resulting from the admixing of:

(i) from 1 to less than 50 mass % (alternately 5 to 45 mass %, alternately 7 to 40 mass %, alternately 10 to 35 mass %, alternately 10 to 25 mass %), based upon the weight of the composition, of one or more base oil(s);

(ii) from 0.10 to 20 mass % (in particular 0.15 to 10 mass %, alternately 0.20 mass % to 5 mass %, alternately 0.25 to 2 mass %), based upon the weight of the composition, of one or more detergent(s);

(iii) from 0.10 to 20 mass % (in particular 0.15 to 10 mass %, alternately 0.20 mass % to 5 mass %, alternately 0.25 to 2 mass %), based upon the weight of the composition, of one or more dispersant(s) (such as PIBSA-PAM); and (iv) optional additional components, antioxidants, pour point depressants, anti-foam agents, viscosity modifiers, corrosion inhibitors, anti-wear agents, extreme pressure additives, demulsifiers, seal compatibility agents, additive diluent base oils, friction modifier(s) (such as, organic FM, such as organic ester, such as fatty acid ester), etc.

In embodiments, the additive concentrate composition may optionally be absent solvent (such as aliphatic or aromatic solvent) and/or absent functionalized base oil.

This disclosure also relates to additive concentrate compositions comprising or resulting from the admixing of:

A) from 1 to less than 50 mass % (alternately 5 to 45 mass %, alternately 7 to 40 mass %, alternately 10 to 35 mass %, alternately 10 to 25 mass %), based upon the weight of the additive concentrate composition, of one or more base oil(s);

C) from 0.1 to 20 wt % (in particular 0.5 to 10 mass %, alternately 2 to 6 mass %), based on total weight of the additive concentrate composition, of one or more detergent(s) (such as blends of detergents);

D) optionally, from 0.01 to 5 wt % (in particular, 0.1 to 4 mass %, alternately 0.25 to 3 mass %, alternately 0.25 to 0.075 mass %), based on total weight of the additive concentrate composition, of one or more friction modifier(s) (such as organic friction modifiers, such as glycerol monoeoleate);

E) optionally, from 0.01 to 20 wt % (in particular, 0.01 to 15 mass %, alternately 0.1 to 10 mass %), based on total weight of the additive concentrate composition, of one or more antioxidant(s) (such as blends of antioxidants);

F) optionally, from 0.01 to 5 wt % (in particular, 0.01 to 3 mass %, alternately 0.1 to 1.5 mass %), based on total weight of the additive concentrate composition, of one or more pour point depressants (such as blends of pour point depressants);

G) optionally, from 0.001 to 5 wt % (in particular, 0.01 to 3 mass %, alternately 0.02 to 1 mass %), based on total weight of the additive concentrate composition, of one or more anti-foam agents (such as blends of anti-foam agents);

I) optionally, from 0.01 to 40 wt % (in particular, 0.1 to 30 mass %, alternately 1 to 20 mass %), based on total weight of the additive concentrate composition, of one or more dispersants (such as blends of dispersants);

K) optionally, from 0.001 to 10 wt % (in particular, 0.1 to 8 mass %, alternately 1 to 5 mass % alternately 0.25 to 0.075 mass %), based on total weight of the additive concentrate, of one or more anti-wear agents (such as blends of anti-wear agents, such as ZDDP).

Additive concentrates may be present in the lubricating oil composition at from of 0.5 mass % to 35 mass %, such as 5 mass % to 30 mass %, such as 7.5 mass % to 25 mass %, such as 10 to 22.5 mass %, such as 15 to 20 mass %, based upon the mass of the lubricating oil composition.

Optionally, the additive concentrate may be absent phenolic antioxidant, such as alkylated diphenylamine.

In embodiments, the additive concentrate may comprise acylated polymers, such as polyisobutylene succinic acid, optionally, having an Mn of 500 to 50,000 g/mol, such as 600 to 5,000 g/mol, such as 700 to 3000 g/mol. In embodiments, the additive concentrate may comprise acylated polymers, such as polyisobutylene succinic acid, having an Mn of 500 to 1600 g/mol, such as 700 to 1200 g/mol.

Viscosity Modifier Concentrates

A viscosity modifier concentrate ("VM concentrate") is a composition comprising viscosity modifier polymer (such as the styrenic block copolymer compositions describe in section B above) and diluent, typically having:

1) less than 50 mass % (such as less than 40 mass %, such as less than 30 mass %, such as less than 25 mass %, such as less than 20 mass %, such as from 1 to 50 mass %, such as from 3 to 40 mass %, such as from 5 to 25 mass %, such as 8 to 15 mass %) styrenic block copolymer viscosity modifier (such as described herein), and 2) more than 50 mass % (such as more than 60 mass %, such as more than 70 mass %, such as more than 75 mass %, such as more than 80 mass %, such as from 100 to 50 mass %, such as from 95 to 60 mass %, such as from 90 to 75 mass %) base oil (such as described herein) which is typically then further blended with an additive package and further base oil, among other things (such as viscosity index (VI) improvers, Lube oil flow improvers (LOFIs), pour point depressants, viscosity modifiers other than those described in section B above), to form a lubricating oil product.

In embodiments, the VM concentrate composition (such as VM concentrate comprising the styrenic block copolymer compositions describe in section B above) may optionally be absent solvent (such as aliphatic or aromatic solvent) and/or absent functionalized base oil.

VM Concentrate (such as VM concentrate comprising the styrenic block copolymer compositions describe in section B above) may be present in the lubricating oil composition at from of 0.5 mass % to 35 mass %, such as 5 mass % to 30 mass %, such as 7.5 mass % to 25 mass %, such as 10 to 22.5 mass %, such as 15 to 20 mass %, based upon the mass of the lubricating oil composition.

Optionally, the VM concentrate (such as VM concentrate comprising the styrenic block copolymer compositions describe in section B above) may comprise antioxidant, such as hindered phenol, phenolic antioxidant (such as alkylated diphenylamine).

Optionally, the VM concentrate (such as VM concentrate comprising the styrenic block copolymer compositions describe in section B above) may be absent phenolic antioxidant, such as alkylated diphenylamine.

In embodiments, the VM concentrate (such as VM concentrate comprising the styrenic block copolymer compositions describe in section B above) may comprise acylated polymers, such as polyisobutylene succinic acid, optionally, having an Mn of 500 to 50,000 g/mol, such as 600 to 5,000 g/mol, such as 700 to 3000 g/mol. In embodiments, the VM concentrate (such as VM concentrate comprising the styrenic block copolymer compositions describe in section B above) may comprise acylated polymers, such as polyisobutylene succinic acid, having an Mn of 500 to 1600 g/mol, such as 700 to 1200 g/mol.

A. Base Oil

The base oil (also referred to as "base stock," "lubricating oil base stock," or "oil of lubricating viscosity") useful herein may be a single oil or a blend of oils, and is typically a large liquid constituent of a lubricating composition, also referred to as a lubricant, into which additives and optional additional oils are blended, for example, to produce a lubricating composition, such as a final lubricant composition, an additive concentrate, a viscosity modifier concentrate, or other lubricating composition.

A base oil may be selected from vegetable, animal, mineral, and synthetic lubricating oils, and mixtures thereof. It may range in viscosity from light distillate mineral oils to heavy lubricating oils, such as those for gas engine oil, mineral lubricating oil, motor vehicle oil, and heavy-duty diesel oil. Generally, the kinematic viscosity at 100° C. ("KV100") of the base oil ranges from 1 to 30, such as 2 to 25 cSt, such as 5 to 20 cSt, as determined according to ASTM D445-19a, in particular, from 1.0 cSt to 10 cSt, from 1.5 cSt to 3.3 cSt, from 2.7 cSt to 8.1 cSt, from 3.0 cSt to 7.2 cSt, or from 2.5 cSt to 6.5 cSt. Generally, the high temperature high shear (HTHS) viscosity at 150° C. of the base oil ranges from 0.5 to 20 cP such as 1 to 10 cP, such as 2 to 5 cP as determined according to ASTM D4683-20.

Typically, when lubricating oil base stock(s) is used to make an additive concentrate, it may advantageously be present in a concentrate-forming amount to give an additive concentrate containing, from 5 wt % to 80 wt %, from 10 wt % to 70 wt %, or from 5 wt % to 50 wt % of active ingredient, based upon the weight of the additive concentrate.

Common oils useful as base oils include animal and vegetable oils (e.g., castor and lard oil), liquid petroleum oils, and hydrorefined and/or solvent-treated mineral lubricating oils of the paraffinic, naphthenic, and mixed paraffinic-naphthenic types. Oils derived from coal or shale are also useful base oils. Base stocks may be manufactured using a variety of different processes including, but not limited to, distillation, solvent refining, hydrogen processing, oligomerization, esterification, and re-refining.

Synthetic lubricating oils useful herein as base oils include hydrocarbon oils such as homopolymerized and copolymerized olefins, referred to as polyalphaolefins or PAO's or group IV base oils [according to the API EOLCS 1509 definition (American Petroleum Institute Publication 1509, see section E.1.3, 19th edition, January 2021, www.API.org)]. Examples of PAO's useful as base oils include: poly(ethylenes), copolymers of ethylene and propylene, polybutylenes, polypropylenes, propylene-isobutylene copolymers, chlorinated polybutylenes, poly(1-hexenes), poly(1-octenes), poly(1-decenes), homo- or co-polymers of $C_8$ to $C_{20}$ alkenes, homo- or co-polymers of $C_8$, and/or $C_{10}$, and/or $C_{12}$ alkenes, $C_8/C_{10}$ copolymers, $C_8/C_{10}/C_{12}$ copolymers, and $C_{10}/C_{12}$ copolymers, and the derivatives, analogues and homologues thereof.

In another embodiment, the base oil may comprise polyalphaolefins comprising oligomers of linear olefins having 6 to 14 carbon atoms, more preferably 8 to 12 carbon atoms, more preferably 10 carbon atoms having a Kinematic viscosity at 100° C. of 10 or more (as measured by ASTM D445); and preferably having a viscosity index ("VI"), as determined by ASTM D2270, of 100 or more, preferably 110 or more, more preferably 120 or more, more preferably 130 or more, more preferably 140 or more; and/or having a pour point of −5° C. or less (as determined by ASTM D97), more preferably −10° C. or less, more preferably −20° C. or less.

In another embodiment polyalphaolefin oligomers useful in the present disclosure may comprise $C_{20}$ to $C_{1500}$ paraffins, preferably $C_{40}$ to $C_{1000}$ paraffins, preferably $C_{50}$ to $C_{750}$ paraffins, preferably $C_{50}$ to $C_{500}$ paraffins. The PAO oligomers are dimers, trimers, tetramers, pentamers, etc., of $C_5$ to $C_{14}$ alpha-olefins in one embodiment, and $C_6$ to $C_{12}$ alpha-olefins in another embodiment, and $C_8$ to $C_{12}$ alpha-olefins in another embodiment. Suitable olefins include 1-pentene, 1-hexene, 1-heptene, 1-octene, 1-nonene, 1-decene, 1-undecene, and 1-dodecene. In one embodiment, the olefin is a combination of 1-octene, 1-decene, and 1-dodecene, or alternately may be substantially 1-decene, and the PAO is a mixture of dimers, trimers, tetramers, and pentamers (and higher) thereof. Useful PAO's are described more particularly in, for example, U.S. Pat. Nos. 5,171,908 and 5,783,531, and in Synthetic Lubricants and High-Performance Functional Fluids 1-52 (Leslie R. Rudnick & Ronald L. Shubkin, ed. Marcel Dekker, Inc. 1999).

PAO's useful in the present disclosure typically possess a number average molecular weight of from 100 to 21,000 g/mol in one embodiment, and from 200 to 10,000 g/mol in another embodiment, and from 200 to 7,000 g/mol in yet another embodiment, and from 200 to 2,000 g/mol in yet another embodiment, and from 200 to 500 g/mol in yet another embodiment. Desirable PAO's are commercially available as SpectraSyn™ Hi-Vis, SpectraSyn™ Low-Vis, SpectraSyn™ plus, SpectraSyn™ Elite PAO's (ExxonMobil Chemical Company, Houston Texas) and Durasyn PAO's from Ineos Oligomers USA LLC.

Synthetic lubricating oils useful as base oils also include hydrocarbon oils such as homopolymerized and copolymerized: alkylbenzenes (e.g., dodecylbenzenes, tetradecylbenzenes, dinonylbenzenes, di(2-ethylhexyl)benzenes); polyphenols (e.g., biphenyls, terphenyls, alkylated polyphenols); and alkylated diphenyl ethers, and alkylated diphenyl sulfides; and the derivatives, analogues, and homologues thereof.

Another suitable class of synthetic lubricating oils useful as base oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) reacted with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils herein also include those made from $C_5$ to $C_{12}$ monocarboxylic acids and polyols, and polyol ethers such as neopentyl glycol, trimethylolpropane, pentaerythritol, dipentaerythritol, and tripentaerythritol.

Desirable ester base oils are commercially available as Esterex™ Esters (ExxonMobil Chemical Company, Houston, Texas).

Silicon-based oils such as the polyalkyl-, polyaryl-, polyalkoxy- or polyaryloxysilicone oils and silicate oils comprise another useful class of synthetic lubricants useful herein; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes, and poly(methylphenyl)-siloxanes.

Other synthetic lubricating oils useful herein include liquid esters of phosphorous-containing acids (e.g., tricresyl phosphate, trioctyl phosphate, diethyl ester of decylphosphonic acid) and polymeric tetrahydrofurans.

Unrefined, refined, and re-refined oils can be used in the lubricating compositions of the present disclosure. Unrefined oils are those obtained directly from a natural or synthetic source without further purification treatment. For example, a shale oil obtained directly from retorting operations, a petroleum oil obtained directly from distillation, or an ester oil obtained directly from an esterification process and used without further treatment is considered an unrefined oil. Refined oils are similar to the unrefined oils except they have been further treated in one or more purification steps to improve one or more properties. Many such purification techniques, such as distillation, solvent extraction, acid or base extraction, filtration, and percolation are used by those in the art. Re-refined oils are oils obtained by processes similar to those used to obtain refined oils where the refining processes are applied to previously refined oils which have been previously used in service. Such re-refined oils are also referred to as reclaimed or reprocessed oils and often are additionally processed for removal of spent additive and oil breakdown products. A re-refined base oil is preferably substantially free from materials introduced through manufacturing, contamination, or previous use.

Other examples of useful base oils are gas-to-liquid ("GTL") base oils, i.e., the base oil is an oil derived from hydrocarbons made from synthesis gas ("syn gas") containing H2 and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. For further information on useful GTL base oils and blends thereof, please see U.S. Pat. No. 10,913,916 (col 4, ln 62 to col 5, ln 60) and U.S. Pat. No. 10,781,397 (col 14, ln 54 to col 15, ln 5, and col 16, ln 44 to col 17, ln 55).

In particular, oils from renewable sources, i.e., based in part on carbon and energy captured from the environment, such as biological sources, are useful herein.

The various base oils are often categorized as Group I, II, III, IV, or V according to the API EOLCS 1509 definition (American Petroleum Institute Publication 1509, see section E.1.3, 19th edition, January 2021, www.API.org). Generally speaking, Group I base stocks have a viscosity index of between about 80 to 120 and contain greater than about 0.03% sulfur and/or less than about 90% saturates. Group II base stocks have a viscosity index of between about 80 to 120 and contain less than or equal to about 0.03% sulfur and greater than or equal to about 90% saturates. Group III base stocks have a viscosity index greater than about 120 and contain less than or equal to about 0.03% sulfur and greater than about 90% saturates. Group IV base stocks includes polyalphaolefins (PAO). Group V base stocks include base stocks not included in Groups I-IV. (Viscosity index measured by ASTM D 2270, saturates is measured by ASTM D2007, and sulfur is measured by ASTM D5185, D2622, ASTM D4294, ASTM D4927, and ASTM D3120).

Base oils for use in the formulated lubricating compositions useful in the present disclosure are any one, two, three, or more of the variety of oils described herein. In desirable embodiments, base oils for use in the formulated lubricating compositions useful in the present disclosure are those described as API Group I (including Group I+), Group II (including Group II+), Group III (including Group III+), Group IV, and Group V oils and mixtures thereof, preferably API Group II, Group III, Group IV, and Group V oils and mixtures thereof. The base oil may be a Group III, Group III+, IV, and Group V base oils due to their exceptional volatility, stability, viscometric, and cleanliness features. Minor quantities of Group I base stock, such as the amount used to dilute additives for blending into formulated lube oil products, can be tolerated but are typically kept to a minimum, e.g., amounts only associated with their use as diluent/carrier oil for additives used on an "as-received" basis. In regard to the Group II stocks, it is often more useful that the Group II base stock be in the higher quality range associated with that stock, i.e., a Group II stock having a viscosity index in the range from 100 to 120.

The base oil useful herein may be selected from any of the synthetic, natural, or re-refined oils (such as those typically used as crankcase lubricating oils for spark-ignited and compression-ignited engines). Mixtures of synthetic and/or natural and/or re-refined base oils may be used if desired. Multi-modal mixtures (such as bi- or tri-modal mixtures) of Group I, II, III, IV, and/or V base stocks may be used if desired.

The base oil or base oil blend used herein conveniently has a kinematic viscosity at 100° C. (KV100, as measured according to ASTM D445-19a, and reported in units of centistoke (cSt) or it its equivalent, mm2/s), of about 2 to about 40 cSt, alternately of 3 to 30 cSt, alternately 4 to 20 cSt at 100° C., alternately 5 to 10 cSt, alternately the base oil or base oil blend may have a kinematic viscosity at 100° C. of 2 to 20 cSt, of 2.5 to 2 cSt, and preferably of about 2.5 cSt to about 9 cSt.

The base oil or base oil blend preferably has a saturate content of at least 65 mass %, more preferably at least 75 mass %, such as at least 85 mass %, such as at least than 90 mass % as determined by ASTM D2007.

Preferably, the base oil or base oil blend will have a sulfur content of less than 1 mass %, preferably less than 0.6 mass %, most preferably less than 0.4 mass %, such as less than 0.3 mass %, based on the total mass of the lubricating composition, as measured by ASTM D5185.

In embodiments, the volatility of the base oil or base oil blend, as measured by the Noack test (ASTM D5800, procedure B), is less than or equal to 30 mass %, such as less than or equal to 25 mass %, such as less than or equal to 20 mass %, such as less than or equal to 16 mass %, such as less than or equal to 12 mass %, such as less than or equal to 10 mass %, based on the total mass of the lubricating composition.

In embodiments, the viscosity index (VI) of the base oil is at least 95, preferably at least 110, more preferably at least 120, even more preferably at least 125, most preferably from about 130 to 240, in particular from about 105 to 140 (as determined by ASTM D2270).

The base oil may be provided in a major amount, in combination with a minor amount of one or more additive components as described hereinafter, constituting a lubricant. This preparation may be accomplished by adding the additives directly to the oil or by adding the one or more additives in the form of a concentrate thereof to disperse or dissolve the additive(s). Additives may be added to the oil by any method known to those skilled in the art, either before, at the same time as, or after addition of other additives.

The base oil may be provided in a minor amount, in combination with minor amounts of one or more additive components as described hereinafter, constituting an additive concentrate. This preparation may be accomplished by adding the additives directly to the oil or by adding the one or more additives in the form of a solution, slurry or suspension thereof to disperse or dissolve the additive(s) in the oil. Additives may be added to the oil by any method known to those skilled in the art, either before, at the same time as, or after addition of other additives.

The base oil typically constitutes the major component of an engine oil lubricant composition of the present disclosure and typically is present in an amount ranging from about 50 to about 99 wt %, preferably from about 70 to about 95 wt %, and more preferably from about 80 to about 95 wt %, based on the total weight of the composition.

Typically, one or more base oils are present in the lubricating composition in an amount of 32 wt % or more, alternately 55 wt % or more, alternately 60 wt % or more, alternately 65 wt % or more, based on the total weight of the lubricating composition. Typically, one or more base oils are present in the lubricating composition at an amount of 98 wt % or less, more preferably 95 wt % or less, even more preferably 90 wt % or less. Alternately, one or more base oils are present in the lubricating composition at from 1 to 99 mass %, alternately 50 to 97 mass %, alternately to 60 to 95 mass %, alternately 70 to 95 mass %, based upon the weight of the lubricating composition.

The base oils and blends thereof described above are also useful for making concentrates (such as additive concentrates and or viscosity modifier concentrates) as well as for making lubricants therefrom.

Concentrates constitute a convenient means of handling additives or other components (such as viscosity modifiers) before their use, as well as facilitating solution or dispersion of additives or other components (such as viscosity modifiers) in lubricants. When preparing a lubricant that contains more than one type of additive (sometimes referred to as "additive components"), each additive may be incorporated separately, each in the form of a concentrate. In many instances, however, it is convenient to provide a so-called additive "package" (also referred to as an "addpack") comprising one or more additives/co-additives, such as described hereinafter, in a single concentrate.

Typically, one or more base oils are present in the concentrate composition (such as an additive concentrate or a viscosity modifier concentrate) in an amount of 50 wt % or less, alternately 40 wt % or less, alternately 30 wt % or less, alternately 20 wt % or less, based on the total weight of the concentrate composition. Typically, one or more base oils are present in the concentrate composition at an amount of 0.1 to 49 mass %, alternately 5 to 40 mass %, alternately to 10 to 30 mass %, alternately 15 to 25 mass %, based upon the weight of the concentrate composition.

B. Styrenic Block Copolymer

This disclosure relates to styrenic block copolymers, and the use of such block copolymers in lubricating oil compositions, particularly as viscosity modifiers.

The term block copolymer means a copolymer comprising at least a first block of one or more monomers and a second block of one or more monomers, where the second block is different in monomer distribution, content or composition from the first block, and hydrogenated or chemically modified versions of the block copolymer. The block copolymers may be in diblock, triblock, linear (including tapered) or radial (including tapered) block form.

The term styrenic block copolymer (SBC) means a block copolymer comprising vinyl aromatic (such as styrene and or alpha-methyl-styrene) block(s) and one or more conjugated diene (such as isobutylene, isoprene, butadiene) block(s), and hydrogenated or chemically modified versions of the block copolymer. The block copolymers may be in diblock, triblock, linear (including tapered) or radial (including tapered) block form. This definition specifically includes styrenic block copolymers such as IS, IBS, BIS, SIBS, SB, SI, SEBS, SEPS, SIS, SBS, SIBS, and the like (for example, radial block copolymers), where S=styrene, EB=random or alternating ethylene and butene, EP=random or alternating ethylene and propylene, I=isoprene, and B=butadiene).

The term "radial block copolymer" means a block copolymer having a radial (also known as star) architecture where the arms of the radial copolymer are each block (co)polymers.

When a styrenic block copolymer is referred to as comprising monomer ("mer") units it is understood that the mer unit in the copolymer is the polymerized form of the monomer unit. Thus an IS block copolymer is a block copolymer comprising block polymer derived from isoprene and block polymer derived from isoprene.

The block copolymers (typically styrenic block copolymers) may have an Mn (of the copolymer itself, as opposed to the Mn of the arm of a radial polymer) of about 10,000 g/mol or more, such as 50,000 g/mol or more, such as 100,000 g/mol or more, such as 300,000 g/mol or more, such as 450,000 g/mol or more, such as 300,000 to 700,000 g/mol such as 450,000 to 600,000 g/mol, such as 450,000 to 650,000 g/mol, such as 500,000 to 600,000 g/mol, such as 520,000 to 580,000 g/mol (Mw, Mn, and Mz are determined by GPC, using polystyrene standards "GPC-PS"). Typically, the radial styrenic block copolymers have an Mn of 10,000 to 1,000,000 g/mol, such as 300,000 to about 800,000 g/mol, such as 450,000 to about 700,000 g/mol, such as 550,000 to about 650,000 g/mol, (GPC-PS).

The styrenic block copolymers may have an Mw/Mn of less than 2 (such as less than 1.6, such as less than 1.5, such as 1.4 or less, such as from 1 to 1.3, such as from 1.0 to 1.25, such as from 1.0 to 1.2, such as 1.0 to 1.15, such as from 1.0 to 1.1 as determined by GPC-PS).

The styrenic block copolymers may have an Mz (as determined by GPC-PS) of 20,000 to 500,000 g/mol, alternately 20,000 to about 400,000 g/mol, alternately 30,000 to about 300,000 g/mol (GPC-PS).

The block copolymers will typically have one or more vinyl aromatic polymer blocks (such as one or more polystyrene blocks) having an Mn of from 2,000 to 45,000 g/mol, such as from 4000 to 20,000 g/mol, such as 6000 to 10,000 g/mol.

The block copolymers will typically have one more, such as two or more, conjugated diene polymer blocks (such at least one polybutadiene block and at least one polyisoprene block, or a block comprising copolymer of butadiene and isoprene), each having an Mn of from 12,000 to 100,000 g/mol, such as such as from 40,000 to 90,000 g/mol, such as 60,000 to 80,000 g/mol.

The block copolymer typically has three or more arms, where each arm independently may have an Mn of about 10,000 g/mol or more, such as 50,000 g/mol or more, such as 100,000 g/mol or more, such as 300,000 g/mol or more, such as 450,000 g/mol or more, such as 300,000 to 700,000 g/mol such as 450,000 to 600,000 g/mol, such as 450,000 to 650,000 g/mol, such as 500,000 to 600,000 g/mol, such as 520,000 to 580,000 g/mol (Mw, Mn, and Mz are determined by GPC, using polystyrene standards "GPC-PS"). Typically, the radial styrenic block copolymer's arms independently may have an Mn of 10,000 to 1,000,000 g/mol, such as 300,000 to about 800,000 g/mol, such as 450,000 to about 700,000 g/mol, such as 550,000 to about 650,000 g/mol, (GPC-PS).

The styrenic block copolymer's arms independently may have an Mw/Mn of less than 2 (such as less than 1.6, such as less than 1.5, such as 1.4 or less, such as from 1 to 1.3, such as from 1.0 to 1.25, such as from 1.0 to 1.2, such as 1.0 to 1.15, such as from 1.0 to 1.1 as determined by GPC-PS).

The styrenic block copolymer's arms independently may have an Mz (as determined by GPC-PS) of 20,000 to 150,000 g/mol, alternately 20,000 to about 150,000 g/mol, alternately 30,000 to about 125,000 g/mol, alternately 35,000 to about 100,000 g/mol, alternately 40,000 to 80,000 g/mol, alternately 40,000 to 60,000 g/mol (GPC-PS).

The block copolymer's arms independently will typically have one or more vinyl aromatic polymer blocks (such as one or more polystyrene blocks) having an Mn of from 2,000 to 45,000 g/mol, such as from 4000 to 20,000 g/mol, such as 6000 to 10,000 g/mol.

The block copolymer's arms independently will typically have one more, such as two or more, conjugated diene polymer blocks (such at least one polybutadiene block and at least one polyisoprene block, or a block comprising copolymer of butadiene and isoprene), each having an Mn of from 12,000 to 100,000 g/mol, such as such as from 40,000 to 90,000 g/mol, such as 60,000 to 80,000 g/mol.

The styrenic block copolymers may comprise repeat units of one or more olefins having 4 to 8 carbon atoms (preferably conjugated dienes having 4 to 5 carbon atoms and or styrene).

The block copolymers useful herein may contain blocks that are homopolymers or copolymers of vinyl aromatics (such as styrene and or alpha-methylstyrene) and one or more of isoprene, butadiene, methyl-styrene, 2,3-dimethylbutadiene, 2-methyl-1,3-pentadiene, myrcene, 3-methyl-1,3-pentadiene, 4-methyl-1,3-pentadiene, 2-phenyl-1,3-butadiene, 2-phenyl-1,3-pentadiene, 3-phenyl-1,3 pentadiene, 2,3-dimethyl-1,3-pentadiene, 2-hexyl-1,3-butadiene, 3-methyl-1,3-hexadiene, 2-benzyl-1,3-butadiene, 2-p-tolyl-1,3-butadiene 1,3-butadiene, 1,3-pentadiene, 1,3-hexadiene, 1,3-heptadiene, 2,4-heptadiene, 1,3-octadiene, 2,4-octadiene, 3,5-octadiene, 1,3-nonadiene, 2,4-nonadiene, 3,5-nonadiene, 1,3-decadiene, 2,4-decadiene, and 3,5-decadiene, [optionally the comonomer(s) are present in the styrene block at less than 20 mol %, less than 5 mol %, such as less than 3 mol %, such as less than 1 mol %, such as less than 0.1 mol %].

The block copolymers useful herein may contain blocks that are homopolymers or copolymers of butadiene and one or more of isoprene, styrene, methyl-styrene, 2,3-dimethyl-butadiene, 2-methyl-1,3-pentadiene, myrcene, 3-methyl-1,3-pentadiene, 4-methyl-1,3-pentadiene, 2-phenyl-1,3-butadiene, 2-phenyl-1,3-pentadiene, 3-phenyl-1,3 pentadiene, 2,3-dimethyl-1,3-pentadiene, 2-hexyl-1,3-butadiene, 3-methyl-1,3-hexadiene, 2-benzyl-1,3-butadiene, 2-p-tolyl-1,3-butadiene 1,3-butadiene, 1,3-pentadiene, 1,3-hexadiene, 1,3-heptadiene, 2,4-heptadiene, 1,3-octadiene, 2,4-octadiene, 3,5-octadiene, 1,3-nonadiene, 2,4-nonadiene, 3,5-nonadiene, 1,3-decadiene, 2,4-decadiene, and 3,5-decadiene, [optionally the comonomer(s) are present in the butadiene block at less than 20 mol %, less than 5 mol %, such as less than 3 mol %, such as less than 1 mol %, such as less than 0.1 mol %].

The block copolymers useful herein may contain blocks that are homopolymers or copolymers of isoprene and one or more of styrene, methyl-styrene, 2,3-dimethyl-butadiene, 2-methyl-1,3-pentadiene, myrcene, 3-methyl-1,3-pentadiene, 4-methyl-1,3-pentadiene, 2-phenyl-1,3-butadiene, 2-phenyl-1,3-pentadiene, 3-phenyl-1,3 pentadiene, 2,3-dimethyl-1,3-pentadiene, 2-hexyl-1,3-butadiene, 3-methyl-1,3-hexadiene, 2-benzyl-1,3-butadiene, 2-p-tolyl-1,3-butadiene 1,3-butadiene, 1,3-pentadiene, 1,3-hexadiene, 1,3-heptadiene, 2,4-heptadiene, 1,3-octadiene, 2,4-octadiene, 3,5-octadiene, 1,3-nonadiene, 2,4-nonadiene, 3,5-nonadiene, 1,3-decadiene, 2,4-decadiene, and 3,5-decadiene, [optionally the comonomer(s) are present in the isoprene block at less than 20 mol %, less than 5 mol %, such as less than 3 mol %, such as less than 1 mol %, such as less than 0.1 mol %].

By definition the block copolymer contains at least two different blocks (also referred to as segments), such as three different blocks of polymeric material, meaning that while the block copolymer can be made of homopolymeric blocks or segments, the block copolymer is not solely homopolyisoprene, is not solely homopolybutylene, is not solely homopolyisobutylene, and/or is not solely homopolystyrene.

The copolymer may be a random copolymer, a tapered block copolymer, a radial ("star") copolymer, or a block copolymer. Block copolymers are formed from a monomer mixture comprising one or more first monomers (such as isoprene), wherein, for example, a first monomer forms a discrete block of polymer joined to a second discrete block of the polymer formed from a second monomer (such as butadiene), optionally joined to a third discrete block of the polymer formed from a third monomer (such as styrene). While block copolymers have substantially discrete blocks formed from the monomers, a tapered block copolymer may be composed of, at one end, a relatively pure first monomer and, at the other end, a relatively pure second monomer. The middle of the tapered block copolymer may be more of a gradient composition of the two monomers.

In embodiments the block copolymer is a radial copolymer formed from a monomer mixture comprising one or more first monomers (such as isoprene and or butadiene), wherein, for example, a first monomer forms a discrete block of polymer joined to a second discrete block of the polymer formed from a second monomer (such as styrene), where the polystyrene block is proximal to the radial center. While block copolymers have substantially discrete blocks formed from the monomers, a tapered block copolymer may be composed of, at one end, a relatively pure first monomer and, at the other end, a relatively pure second monomer. The middle of the tapered block copolymer may be more of a gradient composition of the two monomers.

Preferred structures include a radial block copolymer comprising at least 3 block (such as diblock) copolymer arms (such as at least 4, such as 4 to 16, such as 5 to 10 such as 6 to 8 arms), each of which comprises a proximal styrenic block and a distal polyolefin block, wherein the polyolefin block comprises hydrogenated mer units derived from the polymerized olefin monomers. In embodiments the proximal styrenic block has Mn of at least 10% less (such as at least 20% less, such as at least 30% less, such as at least 40% less, such as at least 50% less, such as at least 60% less, such as at least 70% less, such as at least 80% less, such as at least 90% less) than the Mn of the hydrogenated polyolefin block (in arm structures comprising two or more separate styrenic blocks, the Mn of the styrenic block closest to the radial center is used for this percentage.)

Preferred structures include a radial block copolymer comprising at least 3 block (such as diblock) copolymer arms (such as at least 4, such as 4 to 16, such as 5 to 10 such as 6 to 8 arms), each of which comprises a proximal polystyrene block and a distal polyolefin block, wherein the polyolefin block comprises hydrogenated mer units derived from the polymerized combination of isoprene and butadiene monomers. In embodiments the proximal polystyrene block has Mn of at least 10% less (such as at least 20% less, such as at least 30% less, such as at least 40% less, such as at least 50% less, such as at least 60% less, such as at least 70% less, such as at least 80% less, such as at least 90% less) than the Mn of the hydrogenated polyolefin block (in arm structures comprising two or more separate polystyrene blocks, the Mn of the polystyrene block closest to the radial center is used for this percentage.)

The styrenic block copolymers may have a $T_m$ (as measured by Differential Scanning Calorimetry (DSC)) of 100° C. or less, such as 50° C. or less, or may have a melting point that cannot be determined by DSC using a Perkin Elmer or TA Instrument Thermal Analysis System (sample is heated from ambient to 210° C. at 10° C./minute and held at 210° C. for 5 minutes, then cooled down to −40° C. at 10° C./minute and held for 5 minutes).

The styrenic block copolymers may have a minimum glass transition temperature (Tg) of −25° C. or less, such as −40° C. or less, such as −45 or less, such as −46 or less, such as −50° C. or less, as determined by Differential Scanning Calorimetry (DSC) using a Perkin Elmer or TA Instrument Thermal Analysis System (sample is heated from ambient to 210° C. at 10° C./minute and held at 210° C. for 5 minutes, then cooled down to −85° C. at 10° C./minute and held for 5 minutes). For purposes of this invention and the claims thereto, glass transition contribution from the styrenic block(s) is ignored when determining the Tg of the styrenic block copolymers.

The styrenic block copolymers may have 5 ppm cobalt or less, such as less than 2 ppm cobalt, such as less than 1 ppm cobalt.

The styrenic block copolymers may have more than 40 ppm phosphorus, such as more than 100 ppm P, such as more than 200 ppm P, such as 300 ppm P or more.

The styrenic block copolymers may have more than 1 ppm nickel, such as more than 2 ppm Ni, such as more than 3 ppm Ni.

The styrenic block copolymers may have more than 0.5 ppm magnesium, such as more than 1 ppm Mg, such as more than 2 ppm Mg.

The styrenic block copolymers may have more than 0.5 ppm iron, such as more than 1 ppm Fe, such as more than 3 ppm Fe, such as more than 5 ppm Fe, such as more than 7 ppm Fe and less than 10 ppm Fe.

The styrenic block copolymers may have a residual unsaturation of less than 3%, such less than 2%, such less than 1%, such as less than 0.5%, such as less than 0.25% based upon number of double bonds in the non-hydrogenated polymer.

The block derived from conjugate diene in the styrenic block copolymers may have a residual unsaturation of less than 20%, such as less than 10%, such as less than 5%, such as less than 3%, such less than 2%, such less than 1%, such as less than 0.5%, such as less than 0.25% based upon number of double bonds in the non-hydrogenated polymer.

The styrenic block copolymers may have a residual metal (such as Li, Co, and Al) content of less than 100 ppm, such less than 50 ppm, such as less than 25 ppm, such as less than 10 ppm, such as less than 5 ppm.

The styrenic block copolymers may have a Li content of less than 100 ppm, such less than 50 ppm, such as less than 25 ppm, such as less than 10 ppm, such as less than 5 ppm.

The styrenic block copolymers may have a Co content of less than 100 ppm, such less than 50 ppm, such as less than 25 ppm, such as less than 10 ppm, such as less than 5 ppm.

The styrenic block copolymers may have an Al content of less than 100 ppm, such less than 50 ppm, such as less than 25 ppm, such as less than 10 ppm, such as less than 5 ppm.

The styrenic block copolymers may have a residual nitrogen content of less than 100 ppm, such less than 50 ppm, such as less than 25 ppm, such as less than 10 ppm, such as less than 5 ppm, such as less than 1 ppm, such as less than 0.1 ppm.

The radial SBC may have 3 or more arms, such as 4 or more arms, such as 3 to 20 arms, such as 4 to 15 arms, such as 5 to 10 arms, such as 6 to 7 arms, as determined by GPC-PS, as described in the Experimental section below, where the arms typically comprise diblocks or triblocks, such as diblocks.

The radial SBC may have less stars per entity at 80° C. than the number of stars per entity at 40° C. (as determined in the Experimental section below). The radial SBC may have at least 1.4 less stars per entity on average at 80° C. than the number of arms per entity at 40° C. (as determined in the Experimental section below), such as at least 1 less stars per entity at 40° C.

The radial SBC may have 15 or more arms per entity (such as 18 or more arms per entity, such 20 or more as arms per entity, such 22 or more as arms per entity) at 40° C. (as determined in the Experimental section below).

The radial SBC may have 15 or less arms per entity (such as 13 or less arms per entity, such 10 or less as arms per entity) at 80° C. (as determined in the Experimental section below).

The radial SBC may have less arms per entity at 80° C. than the number of arms per entity at 40° C. (as determined in the Experimental section below). The radial SBC may have at least 3 less arms per entity at 80° C. than the number of arms per entity at 40° C. (as determined in the Experimental section below), such as at least 5 less arms per entity, such as at least 10 less arms per entity, such as from 1 to 15 less arms per entity, such as 5 to 10 less arms per entity than the number of arms per entity at 40° C.

The styrenic block copolymers may have an intrinsic viscosity, [η], measured at a shear rate of $2\times10^6$ $s^{-1}$ at 40° C. that is less (such as at least 16 ml/g less, such as at least 12 ml/g less, such as at least 10 ml/g less, such as from 16 to 5 ml/g less, such as from 16 to 10 ml/g less) than the intrinsic viscosity measured at a shear rate of $2\times10^6$ $s^{-1}$ at 80° C., as determined by Ultra Shear Viscometry analysis on a blend of 99.8 mass % of Group III base stock having a viscosity index of greater than 120 and a $KV_{100}$ of about 4.0 cSt and 0.2 mass % copolymer.

The styrenic block copolymers may have a hydrodynamic radius (Rh) at 80° C. that is less than hydrodynamic radius at 40° C. and the hydrodynamic radius at 100° C., as determined by Dynamic Light Scattering analysis on a blend of 99.8 mass % of Group III base stock having a viscosity index of greater than 120 and a $KV_{100}$ of about 4.0 cSt and 0.2 mass % copolymer. Preferably, the a hydrodynamic radius (Rh) at 80° C. is at least 1 (such as at least 2, such as at least 3, such as at least 4, such as at least 5) nm less than hydrodynamic radius at 40° C. and at least 1 (such as at least 2, such as at least 3) nm less than the the hydrodynamic radius at 100° C.

The styrenic block copolymers may have a radial compression percent at 40° C. of 120 or more, such as 130 or more, such as 140 or more, such as 150 or more, such as 160 or more, such 170 or more.

The styrenic block copolymers may have a shear compression ratio at 40° C. that is at least three times greater (such as at least four times greater, such as at least 4.5 times greater) than the shear compression ratio at 100° C., as determined by ASTM D445 in combination with Ultra Shear Viscometry on a blend of 99.8 mass % of Group III base stock having a viscosity index of greater than 120 and a $KV_{100}$ of about 4.0 cSt and 0.2 mass % copolymer.

Preferred hydrogenated SBC's include radial block copolymers having at least 3, at least 4, at least 5 at least 6 arms, where the arms are fully or partially hydrogenated block copolymers comprising blocks of styrenic monomer units (such as styrene) proximal to the radial center and blocks of conjugated diene (such as isoprene and/or butadiene) distal to the radial center. Particularly preferred hydrogenated SBC's include radial block copolymers having 6 to 7 arms, where the arms are fully or partially hydrogenated block copolymers comprising blocks of polystyrene proximal to the radial center and blocks of copolymer of isoprene and butadiene distal to the radial center. For purposes of this invention proximal means closer the radial center and distal means away from the radial center. If the arms of the SBC contains two or more polystyrene blocks, it is preferred that the terminal block of the arm (i.e, the block furthest from the radial center) comprises conjugated diene.

In embodiments, it is preferred that the terminal block of the arms is not a styrenic block, such as polystyrene.

In embodiments, it is preferred that the terminal block of the arms is an olefinic block, such as block comprising conjugated dienes, such as butadiene and or isoprene.

Methods of making block copolymers are known in the art. Typically, block copolymers are made by anionic polymerization, examples of which are cited in Anionic Polymerization: Principles and Practical Applications, H. L. Hsieh and R. P. Quirk, Marcel Dekker, New York, 1996. In embodiments, block copolymers are made by sequential monomer addition to a carbanionic initiator such as sec-butyl lithium or n-butyl lithium. In another embodiment, the copolymer is made by coupling a triblock material with a divalent coupling agent such as 1,2-dibromoethane, dichlorodimethylsilane, or phenylbenzoate. In this embodiment, a small chain (less than 10 monomer repeat units) of a conjugated diene polymer can be reacted with the vinyl aromatic polymer coupling end to facilitate the coupling reaction. Vinyl aromatic polymer blocks are typically difficult to couple, therefore, this technique is commonly used to achieve coupling of the vinyl aromatic polymer ends. The small chain of diene polymer does not constitute a distinct block since no microphase separation is achieved. Coupling reagents and strategies which have been demonstrated for a variety of anionic polymerizations are discussed in Hsieh and Quirk, Chapter 12, pgs. 307-331. In another embodiment, a difunctional anionic initiator is used to initiate the polymerization from the center of the block system, wherein subsequent monomer additions add equally to both ends of the growing polymer chain. An example of a such a difunctional initiator is 1,3-bis(1-phenylethenyl) benzene treated with organolithium compounds, as described in U.S. Pat. Nos. 4,200,718 and 4,196,154.

Starting materials for preparing the block copolymers of the present invention include the initial monomers. The styrenic momoner(s) can be selected from styrene, alpha-methylstyrene, para-methylstyrene, vinyl toluene, vinylnaphthalene, and para-butyl styrene or mixtures thereof. Of these, styrene is most preferred and is commercially available, and relatively inexpensive, from a variety of manufacturers.

The conjugated dienes for use herein are 1,3-butadiene and substituted butadienes such as isoprene, piperylene, 2,3-dimethyl-1,3-butadiene, and 1-phenyl-1,3-butadiene, or mixtures thereof. Of these, 1,3-butadiene and isoprene are most preferred.

Other important starting materials for anionic co-polymerizations include one or more polymerization initiators. In the present invention such include, for example, alkyl lithium compounds and other organolithium compounds such as s-butyllithium, n-butyllithium, t-butyllithium, amyllithium and the like, including di-initiators such as the di-sec-butyl lithium adduct of m-diisopropenyl benzene. Other such di-initiators are disclosed in U.S. Pat. No. 6,492,469. Of the various polymerization initiators, s-butyllithium is preferred. The initiator can be used in the polymerization mixture (including monomers and solvent) in an amount calculated on the basis of one initiator molecule per desired polymer chain. The lithium initiator process is well known and is described in, for example, U.S. Pat. Nos. 4,039,593 and Re. 27,145, which descriptions are incorporated herein by reference.

The solvent used as the polymerization vehicle may be any hydrocarbon that does not react with the living anionic chain end of the forming polymer, is easily handled in commercial polymerization units, and offers the appropriate solubility characteristics for the product polymer. For example, non-polar aliphatic hydrocarbons, which are generally lacking in ionizable hydrogens make particularly suitable solvents. Frequently used are cyclic alkanes, such as cyclopentane, cyclohexane, cycloheptane, and cyclooctane, all of which are relatively non-polar. Other suitable solvents, such as toluene, will be known to one skilled in the art and can be selected to perform effectively in a given set of process conditions, with temperature being one of the major factors taken into consideration.

Preparation of radial (star branched) polymers (such as those represented by the formula: $(A\text{-}C)_nX$, such as those represented by the formula: $(IB\text{—}S)_nX$) requires a post-polymerization step called "coupling". It is possible to have either a branched selectively hydrogenated block copolymer and/or a branched tailored softening modifier. In the above radial formulas for the selectively hydrogenated block copolymer, "A" is a hydrogenated conjugated diene block (co) polymer, "C" is styrenic block polymer, S is polystyrene and IB is a copolymer of isoprene and butadiene, "X" is the remnant or residue of a coupling agent, and "n" is an integer of from 2 to about 30, preferably from about 2 to about 15, preferably from about 2 to about 8, such as 5 to 7. A variety of coupling agents are known in the art and include, for example, dihalo alkanes, silicon halides, siloxanes, multifunctional epoxides, silica compounds, esters of monohydric alcohols with carboxylic acids, (e.g., dimethyl adipate) and epoxidized oils. Radial/Stat-shaped polymers are prepared with polyalkenyl coupling agents as disclosed in, for example, U.S. Pat. Nos. 3,985,830; 4,391,949; and 4,444,953; Canadian Pat. No. 716,645. Suitable polyalkenyl coupling agents include divinylbenzene, and preferably m-divinylbenzene. Preferred are tetra-alkoxysilanes such as tetra-ethoxysilane (TEOS) and tetra-methoxysilane, alkyltrialkoxysilanes such as methyl-trimethoxy silane (MTMS), aliphatic diesters such as dimethyl adipate and diethyl adipate, and diglycidyl aromatic epoxy compounds such as diglycidyl ethers deriving from the reaction of bis-phenol A and epichlorohydrin.

In embodiments, a hydrogenated styrenic block copolymer (S-I-B block copolymer) is prepared as follows: an initiator, such as sec-butyl lithium or n-butyl lithium is combined with isoprene to form a polyisoprene block, then combined with the butadiene to form a polybutadiene block. Once the isoprene/butadiene monomers are depleted to a desired extent, the combination is thereafter combined with styrene to form a polystyrene block. The block copolymer is then combined with a coupling agent, such as divinylbenzene to form a radial configuration. The radial block copolymer is then combined with hydrogenation catalyst and hydrogenated by means know in the art, described below.

In embodiments, a hydrogenated styrenic block copolymer (S-TB block copolymer) is prepared as follows: an initiator, such as sec-butyl lithium or n-butyl lithium is combined with isoprene and butadiene to form an isoprene-butadiene copolymer block, once the isoprene/butadiene monomers are depleted to a desired extent, the combination is thereafter combined with styrene to form a polystyrene block. The block copolymer is then combined with a coupling agent, such as divinylbenzene to form a radial configuration. The radial block copolymer is then combined with hydrogenation catalyst such as, nickel/aluminum catalyst, and hydrogenated by means know in the art, described below.

Hydrogenation

The styrenic block copolymers can be hydrogenated partially or completely by any hydrogenating agent known to one of ordinary skill in the art. For example, a saturated or partially saturated polymer can be prepared by (a) providing a block copolymer containing one or more blocks having unsaturations (such as double or triple bonds); and (b) hydrogenating at least a portion or all of the unsaturations (such as double or triple bonds) in the block copolymer in the presence of a hydrogenation reagent. In some embodiments, the block copolymer is fully hydrogenated. In some embodiments, the block copolymer is partially hydrogenated. In some embodiments, the block copolymer is saturated (hydrogenated) at 50% or more, such as 60% or more, such as 70% or more, such as 80% or more, such as 90% or more, such as 95% or more, such as 98% or more, such as 99% or more, such as from 50 to 100% saturated (hydrogenated), as determined by ozone adsorption method described in Martino N. Smits and Dirkman Hoefman, Quantative Determination of Olefinic Unsaturation by Measurement of Ozone Absorption Analytical Chemistry Vol 44, No. 9, pg. 1688, 1972, Martino N. Smits.

In embodiments, the hydrogenation reagent can be hydrogen in the presence of a hydrogenation catalyst. In some embodiments, the hydrogenation catalyst is Pd, Pd/C, Pt, $PtO_2$, $Ru(PPh_3)_2Cl_2$, Raney nickel, or a combination thereof. In embodiments, the catalyst is a Pd catalyst. In another embodiment, the catalyst is 5% Pd/C. In a further embodiment, the catalyst may comprise or be 10% Pd/C in a high-pressure reaction vessel and the hydrogenation reaction is allowed to proceed until completion. Generally, after completion, the reaction mixture can be washed, concentrated, and dried to yield the corresponding hydrogenated product. Alternatively, any reducing agent that can reduce a C═C bond to a C C bond can also be used. For example, the block copolymer can be hydrogenated by treatment with hydrazine in the presence of a catalyst, such as 5-ethyl-3-methyllumiflavinium perchlorate, under an oxygen atmosphere to give the corresponding hydrogenated products. The reduction reaction with hydrazine is disclosed in Imada et al., J Am. Chem. Soc., 127, pp. 14544-14545, (2005), which is incorporated herein by reference.

The hydrogenated block copolymers may have a weight ratio of hydrogenated conjugated diene polymer block(s) to vinyl aromatic (styrenic) polymer (which may have some small amount of hydrogenation, such as 10% or less) block of greater than 40:60; typically of greater than 40:60 to 99:1, preferably from 45:55 to 95:5, based on the total weight of the hydrogenated conjugated diene and vinyl aromatic polymer blocks. The total weights of the vinyl aromatic polymer blocks and the hydrogenated conjugated diene polymer block(s) is typically at least 80 weight percent, preferably at least 90, and more preferably at least 95 weight percent of the total weight of the hydrogenated copolymer.

The lubricating composition according to the present disclosure may further comprise one or more additives such as detergents, friction modifiers, antioxidants, pour point depressants, anti-foam agents, viscosity modifiers, dispersants, corrosion inhibitors, anti-wear agents, extreme pressure additives, demulsifiers, seal compatibility agents, additive diluent base oils, etc. Specific examples of such additives are described in, for example, Kirk-Othmer Encyclopedia of Chemical Technology, third edition, volume 14, pp. 477-526, and several are discussed in further detail below.

C. Detergents

The lubricating composition may comprise one or more metal detergents (such as blends of metal detergents) also referred to as a "detergent additive." Metal detergents typically function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number ("TBN" as measured by ASTM D2896) of up to 150 mgKOH/g, such as from 0 to 80 (or 5-30) mgKOH/g. A large amount of a metal base may be incorporated by reacting excess metal compound (e.g., an oxide or hydroxide) with an acidic gas (e.g., carbon dioxide). Such detergents, sometimes referred to as overbased, may have a TBN of 100 mgKOH/g or more (such as 200 mgKOH/g or more), and typically will have a TBN of 250 mgKOH/g or more, such as 300 mgKOH/g or more, such as from 200 to 800 mgKOH/g, 225 to 700 mgKOH/g, 250 to 650 mgKOH/g, or 300 to 600 mgKOH/g, such as 150 to 650 mgKOH/g.

Suitable detergents include, oil-soluble neutral and overbased sulfonates, phenates, sulfurized phenates, thiophosphonates, salicylates, naphthenates and other oil-soluble carboxylates of a metal, particularly the alkali metals (Group 1 metals, e.g., Li, Na, K, Rb) or alkaline earth metals (Group 2 metals, e.g., Be, Mg, Ca, Sr, Ba), particularly, sodium, potassium, lithium, calcium, and magnesium, such as Ca and/or Mg. Furthermore, the detergent may comprise a hybrid detergent comprising any combination of sodium, potassium, lithium, calcium, or magnesium salts of sulfonates, phenates, sulfurized phenates, thiophosphonates, salicylates, and naphthenates or other oil-soluble carboxylates of a Group 1 and/or 2 metal.

Preferably, the detergent additive(s) useful in the present disclosure comprises calcium and/or magnesium metal salts. The detergent may be a calcium and/or magnesium carboxylate (e.g., salicylates), sulfonate, or phenate detergent. More preferably, the detergent additives are selected from magnesium salicylate, calcium salicylate, magnesium sulfonate, calcium sulfonate, magnesium phenate, calcium phenate, and hybrid detergents comprising two, three, four, or more of more of these detergents and/or combinations thereof.

The metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

The overbased metal-containing detergent may be sodium salts, calcium salts, magnesium salts, or mixtures thereof of the phenates, sulfur-containing phenates, sulfonates, salixarates, and salicylates. Overbased phenates and salicylates typically have a total base number of 180 to 650 mgKOH/g, such as 200 to 450 TBN mgKOH/g. Overbased sulfonates typically have a total base number of 250 to 600 mgKOH/g, or 300 to 500 mgKOH/g. In embodiments, the sulfonate detergent may be predominantly a linear alkylbenzene sulfonate detergent having a metal ratio of at least 8 as is described in paragraphs [0026] to [0037] of US Patent Application Publication No. 2005/065045 (and granted as U.S. Pat. No. 7,407,919). The overbased detergent may be present at 0 wt % to 15 wt %, or 0.1 wt % to 10 wt %, or 0.2 wt % to 8 wt %, or 0.2 wt % to 3 wt %, based upon of the lubricating composition. For example, in a heavy-duty diesel engine, the detergent may be present at 2 wt % to 3 wt % of the lubricating composition. For a passenger car engine, the detergent may be present at 0.2 wt % to 1 wt % of the lubricating composition.

The detergent additive(s) may comprise one or more magnesium sulfonate detergents. The magnesium detergent may be a neutral salt or an overbased salt. Suitably the magnesium detergent is an overbased magnesium sulfonate having a TBN of from 80 to 650 mgKOH/g (ASTM D2896), such as 200 to 500 mgKOH/g, such as 240 to 450 mgKOH/g.

Alternately, the detergent additive(s) is a magnesium salicylate. Suitably the magnesium detergent is a magnesium salicylate having TBN of from 30 to 650 mgKOH/g (ASTM D2896), such as 50 to 500 mgKOH/g, such as 200 to 500 mgKOH/g, such as 240 to 450 mgKOH/g or alternately of 150 mgKOH/g or less, such as 100 mgKOH/g or less.

Alternately, the detergent additive(s) is a combination of magnesium salicylate and magnesium sulfonate.

The magnesium detergent provides the lubricating composition thereof with from 200-4000 ppm of magnesium atoms, suitably from 200-2000 ppm, from 300 to 1500 or from 450-1200 ppm of magnesium atoms (ASTM D5185).

The detergent composition may comprise (or consist of) a combination of one or more magnesium sulfonate detergents and one or more calcium salicylate detergents.

The combination of one or more magnesium sulfonate detergents and one or more calcium salicylate detergents provides the lubricating composition thereof with: 1) from 200-4000 ppm of magnesium atoms, suitably from 200-2000 ppm, from 300 to 1500 ppm or from 450-1200 ppm of magnesium atoms (ASTM D5185), and 2) at least 500 ppm, preferably at least 750 ppm, more preferably at least 900 ppm of atomic calcium, such as from 500-4000 ppm, preferably from 750-3000 ppm, more preferably from 900-2000 ppm atomic calcium (ASTM D5185).

The detergent may comprise one or more calcium detergents such as calcium carboxylate (e.g., salicylate), sulfonate, or phenate detergent.

Suitably the calcium detergent has a TBN of from 30 to 700 mgKOH/g (ASTM D2896), such as 50 to 650 mgKOH/g, such as 200 to 500 mgKOH/g, such as 240 to 450 mgKOH/g or alternately of 150 mgKOH/g or less, such as 100 mgKOH/g or less, or 200 mgKOH/g or more, or 300 mgKOH/g or more, or 350 mgKOH/g or more.

Suitably, the calcium detergent is a calcium salicylate, sulfonate, or phenate having a TBN of from 30 to 700 mgKOH/g, 30 to 650 mgKOH/g (ASTM D2896), such as 50 to 650 mgKOH/g, such as 200 to 500 mgKOH/g, such as 240 to 450 mgKOH/g or alternately of 150 mgKOH/g or less, such as 100 mgKOH/g or less, or 200 mgKOH/g or more, or 300 mgKOH/g or more, or 350 mgKOH/g or more.

Calcium detergent is typically present in amount sufficient to provide at least 500 ppm, preferably at least 750 more preferably at least 900 ppm atomic calcium to the lubricating oil composition (ASTM D5185). If present, any calcium detergent is suitably present in amount sufficient to provide no more than 4000 ppm, preferably no more than 3000 ppm, more preferably no more than 2000 ppm atomic calcium to the lubricating oil composition (ASTM D5185). If present, any calcium detergent is suitably present in amount sufficient to provide at from 500-4000 ppm, preferably from 750-3000 ppm more preferably from 900-2000 ppm atomic calcium to the lubricating oil composition (ASTM D5185).

Suitably the total atomic amount of metal from detergent in the lubrication composition according to all aspects of the disclosure is no more than 5000 ppm, preferably no more than 4000 μm and more preferably no more than 2000 ppm (ASTM D5185). The total amount of atomic metal from detergent in the lubrication oil composition according to all aspects of the disclosure is suitably at least 500 ppm, preferably at least 800 ppm and more preferably at least 1000 ppm (ASTM D5185). The total amount of atomic metal from detergent in the lubrication oil composition according to all aspects of the disclosure is suitably from 500 to 5000 ppm, preferably from 500 to 3000 ppm and more preferably from 500 to 2000 ppm (ASTM D5185).

Sulfonate detergents may be prepared from sulfonic acids which are typically obtained by the sulfonation of alkyl substituted aromatic hydrocarbons, such as those obtained from the fractionation of petroleum or by the alkylation of aromatic hydrocarbons. Examples include those obtained by alkylating benzene, toluene, xylene, naphthalene, diphenyl, or their halogen derivatives such as chlorobenzene, chlorotoluene, and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product, but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur-containing compound such as hydrogen sulfide, sulfur monohalide, or sulfur dihalide, to form products which are generally mixtures of compounds in which 2 or more phenols are bridged by sulfur-containing bridges.

Carboxylate detergents, e.g., salicylates, can be prepared by reacting an aromatic carboxylic acid (such as a $C_{5-100}$, $C_{9-30}$, $C_{14-24}$ alkyl-substituted hydroxy-benzoic acid) with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example, benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

In embodiments, the ratio of atomic detergent metal to atomic molybdenum in the lubricating oil composition may be less than 3:1, such as less than 2:1.

Further, as metal organic and inorganic base salts, which are used as detergents can contribute to the sulfated ash content of a lubricating oil composition, in embodiments of the present disclosure, the amounts of such additives are minimized. In order to maintain a low sulfur level, salicylate detergents can be used and the lubricating composition herein may comprise one or more salicylate detergents (said detergents are preferably used in amounts in the range of 0.05 to 20.0 wt %, more preferably from 1.0 to 10.0 wt % and most preferably in the range of from 2.0 to 5.0 wt %, based on the total weight of the lubricating composition).

The total sulfated ash content of the lubricating composition herein is typically not greater than 2.0 wt %, alternately at a level of not greater than 1.0 wt % and alternately at a level of not greater than 0.8 wt %, based on the total weight of the lubricating composition as determined by ASTM D874.

Furthermore, it is useful that each of the detergents, independently, have a TBN (total base number) value in the range of from 10 to 700 mgKOH/g, 10 to 500 mgKOH/g, alternately in the range of from 100 to 650, alternately in the range of from 10 to 500 mgKOH/g, alternately in the range of from 30 to 350 mgKOH/g, and alternately in the range of from 50 to 300 mgKOH/g, as measured by ISO 3771.

The sulfonate detergents (such as Ca and/or Mg sulfonate detergents) may be present in an amount to deliver 0.1 wt % to 1.5 wt %, or 0.15 to 1.2 wt %, or 0.2 wt % to 0.9 wt % sulfonate soap to the lubricant composition.

The salicylate detergents (such as Ca and/or Mg salicylate detergents) are present in an amount to deliver 0.3 wt % to 1.4 wt %, or 0.35 wt % to 1.2 wt %, or 0.4 wt % to 1.0 wt % salicylate soap to the lubricant composition.

The sulfonate soap may be present in an amount 0.2 wt % to 0.8 wt % of the lubricant composition, and the salicylate soap may be present in an amount 0.3 wt % to 1.0 wt % of the lubricant composition.

The total of all alkaline earth metal detergent soap may be present in an amount 0.6 wt % to 2.1 wt %, or 0.7 wt % to 1.4 wt % of the lubricant composition.

Typically, lubricating compositions formulated for use in heavy-duty diesel engines comprise detergents at from about 0.1 to about 10 mass %, alternately from about 0.5 to about 7.5 mass %, alternately from about 1 to about 6.5 mass %, based on the lubricating composition.

Typically, lubricating compositions formulated for use in a passenger-car engines comprise detergents at from about 0.1 to about 10 mass %, alternately from about 0.5 to about 7.5 mass %, alternately from about 1 to about 6.5 mass %, based on the lubricating composition.

Typically, lubricating compositions formulated for use in a drive train (e.g., transmissions) comprise detergents at from about 0.1 to about 10 mass %, alternately from about 0.5 to about 7.5 mass %, alternately from about 2 to about 6.5 mass %, based on the lubricating composition.

D. Friction Modifiers

A friction modifier is any material or materials that can alter the coefficient of friction of a surface lubricated by any lubricant or fluid-containing such material(s). Friction modifiers, also known as friction reducers, or lubricity agents or oiliness agents, and other such agents that change the ability of base oils, formulated lubricating compositions, or functional fluids, to modify the coefficient of friction of a lubricated surface may be effectively used in combination with the base oils or lubricating compositions of the present disclosure if desired. Friction modifiers that lower the coefficient of friction are particularly advantageous in combination with the base oils and lubricating compositions of this disclosure.

Illustrative friction modifiers may include, for example, organometallic compounds or materials, or mixtures thereof. Illustrative organometallic friction modifiers useful in the lubricating oil formulations of this disclosure include, for example, tungsten and/or molybdenum compounds, such as molybdenum amine, molybdenum diamine, an organotungstenate, a molybdenum dithiocarbamate, molybdenum dithiophosphates, molybdenum amine complexes, molybdenum carboxylates, and the like, and mixtures thereof. Examples of useful molybdenum-containing compounds may conveniently include molybdenum dithiocarbamates, trinuclear molybdenum compounds, for example, as described in PCT Publication No. WO 98/26030, sulfides of molybdenum and molybdenum dithiophosphate.

Other known friction modifiers comprise oil-soluble organo-molybdenum compounds. Such organo-molybdenum friction modifiers may also provide antioxidant and anti-wear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D664 or D2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOC_{14}$, $MoO_2Br_2$, $Mo_2O_3C_{16}$, molybdenum trioxide or similar acidic molybdenum compounds.

Among the molybdenum compounds useful in the compositions of this disclosure are organo-molybdenum compounds of the formula $Mo(R''OCS_2)_4$ and $Mo(R''SCS_2)_4$, wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this disclosure are trinuclear molybdenum compounds, especially those of the formula Mo3SkLnQz and mixtures thereof wherein the L are independently selected ligands having organo groups with a sufficient number of carbon atoms to render the compound soluble or dispersible in the oil, n is from 1 to 4, k varies from 4 to 7, Q is selected from the group of neutral electron-donating compounds such as water, amines, alcohols, phosphines, and ethers, and z ranges from 0 to 5 and includes non-stoichiometric values. At least 21 carbon atoms should be present among all the ligand/organo groups, such as at least 25, at least 30, or at least 35, carbon atoms.

Lubricating oil compositions useful in all aspects of the present disclosure preferably contain at least 10 ppm, at least 30 ppm, at least 40 ppm and more preferably at least 50 ppm molybdenum. Suitably, lubricating oil compositions useful in all aspects of the present disclosure contain no more than 1000 ppm, no more than 750 ppm, or no more than 500 ppm of molybdenum. Lubricating oil compositions useful in all aspects of the present disclosure preferably contain from 10 to 1000, such as 30 to 750 or 40 to 500, ppm of molybdenum (measured as atoms of molybdenum).

For more information or useful friction modifiers containing Mo, please see U.S. Pat. No. 10,829,712 (col 8, ln 58 to col 11, In 31).

Ashless friction modifiers may be present in the lubricating oil compositions of the present disclosure and are known generally and include esters formed by reacting carboxylic acids and anhydrides with alkanols and amine-based friction modifiers. Other useful friction modifiers generally include a polar terminal group (e.g., carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26. Typically, the total amount of organic ashless friction modifier in a lubricant according to the present disclosure does not exceed 5 mass %, based on the total mass of the lubricating oil composition and preferably does not exceed 2 mass % and more preferably does not exceed 0.5 mass %.

Illustrative friction modifiers useful in the lubricating compositions described herein include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol monooleate, saturated mono-, di-, and tri-glyceride esters, glycerol monostearate, and the like. These can include polyol esters, hydroxyl-containing polyol esters, and the like.

Illustrative borated glycerol fatty acid esters include, for example, borated glycerol monooleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol di-oleates, glycerol tri-oleates, glycerol monooleates, glycerol di-stearates, and glycerol tri-stearates and the corresponding glycerol mono-palmitates, glycerol dipalmitates, and glycerol tri-palmitates, and the respective isostearates, linoleates, and the like. Ethoxylated, propoxylated, and/or butoxylated fatty acid esters of polyols, especially using glycerol as underlying polyol are useful herein.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

Useful concentrations of friction modifiers may range from 0.01 wt % to 5 wt %, or about 001 wt % to about 2.5 wt %, or about 0.05 wt % to about 1.5 wt %, or about 0.051 wt % to about 1 wt %. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface-active material(s), are also desirable. For example, combinations of Mo-containing compounds with polyol fatty acid esters, such as glycerol mono-oleate are useful herein.

E. Antioxidants

Antioxidants retard the oxidative degradation of base oils during service. Such degradation may result in deposits on metal surfaces, the presence of sludge, a viscosity increase in a lubricant, and the like. A wide variety of oxidation inhibitors that are useful in lubricating oil compositions. See Lubricants and Related Products, Klamann, Wiley VCH, 1984; U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics, which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_{6+}$ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic proprionic ester derivatives. Bis-phenolic antioxidants may also be advantageously used herein. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include, for example, 4,4'-bis(2,6-di-t-butyl-phenol) and 4,4'-methylene-bis(2,6-di-t-butyl-phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants useful herein are more fully described in U.S. Pat. No. 8,048,833.

Non-phenolic oxidation inhibitors, which may be used include aromatic amine antioxidants and these may be used either as such or in combination with phenolics. Typical examples of non-phenolic antioxidants include: alkylated and non-alkylated aromatic amines such as aromatic monoamines of the formula $R_8R_9R_{10}N$, where $R_8$ is an aliphatic, aromatic or substituted aromatic group, $R_9$ is an aromatic or a substituted aromatic group, and $R_{10}$ is H, alkyl, aryl or $R_{11}S(O)XR_{12}$ where $R_{11}$ is an alkylene, alkenylene, or aralkylene group, $R_{12}$ is an alkyl group, or an alkenyl, aryl, or alkaryl group, and x is 0, 1, or 2. The aliphatic group $R_8$ may contain from 1 to about 20 carbon atoms, and preferably contains from about 6 to 12 carbon atoms. The aliphatic group is typically a saturated aliphatic group. Preferably, both $R_8$ and $R_9$ are aromatic or substituted aromatic groups, and the aromatic group may be a fused ring aromatic group such as naphthyl. Aromatic groups $R_8$ and $R_9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alpha-naphthylamine; and p-octylphenyl-alpha-naphthylamine.

Sulfur-containing antioxidants are also useful herein. In particular, one or more oil-soluble or oil-dispersible sulfur-containing antioxidant(s) can be used as an antioxidant additive. For example, sulfurized alkyl phenols and alkali or alkaline earth metal salts thereof also are useful antioxidants herein. Suitably, the lubricating oil composition(s) of the present disclosure may include the one or more sulfur-containing antioxidant(s) in an amount to provide the lubricating oil composition with from 0.02 to 0.2, preferably from 0.02 to 0.15, even more preferably 0.02 to 0.1, even more preferably 0.04 to 0.1, mass % sulfur based on the total mass of the lubricating oil composition. Optionally the oil-soluble or oil-dispersible sulfur-containing antioxidant(s) are selected from sulfurized $C_4$ to $C_{25}$ olefin(s), sulfurized aliphatic ($C_7$ to $C_{29}$) hydrocarbyl fatty acid ester(s), ashless sulfurized phenolic antioxidant(s), sulfur-containing organo-molybdenum compound(s), and combinations thereof. For further information, on sulfurized materials useful as antioxidants herein, please see U.S. Pat. No. 10,731,101 (col 15, ln 55 to col 22, ln 12).

Antioxidants useful herein include hindered phenols and/or arylamines. These antioxidants may be used individually by type or in combination with one another.

Typical antioxidants include: Irganox™ L67, Irganox™ L135, Ethanox™ 4702, Lanxess Additin™ RC 7110; Ethanox™ 4782J; Irganox™ 1135, Irganox™ 5057, sulfurized lard oil and palm oil fatty acid methyl ester.

Antioxidant additives may be used in an amount of about 0.01 to 10 (alternately 0.01 to 5, alternately 0.01 to 3) wt %, alternately about 0.03 to 5 wt %, alternately 0.05 to less than 3 wt %, based upon the weight of the lubricating composition.

Compositions according to the present disclosure may contain an additive having a different enumerated function that also has secondary effects as an antioxidant (for example, phosphorus-containing anti-wear agents (such as ZDDP) may also have antioxidant effects). These additives are not included as antioxidants for purposes of determining the amount of antioxidant in a lubricating oil composition or concentrate herein.

F. Pour Point Depressants

Conventional pour point depressants (also known as lube oil flow improvers) may be added to the compositions of the present disclosure if desired. These pour point depressants may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %, based upon the weight of the lubricating composition.

G. Anti-Foam Agents

Anti-foam agents may advantageously be added to lubricant compositions described herein. These agents prevent or retard the formation of stable foams. Silicones and/organic polymers are typical anti-foam agents. For example, polysiloxanes, such as silicon oil or polydimethyl siloxane, provide anti-foam properties.

Anti-foam agents are commercially available and may be used in minor amounts such as 5 wt % or less, 3 wt % or less, 1 wt % or less, 0.1 wt % or less, such as from 5 to wt % to 0.1 ppm such as from 3 wt % to 0.5 ppm, such as from 1 wt % to 10 ppm.

For example, it may be that the lubricating oil composition comprises an anti-foam agent comprising polyalkyl siloxane, such as a polydialkyl siloxane, for example, wherein the alkyl is a $C_1$-$C_{10}$ alkyl group, e.g., a polydimethylsiloxane (PDMS), also known as a silicone oil. Alternately, the siloxane is a poly($R^3$)siloxane, wherein $R^3$ is one or more same or different linear branched or cyclic hydrocarbyls, such as alkyls or aryls, typically having 1 to 20 carbon atoms. It may be that, for example, the lubricating oil composition comprises a polymeric siloxane compound according to Formula 1 below wherein $R^1$ and $R^2$ are independently methyl, ethyl, propyl, butyl, pentyl, hexyl, heptyl, octyl, nonyl or decyl, phenyl, naphthyl, alkyl substituted phenyl, or isomers thereof (such as methyl, phenyl) and n is from 2 to 1000, such as 50 to 450, alternately such as 40 to 100.

Additionally, or alternatively, it may be that the lubricating oil composition comprises an organo-modified siloxane (OMS), such as a siloxane modified with an organo group such as a polyether (e.g., ethylene-propyleneoxide copolymer), long chain hydrocarbyl (e.g., $C_{11}$-$C_{100}$ alkyl), or aryl (e.g., $C_6$-$C_{14}$ aryl). It may be that, for example, the lubricating oil composition comprises an organo-modified siloxane compound according to Formula 1, wherein n is from 2 to 2000, such as 50 to 450 (alternately such as 40 to 100), and wherein $R^1$ and $R^2$ are the same or different, optionally wherein each of $R^1$ and $R^2$ is, independently an organo group, such as an organo group selected from polyether (e.g., ethylene-propyleneoxide copolymer), long chain hydrocarbyl (e.g., $C_{11}$-$C_{100}$ alkyl), or aryl (e.g., $C_6$-$C_{14}$ aryl). Preferably, one of $R^1$ and $R^2$ is $CH_3$.

Formula 1

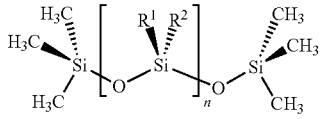

Based on the total weight of the lubricant composition, the siloxane according to Formula 1 is incorporated so as to provide about 0.1 to less than about 30 ppm Si, or about 0.1 to about 25 ppm Si, or about 0.1 to about 20 ppm Si, or about 0.1 to about 15 ppm Si, or about 0.1 to about 10 ppm Si. More preferably, it is in the range of about 3-10 ppm Si.

In embodiments, silicone anti-foam agents useful herein are available from Dow Corning Corporation and Union Carbide Corporation, such as Dow Corning FS-1265 (1000 centistokes), Dow Corning DC-200, and Union Carbide UC-L45. Silicone anti-foam agents useful herein include polydimethylsiloxane, phenyl-methyl polysiloxane, linear, cyclic or branched siloxanes, silicone polymers and copolymers, and/organo-silicone copolymers. Also, a siloxane polyether copolymer Anti-foam agent available from OSI Specialties, Inc. of Farmington Hills, Michigan and may be substituted or included. One such material is sold as SILWET-L-7220.

Acrylate polymer anti-foam agent can also be used herein. Typical acrylate anti-foam agents include polyacrylate anti-foam agent available from Monsanto Polymer Products Co. known as PC-1244. A preferred acrylate polymer anti-foam agent useful herein is PX™3841 (i.e., an alkyl acrylate polymer), commercially available from Dorf Ketl, also referred to as Mobilad™ C402.

In embodiments, a combination of sililcone anti-foam agent and acrylate anti-foam agent can be used, such as at a weight ratio of the silicone anti-foam agent to the acrylate anti-foam agent of from about 5:1 to about 1:5, see, for example, US Patent Application Publication No. 2021/0189283.

H. Viscosity Modifiers

Viscosity modifiers (also referred to as viscosity index improvers or viscosity improvers) can be included in the lubricating compositions described herein. Viscosity modifiers provide lubricants with high and low temperature operability. These additives impart shear stability at elevated temperatures and acceptable viscosity at low temperatures. Suitable viscosity modifiers include high molecular weight hydrocarbons, polyesters, and viscosity modifier dispersants that can function as both a viscosity modifier and a dispersant. Typical molecular weights of these polymers are between about 10,000 to 1,500,000 g/mol, more typically about 20,000 to 1,200,000 g/mol, and even more typically between about 50,000 and 1,000,000 g/mol. For purposes of this disclosure and the claims thereto, the term viscosity modifiers does not include the radial block copolymers described by Section B above, i.e., if the viscosity modifier is a radial styrenic block copolymer, the styrenic block not proximal to the radial center.

Examples of suitable viscosity modifiers are linear, grafted (also known as as comb or brush), or star-shaped polymers and copolymers of methacrylate, butadiene, olefins, or alkylated styrenes of any tacticity or microstructure. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene (preferably where if the block copolymer is in radial form, the styrene block is not proximal to the radial center), and polyacrylates (copolymers of various chain length acrylates, for example). Specific examples include styrene-isoprene or styrene-butadiene based polymers of 50,000 to 200,000 g/mol molecular weight (where the styrene block is distal to the radial center).

Copolymers useful as viscosity modifiers include those commercially available from Chevron Oronite Company LLC under the trade designation "PARATONE™" (such as "PARATONE™ 8921," "PARATONE™ 68231," and "PARATONE™ 8941"); from Afton Chemical Corporation under the trade designation "HiTEC™" (such as HiTEC™ 5850B, and HiTEC™5777); and from The Lubrizol Corporation under the trade designation "Lubrizol™ 7067C". Hydrogenated polyisoprene star polymers useful as viscosity modifiers herein include those commercially available from Infineum International Limited, e.g., under the trade designation "SV200™" and "SV600™". Hydrogenated diene-styrene block copolymers useful as viscosity modifiers herein are commercially available from Infineum International Limited, e.g., under the trade designation "SV150™"

Polymers useful as viscosity modifiers herein include polymethacrylate or polyacrylate polymers, such as linear polymethacrylate or polyacrylate polymers, such as those available from Evnoik Industries under the trade designation "Viscoplex™" (e.g., Viscoplex™ 6-954) or star polymers which are available from Lubrizol Corporation under the trade designation Asteric™ (e.g., Lubrizol™ 87708 and Lubrizol™ 87725).

Vinyl aromatic-containing polymers useful as viscosity modifiers herein may be derived from vinyl aromatic hydrocarbon monomers, such as styrenic monomers, such as styrene. Illustrative vinyl aromatic-containing copolymers useful herein may be represented by the following general formula: A-B wherein A is a polymeric block derived predominantly from vinyl aromatic hydrocarbon monomer (such as styrene), and B is a polymeric block derived predominantly from conjugated diene monomer (such as isoprene).

Vinyl aromatic-containing polymers useful as viscosity modifiers may have a Kinematic viscosity at 100° C. of 20 cSt or less, such as 15 cSt or less, such as 12 cSt or less, but may be diluted (such as in Group I, II, and/or III base stock) to higher Kinematic viscosities at 100° C., such as to 40 cSt or more, such as 100 cSt or more, such as 1000 cSt or more, such as 1000 to 2000 cSt).

Vinyl aromatic-containing polymer concentrates prepared in base oil (such as in Group I, II, and/or III base stock) useful as viscosity modifiers may have a Kinematic viscosity at 100° C. of 40 cSt or more, such as 100 cSt or more, such as 1000 cSt or more, such as 1000 to 2000 cSt. Further dilution in base oil (such as in Group I, II, and/or III base stock) may lower the Kinematic viscosities at 100° C., such as to 20 cSt or less, such as 15 cSt or less, such as 12 cSt or less.

Typically, the viscosity modifiers may be used in an amount of about 0.01 to about 10 wt %, such as about 0.1 to about 7 wt %, such as 0.1 to about 4 wt %, such as about 0.2 to about 2 wt %, such as about 0.2 to about 1 wt %, and such as about 0.2 to about 0.5 wt %, based on the total weight of the formulated lubricant composition.

Viscosity modifiers are typically added as concentrates, in large amounts of diluent oil. The "as delivered" viscosity modifier typically contains from 20 wt % to 75 wt % of an active polymer for polymethacrylate or polyacrylate polymers, or from 8 wt % to 20 wt % of an active polymer for olefin copolymers, hydrogenated polyisoprene star polymers, or hydrogenated diene-styrene block copolymers, in the "as delivered" polymer concentrate.

I. Dispersants

During engine operation, oil-insoluble oxidation byproducts are produced. Dispersants help keep these byproducts in solution, thus diminishing their deposition on metal surfaces. Dispersants used in the formulation of the lubricating compositions herein may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents tend to form ash upon combustion.

Dispersants useful herein typically contain a polar group attached to a relatively high molecular weight hydrocarbon chain. The polar group typically contains at least one element of nitrogen, oxygen, or phosphorus. Typical hydrocarbon chains contain 40 to 500, such as 50 to 400 carbon atoms.

Dispersants of (Poly)Alkenylsuccinic Derivatives

A particularly useful class of dispersants includes the (poly)alkenylsuccinic derivatives, typically produced by the reaction of a long chain hydrocarbyl-substituted succinic compound, usually a hydrocarbyl-substituted succinic anhydride, with a polyhydroxy or polyamino compound. The long chain hydrocarbyl group constituting the oleophilic portion of the molecule which confers solubility in the oil, is often a polyisobutylene group (typically the long chain hydrocarbyl group, such as a polyisobutylene group, has an Mn of 400 to 3000 g/mol, such as 450 to 2500 g/mol). Many examples of this type of dispersant are well known commercially and in the literature. Exemplary US Patents describing such dispersants include U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersants are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants useful herein may be found, for example, in European Patent Applications Nos. 0 471 071 and 0 451 380, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid or anhydride compound (typically having at least 25 carbon atoms, such as 28 to 400 carbon atoms, in the hydrocarbon substituent), with at least one equivalent of a polyhydroxy or polyamino compound (such as an alkylene amine) are particularly useful herein. Hydrocarbyl-substituted succinic acid and hydrocarbyl-substituted succinic anhydride derivatives may have a number average molecular weight of at least 400 g/mol, such as at least 900 g/mol, such as at least 1500 g/mol, such as from 400 to 4000 g/mol, such as from 800 to 3000, such as from 2000 to 2800 g/mol, such from about 2100 to 2500 g/mol, and such as from about 2200 to about 2400 g/mol.

Succinimides, which are particularly useful herein, are formed by the condensation reaction between: 1) hydrocarbyl-substituted succinic anhydrides, such as polyisobutylene succinic anhydride (PIBSA); and 2) polyamine (PAM). Examples of suitable polyamines include: polyhydrocarbyl polyamines, polyalkylene polyamines, hydroxy-substituted polyamines, polyoxyalkylene polyamines, and combinations thereof. Examples of polyamines include tetraethylene pentamine, pentaethylene hexamine, tetraethylenepentamine (TEPA), pentaethylenehaxamine (PEHA), N-phenyl-p-phenylenediamine (ADPA), and other polyamines having an average of 5, 6, 7, 8, or 9 nitrogen atoms per molecule. Mixtures where the average number of nitrogen atoms per polyamine molecule is greater than 7 are commonly called heavy polyamines or H-PAMs and may be commercially available under trade names such as HPA™ and HPA-X™ from DowChemical, E-100™ from Huntsman Chemical, et al. Examples of hydroxy-substituted polyamines include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines include polyoxyethylene and/or polyoxypropylene diamines and triamines (as well as co-oligomers thereof) having an average Mn from about 200 to about 5000 g/mol. Products of this type are commercially available under the tradename Jeffamine™. Representative examples of useful succinimides are shown in U.S. Pat. Nos. 3,087,936; 3,172,892; 3,219,666; 3,272,746; 3,322,670; 3,652,616; 3,948,800; and 6,821,307; and CA Patent No. 1,094,044.

The dispersants may comprise one or more, optionally borated, higher molecular weight (Mn 1600 g/mol or more, such as 1800 to 3000 g/mol) succinimides and one or more, optionally borated, lower molecular weight (Mn less than 1600 g/mol) succinimides, where the higher molecular weight may be 1600 to 3000 g/mol, such as 1700 to 2800 g/mol, such as 1800 to 2500 g/mol, such as 1850 to 2300 g/mol; and the lower molecular weight may be 600 to less than 1600 g/mol, such as 650 to 1500 g/mol, such as 700 to 1400 g/mol, such as 800 to 1300 g/mol, such as 850 to 1200 g/mol such as 900 to 1150 g/mol, such as 900 to 1000 g/mol. The higher molecular weight succinimide dispersant may be present in the lubricating composition in an amount of from 0.5 to 10 wt %, or from 0.8 to 6 wt %, or from 1.0 to 5 wt %, or from 1.5 to 5 wt %, or from 1.5 to 4.0 wt %; and the lower molecular weight succinimides dispersant may be present in the lubricating composition in an amount of from 1 to 5 wt %, or from 1.5 to 4.8 wt %, or from 1.8 to 4.6 wt %, or from 1.9 to 4.6 wt %, or at 2 wt % or more, such as 2 to 5 wt %. The lower molecular weight succinimides may differ from the higher molecular weight succinimides, by 500 g/mol or more, such as by 750 g/mol or more, such as by 1000 g/mol or more, such as by 1200 g/mol or more, such as by 500 to 3000 g/mol, such as by 750 to 2000 g/mol, such as by 1000 to 1500 g/mol.

Succinate esters useful as dispersants include those formed by the condensation reaction between hydrocarbyl-substituted succinic anhydrides and alcohols or polyols. For example, the condensation product of a hydrocarbyl-substituted succinic anhydride and pentaerythritol is a useful dispersant.

Succinate ester amides useful herein are formed by a condensation reaction between hydrocarbyl-substituted succinic anhydrides and alkanol amines. Suitable alkanol amines include ethoxylated polyalkylpolyamines, propoxylated polyalkylpolyamines, and polyalkenylpolyamines such as polyethylene polyamines and/or propoxylated hexamethylenediamine. Representative examples are shown in U.S. Pat. No. 4,426,305.

Hydrocarbyl-substituted succinic anhydrides (such as PIBSA) esters of hydrocarbyl bridged aryloxy alcohols are also useful as dispersants herein. For information on such dispersants, please see U.S. Pat. No. 7,485,603, particularly, col 2, ln 65 to col 6, ln 22 and col 23, ln 40 to col 26, ln 46. In particular, PIBSA esters of methylene-bridged naphthyloxy ethanol (i.e., 2-hydroxyethyl-1-naphthol ether (or hydroxy-terminated ethylene oxide oligomer ether of naphthol) are useful herein.

The molecular weight of the hydrocarbyl-substituted succinic anhydrides used in the preceding paragraphs will typically range from 350 to 4000 g/mol, such as 400 to 3000 g/mol, such as 450 to 2800 g/mol, such as 800 to 2500 g/mol. The above (poly)alkenylsuccinic derivatives can be post-reacted with various reagents such as sulfur, oxygen, formaldehyde, carboxylic acids such as oleic acid.

The dispersants may be present in the lubricant in an amount 0.1 mass % to 20 mass % of the composition, such as 0.2 to 15 mass %, such as 0.25 to 10 mass %, such as 0.3 to 5 mass %, such as 1.0 mass % to 3.0 mass %, of the lubricating oil composition.

The above (poly)alkenylsuccinic derivatives, can also be post reacted with boron compounds such as boric acid, borate esters or highly borated dispersants, to form borated dispersants generally having from about 0.1 to about 5 moles of boron per mole of dispersant reaction product.

Dispersants useful herein include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having an Mn of from about 300 to about 5000 g/mol, or from about 500 to about 3000 g/mol, or about 1000 to about 2000 g/mol, or a mixture of such hydrocarbylene groups, often with high terminal vinylic groups.

The boron-containing dispersant may be present at 0.01 wt % to 20 wt %, or 0.1 wt % to 15 wt %, or 0.1 wt % to 10 wt %, or 0.5 wt % to 8 wt %, or 1.0 wt % to 6.5 wt %, or 0.5 wt % to 2.2 wt % of the lubricating composition.

The boron-containing dispersant may be present in an amount to deliver boron to the composition at 15 ppm to 2000 ppm, or 25 ppm to 1000 ppm, or 40 ppm to 600 ppm, or 80 ppm to 350 ppm.

The borated dispersant may be used in combination with non-borated dispersant and may be the same or different compound as the non-borated dispersant. In one embodiment, the lubricating composition may include one or more boron-containing dispersants and one or more non-borated dispersants, wherein the total amount of dispersant may be 0.01 wt % to 20 wt %, or 0.1 wt % to 15 wt %, or 0.1 wt % to 10 wt %, or 0.5 wt % to 8 wt %, or 1.0 wt % to 6.5 wt %, or 0.5 wt % to 2.2 wt % of the lubricating composition and wherein the ratio of borated dispersant to non-boroated dispersant may be 1:10 to 10:1 (weight:weight) or 1:5 to 3:1 or 1:3 to 2:1.

The dispersant may comprise one or more borated or unborated poly(alkenyl)succinimides, where the polyalkyenyl is derived from polyisobutylene and the imide is derived from a polyamine ("PIBSA-PAM").

The dispersant may comprise one or more PIBSA-PAMs, where the PIB is derived from polyisobutylene having an Mn of from 600 to 5000, such as from 700 to 4000, such as from 800 to 3000, such as from 900 to 2500 g/mol and the polyamine is derived from hydrocarbyl-substituted polyamines, such as tetraethylene pentamine, pentaethylene hexamine, tetraethylenepentamine (TEPA), pentaethylenehaxamine (PEHA), N-phenyl-p-phenylenediamine (ADPA), and other polyamines having an average of 5, 6, 7, 8, or 9 nitrogen atoms per molecule). The dispersant may be borated, typically at levels of up to 4 mass % such as from 1 to 3 mass %. The dispersant may comprise one or more borated and one or more non-borated PIBSA-PAM's. The dispersant may comprise one or more borated PIBSA-PAM's derived from a PIB having an Mn of 700 to 1800 g/mol (such as 800 to 1500 g/mol) and one or more non-borated PIBSA-PAM's derived from a PIB having an Mn of more than 1800 to 5000 g/mol (such as 2000 to 3000 g/mol). The dispersant may comprise one or more non-borated PIBSA-PAM's derived from a PIB having an Mn of 700 to 1800 g/mol (such as 800 to 1500 g/mol) and one or more borated PIBSA-PAM's derived from a PIB having an Mn of more than 1800 to 5000 g/mol (such as 2000 to 3000 g/mol).

The dispersant may comprise PIBSA derived from a PIB having an Mn of 700 to 5000 g/mol (such as 800 to 3000 g/mol) and one or more borated or non-borated PIBSA-PAM's derived from a PIB having an Mn of 700 to 5000 g/mol.

The dispersant may comprise PIBSA derived from a PIB having an Mn of 700 to 5000 g/mol (such as 800 to 3000 g/mol) and one or more borated PIBSA-PAM's derived from a PIB having an Mn of 700 to 1800 g/mol (such as 800 to 1500 g/mol) and one or more non-borated PIBSA-PAM's derived from a PIB having an Mn of more than 1800 to 5000 g/mol (such as 2000 to 3000 g/mol). The dispersant may comprise PIBSA derived from a PIB having an Mn of 700 to 5000 g/mol (such as 800 to 3000 g/mol) one or more non-borated PIBSA-PAM's derived from a PIB having an Mn of 700 to 1800 g/mol (such as 800 to 1500 g/mol) and one or more borated PIBSA-PAM's derived from a PIB having an Mn of more than 1800 to 5000 g/mol (such as 2000 to 3000 g/mol).

The dispersant may comprise one or more borated or non-borated PIBSA-PAM's and one or more PIBSA-esters of hydrocarbyl bridged aryloxy alcohols.

The dispersant may comprise one or more borated and one or more non-borated PIBSA-PAM's.

The dispersant may comprise one or more, optionally borated, higher molecular weight (Mn 1600 g/mol or more, such as 1800 to 3000 g/mol) PIBSA-PAM's and one or more, optionally borated, lower molecular weight (Mn less than 1600 g/mol) PIBSA-PAM's, where the higher molecular weight may be 1600 to 3000 g/mol, such as 1700 to 2800 g/mol, such as 1800 to 2500 g/mol, such as 1850 to 2300 g/mol; and the lower molecular weight may be 600 to less than 1600 g/mol, such as 650 to 1500 g/mol, such as 700 to 1400 g/mol, such as 800 to 1300 g/mol, such as 850 to 1200 g/mol, such as 900 to 11500 g/mol, such as 900 to 100 g/mol. The higher molecular weight PIBSA-PAM dispersant may be present in the lubricating composition in an amount of from 0.5 to 10 wt %, or from 0.8 to 6 wt %, or from 1.0 to 5 wt %, or from 1.5 to 5 wt % or from 1.5 to 4.0 wt %; and the lower molecular weight PIBSA-PAM dispersant may be present in the lubricating composition in an amount of from 1 to 5 wt %, or from 1.5 to 4.8 wt %, or from 1.8 to 4.6 wt %, or from 1.9 to 4.6 wt %, or at 2 wt % or more, such as 2 to 5 wt %.

Dispersants of Mannich Bases

Mannich base dispersants useful herein are typically made from the reaction of an amine component, a hydroxy aromatic compound (substituted or unsubstituted, such as alkyl substituted), such as alkylphenols, and an aldehyde, such as formaldehyde. See U.S. Pat. Nos. 4,767,551 and 10,899,986. Process aids and catalysts, such as oleic acid and sulfonic acids, can also be part of the reaction mixture. Representative examples are shown in U.S. Pat. Nos. 3,697,574; 3,703,536; 3,704,308; 3,751,365; 3,756,953; 3,798,165; 3,803,039; 4,231,759; 9,938,479; 7,491,248; and 10,899,986, and PCT Publication No. WO 01/42399.

Dispersants of Polymethacrylate or Polyacrylate Derivatives

Polymethacrylate or polyacrylate derivatives are another class of dispersants useful herein. These dispersants are typically prepared by reacting a nitrogen-containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are typically lower molecular weights.

The lubricating composition of the disclosure typically comprises dispersant at 0.1 mass % to 20 mass % of the composition, such as 0.2 to 15 mass %, such as 0.25 to 10 mass %, such as 0.3 to 5 mass %, such as 2.0 mass % to 4.0 mass % of the lubricating oil composition. Alternately the dispersant may be present at 0.1 wt % to 5 wt %, or 0.01 wt % to 4 wt % of the lubricating composition.

For further information on dispersants useful herein, please see U.S. Pat. No. 10,829,712, col 13, ln 36 to col 16, ln 67 and U.S. Pat. No. 7,485,603, col 2, ln 65 to col 6, ln 22, col 8, ln 25 to col 14, ln 53, and col 23, ln 40 to col 26, ln 46.

Compositions according to the present disclosure may contain an additive having a different enumerated function that also has secondary effects as a dispersant (for example, Component B Functionalized Polymer described above, may also have dispersant effects). These additives are not included as dispersants for purposes of determining the amount of dispersant in a lubricating oil composition or concentrate herein.

J. Corrosion Inhibitors/Anti-Rust Agents

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur-containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole represented by the structure:

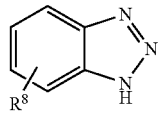

wherein $R^8$ is absent (hydrogen) or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. Non-limiting examples of such corrosion inhibitors may comprise or be benzotriazole, tolyltriazole, and/or optionally, substituted benzotriazoles such as Irgamet™ 39, which is commercially available from BASF of Ludwigshafen, Germany. A preferred corrosion inhibitor may comprise or be benzotriazole and/or tolyltriazole.

Additionally, or alternatively, the corrosion inhibitor may include one or more substituted thiadiazoles represented by the structure:

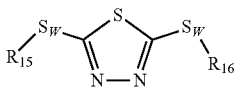

wherein $R_{15}$ and $R_{16}$ are independently hydrogen or a hydrocarbon group, which group may be aliphatic or aromatic, including cyclic, alicyclic, aralkyl, aryl and alkaryl, and wherein each w is independently 1, 2, 3, 4, 5, or 6 (preferably 2, 3, or 4, such as 2). These substituted thiadiazoles are derived from the 2,5-dimercapto-1,3,4-thiadiazole (DMTD) molecule. Many derivatives of DMTD have been described in the art, and any such compounds may be included in the fluid used in the present disclosure. For example, U.S. Pat. Nos. 2,719,125; 2,719,126; and 3,087,937; describe the preparation of various 2, 5-bis-(hydrocarbon dithio)-1,3,4-thiadiazoles.

Further, additionally or alternatively, the corrosion inhibitor may include one or more other derivatives of DMTD, such as a carboxylic ester in which $R_{15}$ and $R_{16}$ may be joined to the sulfide sulfur atom through a carbonyl group. Preparation of these thioester-containing DMTD derivatives is described, for example, in U.S. Pat. No. 2,760,933. DMTD derivatives produced by condensation of DMTD with alpha-halogenated aliphatic carboxylic acids having at least 10 carbon atoms are described, for example, in U.S. Pat. No. 2,836,564. This process produces DMTD derivatives wherein $R_{15}$ and $R_{16}$ are HOOC—CH($R_{19}$)—($R_{19}$ being a hydrocarbyl group). DMTD derivatives further produced by amidation or esterification of these terminal carboxylic acid groups may also be useful.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

Still further, additionally or alternatively, the corrosion inhibitor may include a trifunctional borate having the structure, $B(OR_{46})_3$, in which each $R_{46}$ may be the same or different. As the borate may typically be desirably compatible with the non-aqueous medium of the composition, each $R_{46}$ may, in particular, comprise or be a hydrocarbyl $C_1$-$C_8$ moiety. For compositions in which the non-aqueous medium comprises or is a lubricating oil base stock, for example, better compatibility can typically be achieved when the hydrocarbyl moieties are each at least $C_4$. Non-limiting examples of such corrosion inhibitors thus include, but are not limited to, triethylborate, tripropylborates such as triisopropylborate, tributylborates such as tri-tert-butylborate, tripentylborates, trihexylborates, trioctylborates such as tri-(2-ethylhexyl)borate, monohexyl dibutylborate, and the like, as well as combinations thereof.

When used, a corrosion inhibitor may comprise a substituted thiadiazole, a substituted benzotriazole, a substituted triazole, a trisubstituted borate, or a combination thereof.

When desired, corrosion inhibitors can be used in any effective amount, but, when used, may typically be used in amounts from about 0.001 wt % to 5.0 wt %, based on the weight of the composition, e.g., from 0.005 wt % to 3.0 wt % or from 0.01 wt % to 1.0 wt %. Alternately, such additives may be used in an amount of about 0.01 to 5 wt %, preferably about 0.01 to 1.5 wt %, based upon the weight of the lubricating composition.

In some embodiments, 3,4-oxypyridinone-containing compositions may contain substantially no (e.g., 0, or less than 0.001 wt %, 0.0005 wt % or less, not intentionally added, and/or absolutely no) triazoles, benzotriazoles, substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, derivatives thereof, combinations thereof, or all corrosion inhibitors.

Compositions according to the present disclosure may contain an additive having a different enumerated function that also has secondary effects as a corrosion inhibitor (for example, Component B Functionalized Polymer described above, may also have corrosion inhibitor effects). These additives are not included as corrosion inhibitor for purposes of determining the amount of corrosion inhibitor in a lubricating oil composition or concentrate herein.

K. Anti-Wear Agents

The lubricating oil composition of the present disclosure can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo, and the like) salts of dithiophosphates, metal (e.g., Zn, Pb, Sb, Mo, and the like) salts of dithiocarbamates, metal (e.g., Zn, Pb, Sb, and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt % to about 5 wt %, from about 0.05 wt % to about 3 wt %, or from about 0.1 wt % to about 1 wt %, based on the total weight of the lubricating oil composition.

In embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel, or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

Useful anti-wear agents also include substituted or unsubstituted thiophosphoric acids, and salts thereof include zinc-containing compounds such as zinc dithiophosphate compounds selected from zinc dialkyl-, diaryl- and/or alkylaryl-dithiophosphates.

A metal alkylthiophosphate and more particularly a metal dialkyl dithio phosphate in which the metal constituent is zinc, or zinc dialkyl dithio phosphate (ZDDP) can be a useful component of the lubricating compositions of this disclosure. ZDDP can be derived from primary alcohols, secondary alcohols or mixtures thereof. ZDDP compounds generally are of the formula $Zn[SP(S)(OR_1)(OR_2)]_2$ where $R_1$ and $R_2$ are $C_1$-$C_{15}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be used. Alkyl aryl groups may also be used. Useful zinc dithiophosphates include secondary zinc dithiophosphates such as those available from The Lubrizol Corporation under the trade designations "LZ 677A", "LZ 1095" and "LZ 1371", from Chevron Oronite under the trade designation "OLOA 262" and from Afton Chemical under the trade designation "HiTEC™ 7169".

In embodiments, the zinc compound can be a zinc dithiocarbamate complex, such as the zinc dithiocarbamates represented by the formula:

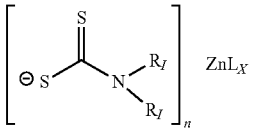

where each $R_1$ is independently a linear, cyclic, or branched, saturated or unsaturated, aliphatic hydrocarbon moiety having from 1 to about 10 carbon atoms, n is 0, 1, or 2, L is a ligand that saturates the coordination sphere of zinc, and x is 0, 1, 2, 3, or 4. In certain embodiments, the ligand, L, is selected from the group consisting of water, hydroxide, ammonia, amino, amido, alkylthiolate, halide, and combinations thereof.

The anti-wear additives, such as ZDDP and/or the zinc carbamates, are typically used in amounts of from about 0.4 wt % to about 1.2 wt %, preferably from about 0.5 wt % to about 1.0 wt %, and more preferably from about 0.6 wt % to about 0.8 wt %, based on the total weight of the lubricating composition, although more or less can often be used advantageously. Preferably, the anti-wear additive is ZDDP, preferably a secondary ZDDP, and is present in an amount of from about 0.6 to 1.0 wt % of the total weight of the lubricating composition.

Anti-wear additives useful herein also include boron-containing compounds, such as borate esters, borated fatty amines, borated epoxides, alkali metal (or mixed alkali metal or alkaline earth metal) borates and borated overbased metal salts.

Compositions according to the present disclosure may contain an additive having a different enumerated function that also has secondary effects as an anti-wear agent (for example, Component B Functionalized Polymer described above, may also have anti-wear effects). These additives are not included as anti-wear agents for purposes of determining the amount of anti-wear agents in a lubricating oil composition or concentrate herein.

L. Demulsifiers

Demulsifiers useful herein include those described in U.S. Pat. No. 10,829,712 (col 20, ln 34-40). Typically, a small amount of a demulsifying component may be used herein. A preferred demulsifying component is described in European Patent No. 330 522. It is obtained by reacting an alkylene oxide with an adduct obtained by reacting a bis-epoxide with a polyhydric alcohol. Such additives may be used in an amount of about 0.001 to 5 wt %, preferably about 0.01 to 2 wt %.

M. Seal Compatibility Agents

Other optional additives include seal compatibility agents such as organic phosphates, aromatic esters, aromatic hydrocarbons, esters (butylbenzyl phthalate, for example), and polybutenyl succinic anhydride. Such additives may be used in an amount of about 0.001 to 5 wt %, preferably about 0.01 to 2 wt %. In embodiments the seal compatibility agents are sea swell agents, such as PIBSA (polyisobutenyl succinic anhydride).

N. Extreme Pressure Agents

The lubricating oil composition of the present disclosure can contain one or more extreme pressure agents that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally substituted dihydrocarbyl polysulfides, thia-aldehydes, thia-ketones, epithio compounds, sulfur-containing acetal derivatives, co-sulfurized blends of terpene and acyclic olefins, and poly sulfide olefin products, amine salts of phosphoric acid esters or thiophosphoric acid esters, and combinations thereof. The amount of the extreme pressure agent may vary from about 0.01 wt % to about 5 wt %, from about 0.05 wt % to about 3 wt %, or from about 0.1 wt % to about 1 wt %, based on the total weight of the lubricating oil composition.

O. Non-Base Stock Unsaturated Hydrocarbons

The lubricating oil composition of the present disclosure can contain one or more unsaturated hydrocarbons. These unsaturated hydrocarbons are distinct from any baseoils (lubricating oil base stocks of Group I, II, III, IV and/or V) and/or viscosity modifiers that may be present in the compositions and always have at least one (and typically only one, in the case of linear alpha-olefins, or LAOs) unsaturation per molecule. Without being bound by theory, the unsaturation(s) may provide an antioxidation functionality and/or a sulfur-trapping functionality that may supplement and/or replace one or more antioxidant additives and/or one or more corrosion inhibitor additives, but unsaturated hydrocarbons (LAOs) will typically not provide the only antioxidant nor the only corrosion inhibition functionality in lubrication oil compositions. Non-limiting examples of unsaturated hydrocarbons can include one or more unsaturated $C_{12}$-$C_{60}$ hydrocarbons (such as $C_{12}$-$C_{48}$ hydrocarbons, $C_{12}$-$C_{36}$ hydrocarbons, $C_{12}$-$C_{30}$ hydrocarbons, or $C_{12}$-$C_{24}$ hydrocarbons). When only one unsaturation is present, the unsaturated hydrocarbons may be termed linear alpha-olefins (LAOs). Other non-limiting examples of unsaturated hydrocarbons can include oligomers/polymers of polyisobutylenes that have retained (or been post-polymerization modified to exhibit) a (near-) terminal unsaturation, and/or blends thereof. When present, unsaturated hydrocarbons (LAOs) may be present from 0.01 to 5 wt % (in particular, 0.1 to 3 mass %, alternately 0.1 to 1.5 mass %) based on total weight of the lubricating oil composition.

When lubricating oil compositions contain one or more of the additives discussed above, the additive(s) are typically blended into the composition in an amount sufficient for it to perform its intended function. Typical amounts of such additives useful in the present disclosure, especially for use in crankcase lubricants, are shown in the Table below.

It is noted that many of the additives are shipped from the additive manufacturer as a concentrate, containing one or more additives together, with a certain amount of base oil or other diluents. Accordingly, the weight amounts in the table below, as well as other amounts mentioned herein, are directed to the amount of active ingredient (that is the non-diluent portion of the ingredient). The weight percent (mass %) indicated below is based on the total weight of the lubricating oil composition.

Typical Amounts of Optional Lubricating Oil Components

| Additive Formulations | A (mass % a.i.) | B (mass % a.i.) | C (mass % a.i.) |
|---|---|---|---|
| Dispersant | 0.1-20 | 0.1-20 | 1-8 |
| Detergents | 0.1-20 | 0.1-20 | 0.2-9 |
| Corrosion Inhibitor Anti-rust/ extreme pressure agents | 0-7 | 0.05-5 | 0.1-1.5 |
| styrenic block copolymer VM with proximal styrenic block and distal conjugated diene block (SBC) | 0.1-20 | 1-8 | |
| Antioxidant | 0.01-10 | 0.1-5 | 0.1-4 |
| Pour Point Depressant | | 0-5 | 0.01-1.5 |
| Anti-foaming Agent | | 0-5 | 0.001-0.15 |
| Functionalized Polymer | 0.01-10 | 0.1-5 | 0.1-2 |
| Friction Modifier | | 1. | 0.5 |
| Anti-wear Agent | 0.01-10 | 0.1-5 | 0.1-3 |
| Viscosity Modifier, other than SBC above | | 0.01-10 | 0.25-3 |
| Seal Swell Agents | | 0-5 | 0-2 |
| Extreme Pressure Agents | | 0-5 | 0-3 |
| Unsaturated Hydrocarbons (LAOs) | | 0-5 | 0-3 |
| Base stock | Balance (such as 50 to 95 %) | Balance | Balance |

Typical Amounts of Optional Lubricating Oil Components in LOC (Continued)

| ADDITIVE FORMULATIONS | A (mass %) | B (mass %) | C (mass %) |
|---|---|---|---|
| Dispersant (borated and non-borated) | 0.1-40 | 1-20 | 4 to 15 |
| Detergents (Ca, Mg, and or Ca & Mg) | 0.1-20 | 0.2-15 | 2 to 10 |
| styrenic block copolymer VM with proximal styrenic block and distal conjugated diene block (SBC) | 0.1-15 | 0.5-5 | 1 to 5 |
| Amine and or phenol based Antioxidant | 0.01-7 | 0.10-5 | 1 to 5 |
| Sulfurized fatty acid ester | 0-20 | 0.01 to 10 | 0.1-5 |
| Molybdenum containing compound | 0.01-10 | 0.1 to 7 | 0.1 to 5 |
| Antifoaming Agent | 0.001-5 | 0.001-0.2 | 0.001-0.1 |
| Friction Modifier | 0-5 | 0-1.5 | 0.1 to 5 |
| Viscosity Modifier, other than SBC above | 0.01-25 | 1-20 | 5-15 |
| LAO (Linear Alpha Olefin) | 0.1 to 10 | 0.1 to 5 | 0.1 to 2.5 |
| Optional additional additives | 0-20 | 0.1-10 | 0.1-5 |
| Base stock (50 to 99 mass %) | Balance | Balance | Balance |

Typical Amounts of Optional Lubricating Oil Components in LOC (Continued)

| ADDITIVE FORMULATIONS | D (mass %) | E (mass %) | F (mass %) |
|---|---|---|---|
| Dispersant borated | 0.1-10 | 0.5-8 | 0.5-5 |
| Dispersant non-borated | 0.1 to 30 | 0.5 to 20 | 1 to 15 |
| Detergent Ca high TBN | 0.1-19.8 | 0.25-9 | 0.25 to 5 |
| Detergent Mg, preferably high TBN | 0.1-19.8 | 0.5-8 | 0.5 to 5 |

-continued

Typical Amounts of Optional Lubricating Oil Components in LOC (Continued)

| ADDITIVE FORMULATIONS | D (mass %) | E (mass %) | F (mass %) |
|---|---|---|---|
| Detergent Ca low TBN | 0.1-9.8 | 0.5-8 | 0.5 to 5 |
| styrenic block copolymer VM with proximal styrenic block and distal conjugated diene block (SBC) | 0.1-15 | 0.5-5 | 0.5 to 3 |
| Amine and or phenol (preferably amine) based antioxidant | 0.01-7 | 0.10-5 | 1 to 5 |
| Sulfurized fatty acid ester | 0.01-20 | 0.1 to 10 | 0.5-5 |
| Molybdenum containing compound | 0.01-10 | 0.1 to 7 | 0.1 to 5 |
| Antifoaming Agent | 0.001-5 | 0.001-0.2 | 0.001-0.1 |
| Friction Modifier | 0-5 | 0-1.5 | 0.1 to 5 |
| Viscosity Modifier, other than SBC above | 0.01-25 | 1-20 | 5-15 |
| LAO | 0.1 to 10 | 0.1 to 5 | 0.1 to 2.5 |
| Optional additional additives | 0-20 | 0.1-10 | 0.1-10 |
| Base stock (50 to 99 mass %) | Balance | Balance | Balance |

The foregoing additives are typically commercially available materials. These additives may be added independently, but are usually pre-combined in packages, which can be obtained from suppliers of lubricant oil additives. Additive packages with a variety of ingredients, proportions and characteristics are available and selection of the appropriate package will take the use of the ultimate composition into account.

Fuels

This disclosure also relates to a method of lubricating an automotive internal combustion engine during operation of the engine comprising:

(i) providing to a crankcase of the automotive internal combustion engine an automotive crankcase the lubricating composition of described herein;

(ii) providing a hydrocarbon fuel in the automotive internal combustion engine; and (iii) combusting the fuel in the automotive internal combustion engine, such as a spark-ignited or compression-ignited two- or four-stroke reciprocating engines such as a diesel engine or passenger car engine (such as a spark-ignited combustion engine).

This disclosure also relates to a fuel composition comprising the lubricating oil compositions described herein and a hydrocarbon fuel, wherein the fuel may be derived from petroleum and/or biological sources ("biofuel" or "renewable fuel"). In embodiments, the fuel comprises from 0.1 to 100 mass % renewable fuel, alternately from 1 to 75 mass % renewable fuel, alternately from 5 to 50 mass % renewable fuel, based upon the total mass of the from 1 to 50 mass % renewable fuel and the petroleum derived fuel.

The renewable fuel component is typically produced from vegetable oil (such as palm oil, rapeseed oil, soybean oil, jatropha oil), microbial oil (such as algae oil), animal fats (such as cooking oil, animal fat, and/or fish fat) and/or biogas. Renewable fuel refers to biofuel produced from biological resources formed through contemporary biological processes. In an embodiment, the renewable fuel component is produced by means of a hydrotreatment process. Hydrotreatment involves various reactions where molecular hydrogen reacts with other components, or the components undergo molecular conversions in the presence of molecular hydrogen and a solid catalyst. The reactions include, but are not limited to, hydrogenation, hydrodeoxygenation, hydrodesulfurization, hydrodenitrification, hydrodemetallization, hydrocracking, and isomerization. The renewable fuel component may have different distillation ranges, which provide the desired properties to the component, depending on the intended use.

Uses

The lubricating compositions of the disclosure may be used to lubricate mechanical engine components, particularly in internal combustion engines, e.g., spark-ignited or compression-ignited, two- or four-stroke reciprocating engines, by adding the lubricant thereto. Typically, they are crankcase lubricants, such as passenger car motor oils or heavy-duty diesel engine lubricants.

In particular, the lubricating compositions of the present disclosure are suitably used in the lubrication of the crankcase of a compression-ignited, internal combustion engine, such as a heavy-duty diesel engine.

In particular, the lubricating compositions of the present disclosure are suitably used in the lubrication of the crankcase of a spark-ignited turbo charged internal combustion engine.

In embodiments, the lubricating oils of this disclosure are used in spark-assisted high compression internal combustion engines and, when used in high compression spark ignition internal combustion engines the lubricating oil compositions of this disclosure are useful in lubricating high compression spark ignition engines.

In embodiments, the lubricating compositions of the present disclosure are suitably used in the lubrication of the crankcase of an engine for a heavy-duty diesel vehicle (i.e., a heavy-duty diesel vehicle having a gross vehicle weight rating of 10,000 pounds or more.)

In embodiments, the lubricating compositions of the present disclosure are suitably used in the lubrication of the crankcase of a passenger car diesel engine.

In particular, lubricating oil formulations of this disclosure are particularly useful in compression-ignited internal combustion engines, i.e., heavy-duty diesel engines, employing low viscosity oils, such as API FA-4 and future oil categories, in which wear protection of the valve train becomes challenging.

This disclosure further relates to:

1. A lubricating oil composition comprising or resulting from the admixing of:

(i) at least 50 mass % of one or more base oils, based upon the weight of the lubricating oil composition;

(ii) one or more dispersants;

(iii) one or more detergents; and (iv) one or more styrenic block copolymers having:

a) a radial structure where one or more blocks derived from conjugated diene monomers are distal to the radial center and one more blocks derived from vinyl aromatic monomers that are proximal to the radial center;

b) line roughness, Ra, of 7 μm or more, as determined by Keyence surface analysis of the neat polymer; and c) an intrinsic viscosity, [η], measured at a shear rate of $2\times10^6$ $s^{-1}$ at 40° C. that is less than the intrinsic viscosity measured at a shear rate of $2\times10^6$ $s^{-1}$ at 80° C., as determined by Ultra Shear Viscometry analysis on a blend of 99.8 mass % of Group III base stock having a viscosity index of greater than 120 and a $KV_{100}$ of about 4.0 cSt and 0.2 mass % copolymer.

2. The lubricating composition of paragraph 1 wherein the styrenic block copolymer has a hydrodynamic radius (Rh) at 80° C. that is less than hydrodynamic radius at 40° C. and the hydrodynamic radius at 100° C., as determined by Dynamic Light Scattering analysis on a blend of 99.8 mass % of Group III base stock having a viscosity index of greater than 120 and a $KV_{100}$ of about 4.0 cSt and 0.2 mass % copolymer.

3. The lubricating composition of paragraph 1 or 2 wherein the styrenic block copolymer has a shear compression ratio at 40° C. that is at least three times greater than the shear compression ratio at 100° C., as determined by ASTM D445 in combination with Ultra Shear Viscometry on a blend of 99.8 mass % of Group III base stock having a viscosity index of greater than 120 and a $KV_{100}$ of about 4.0 cSt and 0.2 mass % copolymer.

4. The lubricating composition of any of paragraphs 1-3 wherein the styrenic block copolymer has a hydrodynamic radius (Rh) at 80° C. that is less than hydrodynamic radius at 40° C. and the hydrodynamic radius at 100° C., as determined by Dynamic Light Scattering analysis on a blend of 99.8 mass % of Group III base stock having a viscosity index of greater than 120 and a $KV_{100}$ of about 4.0 cSt and 0.2 mass % copolymer; and the styrenic block copolymer has a shear compression ratio at 40° C. that is at least three times greater than the shear compression ratio at 100° C., as determined by ASTM D445 in combination with Ultra Shear Viscometry analysis on a blend of 99.8 mass % of Group III base stock having a viscosity index of greater than 120 and a $KV_{100}$ of about 4.0 cSt and 0.2 mass % copolymer.

5. The lubricating composition of any of paragraphs 1-4 wherein the detergent comprises calcium detergent.

6. The lubricating composition of any of paragraphs 1-5 wherein the detergent comprises calcium salicylate and or magnesium sulfonate detergent.

7. The lubricating composition of any of paragraphs 1-4 wherein the detergent comprises magnesium salicylate and magnesium sulfonate detergent.

8. The lubricating composition of any of paragraphs 1-7 wherein the dispersant comprises PIBSA-PAM and or borated PIBSA-PAM.

9. The lubricating composition of any of paragraphs 1-8 further comprising antioxidant and or molybdenum containing compound.

10. The lubricating composition of any of paragraphs 1-9 wherein the styrenic block copolymer has a radial compression percent at 40° C. of 120 or more, such as 130 or more, such as 140 or more, such as 150 or more, such as 160 or more, such 170 or more.

11. The lubricating composition of any of paragraphs 1-10 wherein the one or more blocks derived from conjugated diene are derived from butadiene and or isoprene and the one or more blocks derived from vinyl aromatic are derived from polystyrene.

12. The lubricating composition of any of paragraphs 1-11 wherein the block copolymer is partially or fully hydrogenated.

13. The lubricating composition of any of paragraphs 1-12 wherein the one or more blocks derived from conjugated diene monomers are at least 90% hydrogenated.

14. The lubricating composition of any of paragraphs 1-13 wherein the styrenic block copolymers contain less than 5 pg/g of nitrogen.

15. The lubricating composition of any of paragraphs 1-14 wherein the styrenic block copolymers prior to hydrogenation are not functionalized with a nitrogen containing compound.

16. The lubricating oil composition of any of paragraphs 1-15 where the lubricating oil composition is absent phenolic antioxidant.

17. The lubricating oil composition of any of paragraphs 1-16 where the lubricating oil composition has an SAE viscosity grade of 20W-X, 15W-X, 10W-X, 5W-X, or 0W-X, where X represents any one of 8, 12, 16, 20, 30, 40, and 50.

18. The lubricating oil composition of any of paragraphs 1-17 where the lubricating oil composition exhibits greater than 9.2 credits in sludge handling properties as measured by the MB M271 EVO test performed according to CEC L107 M271 EVO Sludge Deposit Test.

19. The lubricating oil composition of any of paragraphs 1-18 further comprising one or more styrenic block copolymers having a radial structure where one or more blocks derived from conjugated diene monomers are proximal to the radial center and one more blocks derived from vinyl aromatic monomers that are distal to the radial center 20. The lubricating oil composition of any of paragraphs 1-19 where one or more styrenic block copolymers are provided to the composition as a viscosity modifier concentrate.

21. A method of lubricating an internal combustion engine during operation of the engine comprising:

(i) providing to a crankcase of the internal combustion engine the lubricating composition of any of paragraphs 1-20;

(ii) providing a fuel in the internal combustion engine; and (iii) combusting the fuel in the automotive internal combustion engine.

22. The method of paragraph 21, wherein the fuel is one of more of hydrocarbon fuel, renewable fuel, hydrogen fuel, or any blend thereof.

23. The method of paragraph 21 or 22, wherein the engine is a diesel engine.

24. The method of paragraph 21 or 22, wherein the engine is a gasoline engine.

The following non-limiting examples are provided to illustrate the disclosure.

Experimental

All molecular weights are number average molecular weights (Mn) reported in g/mol, as determined by gel permeation chromatography using polystyrene standards, unless otherwise noted. "A.I.", "a.i.", and "ai" are wt % active ingredient, unless otherwise indicated.

Testing Procedures

KV150, KV100, KV80, and KV40 are Kinematic viscosity measured at 150° C., 100° C., 80° C., and 40° C., respectively, according to ASTM D445-19a.

Sulfur content in oil is measured by ASTM D5185.

If indicated, Sulphur content is determined according to ASTM D2622.

Sulfated ash ("SASH") content is measured by ASTM D874.

Phosphorus, Boron, Calcium, Zinc, Molybdenum, and Magnesium content are measured by ASTM D5185.

Cold Crank Simulator (CCS) viscosity at −30° C. is determined according to ASTM D5293, and is reported in units of mPa·s (cP).

High Temperature High Shear Viscosity, ("HTHS" or "HTHS150") is determined at 150° C. according to ASTM D4683 and is reported in cPs.

MB M271 EVO test is perforied according to CEC L-107 M271 EVO Sludge Deposit Test and reported in units of sludge credits.

VW TDI3 test is performed according to Volkswagen method VW PV1808.

The moments of molecular weight (Mw, Mn, Mz) are determined by Gel Permeation Chromatography ("GPC-PS") using polystyrene standards (Acquity™ APC Polystyrene High MW Calibration Kit, 266-1,760,000 Da) as follows. Molecular weights [number average molecular weight (Mn), weight average molecular weight (Mw), and z-average molecular weight (Mz)] are determined using an Agilent Acuity P-SM-FTN and P-15 m high temperature GPC-SEC (gel permeation/size exclusion chromatograph) equipped with an on-line differential refractive index (DRI) detector and a PDA UV detector for 215, 254, and 304 wavelengths. The GPC uses 3 Agilent PLgel 10 micron Mixed B LS columns. The column separation is performed using a flow rate of 0.25 mL/min and a nominal injection volume of 10 microliters. The detectors and columns are maintained at 30° C. when in low flow mode (idle) and heated up to 35° C. when preparing to run samples. The stream emerging from the SEC columns is directed into the optical flow cell and then into the DRI detector. Solvent for the SEC experiment is un-inhibited THF (tetrahydrofuran). Polymer solutions are prepared by placing dry polymer in a glass container, adding the desired amount of THF. Once the sample is added to the machine it is given time to reach 35° C. before the run begins. The GPC runs a pre-run programmed equilibrium of approx 1.5 hours. Samples are agitated for 2 to 15 hours depending on solubility. Samples are filtered after the agitation and before being run. All quantities are measured gravimetrically. The THF densities used to express the polymer concentration in mass/volume units are 0.887 g/mL at 68° C. The injection sample concentration is 1-3 mg/mL. Prior to running each sample, the DRI detector and the injector are purged. Flow rate in the apparatus is then increased from 0.01 to 0.25 mL/minute, and the DRI is allowed to stabilize for 4 to 5 hours before injecting the first sample. Software used to run the GPC and prepare reports is Empower™ 3, version 7.41.00.00.

Viscosity Index (VI) is determined according to ASTM D2270.

Star Mn and Arm Mn are measured directly from the GPC-PS chromatogram. The polydispersity of each is low enough and molecular weight difference large enough to distinguish each independently. The Number of Arms is calculated as the quotient of the Star Mn and the Arm Mn:(Star Mn/Arm Mn)

Intrinsic Viscosity (IV), [η], reported in ml/g, at 150° C., 100° C., 80° C., and 40° C., for low shear using ASTM D445 and high shear using Ultra Shear Viscometry, i.e., utilizing a PCS Instruments Limited (London, England) Model USV™, Serial U111 instrument (running USVPC software version 2.06) at a shear rate of $2\times10^6$ $s^{-1}$.

Viscometric Radius (Rv), reported in nanometers (nm), at 150° C., 100° C., 80° C., and 40° C., at low and high shear is calculated using the corresponding low shear and high shear intrinsic viscosity values at each temperature and the GPC-PS molecular weight, Mn, as follows: Rv is the cube root of: (3Mn of the radial polymer)([η])/(10π)($N_A$)), where $N_A$ is Avogadro's Number, i.e., $$R_V = \sqrt[3]{\frac{3M_n[\eta]}{10\pi N_A}}.$$

Hydrodynamic radius (DLS-Rh), reported in nanometers (nm), at 100° C., 80° C., and 40° C., is determined by Dynamic Light Scattering (no shear), as follows: Blends of 99.8 mass % of Group III base stock having a viscosity index of greater than 120 and a $KV_{100}$ of about 4.0 cSt (Yubase™ 4) and 0.2 mass % block copolymer are prepared and passed through 0.45 um PTFE filters into a quartz cuvette. A Wyatt DynaPro NanoStar DLS instrument was employed to measure the hydrodynamic radius. Intensity autocorrelation functions were measured as a function of temperature on cooling from 150° C. to 40° C. The autocorrelation functions were fit according to a regularization fitting procedure available withing the supplier (Wyatt) DYNAMICS software version 7.8.2.18, with the solvent viscosity set to 15.6 cP at 40° C., 5.1 cP at 80° C., and 3.5 cP at 100° C.

Number of stars per entity (#Stars/Entity) is determined by the cubed quotient of the hydrodynamic radius Rh and the viscometric radius Rv: $(Rh/Rv)^3$.

Number of arms per entity (#Arms/Entity) is determined by multiplying the #Stars/Entity by the Number of Arms per star (Star Mn/Arm Mn).

Shear Compression Ratio is determined by the quotient of the low and the high shear intrinsic viscosity at each temperature.

Radial Compression percent is calculated according to the following equation:

$$\text{Radial Compression percent} = 100*(\sqrt[3]{\text{Shear Compression Ratio}} - 1).$$

Haake Carbon Black Test. Dispersancy of carbon black is determined by blending base oil and additive components to provide a formulated oil. Six, nine or twelve wt % of carbon black powder is added to a formulated oil and the sample is blended overnight at 100° C. The viscosity of the carbon black dispersion is then measured in a Haake rheometer over a range of shear rates from 1 to 1000 $sec^{-1}$. Modeling methods used evaluate and report Haake Carbon Black Test data are described in U.S. Pat. No. 11,365,273 B2, column 36, line 66 to column 38, line 3, especially column 37, line 45 to column 38, line 3 for description of the Apparent Yield Stress Model.

Inductively Coupled Plasma Mass Spectrometry (ICP in Table B below) was performed according to the following procedure:

Samples were prepared through microwave assisted nitric, hydrochloric, and hydrofluoric acids digestion using a Milestone Ultrawave Single Reactor Chamber instrument. A digestion control containing a known quantity of analytes and a blank were taken through each sample preparation procedure. A minimum of two analytical isotopes or resolutions per element were included in the analysis sequence to confirm concentrations and evaluate for potential interferences. SFICP-MS analysis was performed using a Thermo Scientific Element2 sector field mass spectrometer (SFICPMS). Standards were prepared in the concentration range of 0.05 ppb to 100 ppb from multi-element stock solutions. The sample analysis was bracketed by calibration blank and standard solution measurements. A 10 ppb QC check was measured during the sample analysis.

Inductively Coupled Plasma Atomic Emission Spectroscopy (ICP in Table F below) was performed according to ASTM D4951.

NOACK volatility is determined according to ASTM D5800, procedure B.

Total Base Number (TBN) is determined according to ASTM D2896 and reported in units of mgKOH/g.

Pour point is determined according to ASTM D97.

Surface Roughness was evaluated using a Keyence VR-3200 3D Measurement Microscope to evaluate the films. The 1.44 mm thick films were prepared side by side in a 4×4 inch mold using approx 10 grams of neat (i.e., no solvent or diluent) polymer (a portion of the 10 g of each polymer placed between Mylar™ sheets then subjected to heat (top plate 135° C., bottom plate 141° C.). The plates were compressed, heating the polymers above their glass transition temperatures such that they flowed to make a flat, transparent film that conformed to the mold. This was repeated until mold was filled). The films were placed on cold bench and allowed to cool to room temperature. The seam between the two films in the mold was avoided during surface analysis. The Mylar™ sheets from sample preparation were left on the samples until just before measurement to prevent surface contamination. Each side of the molded material (each sample) was placed under the measurement window of the Keyence, a field of about 2×2 cm. Area Depth Profiles were captured by the instrument and Line Depth Profiles were recorded by drawing a representative line across the Area Profiles. The Surface Roughness and the Line Roughness were both calculated using internal software (VR3000 G2 series software) provided by the manufacturer (Software version 2.4.0.115).

Materials

Component Chart

| Material | Description |
|---|---|
| B-PIBSA-PAM-950 | Borated PIBSA-PAM (Mn 950) in ~50% oil (ai ~45) |
| PIBSA-PAM 1000 Mn | PIBSA-PAM dispersant (1000 Mn PIB, ~53% oil) |
| PIBSA-PAM 2200 Mn | PIBSA-PAM Dispersant (2200 Mn PIB, in ~43% oil, ai ~55) |
| PIBSA ester | 1.PIBSA ester prepared in a manner similar to Example 1 of U.S. 2009/0203559. |
| Amine Funct EP Copol | amine functionalized olefin copolymer dispersant (E/P copolymer ~23,000 Mn in ~65% oil ) |
| PIBSA Ester | PIBSA ester prepared in a manner similar to Example 1 of U.S. 2009/0203559. |
| Ca Salicylate-350 TBN | Ca salicylate/PDMS Blend TBN 350 in ~43 wt % oil/antifoam agent |
| Mg sulfonate-400 TBN | Mg sulfonate detergent (400 TBN, in ~43 wt % oil, ai ~57) |
| Ca salicylate-64 TBN | Ca alkyl salicylate (TBN ~64, in 60 wt % oil) |
| ZDDP | ZDDP (derived from iso-octanol/2-butanol [15/85]), ai ~75) |
| Mo Friction modifier | Trimeric MoDTC (ai ~45) |
| DPA antioxidant | DPA Antioxidant -Irganox L67 |
| Phenol antioxidant | C8 hindered phenol |
| Sulfurized FAME | Sulfurized Lard Oil and Palm Oil Fatty Acid Methyl Ester |
| LAO | blend of $C_{14}$+ Linear Alpha Olefins |
| PIBSA | PIBSA (Mn 950, ai ~72) |
| Anti-foam agent | PDMS silicone anti-foam agent |
| PIB- 950 Mn | Polyisobutylene having an Mn of 950 g/mol |
| lube oil flow improver | fumarate/vinyl acetate copolymer in oil |
| IB-S-IB tri-block copolymer | hydrogenated triblock radial polymer comprising distal polyisobutylene-butadiene copolymer middle polystyrene blocks and proximal polyisobutylene-butadiene copolymer blocks. |
| IB-S block copolymer | hydrogenated diblock radial polymer comprising distal polystyrene blocks and proximal polyisobutylene-butadiene copolymer blocks. |
| S-IB block copolymer | hydrogenated diblock radial polymer comprising proximal polystyrene blocks and distal polyisoprene-butadiene copolymer blocks (LD1160 ™ SEPS from Shanghai Lander Chemical Company limited, Shanghai, People's Republic of China.) |
| SBS block copolymer | hydrogenated styrene butadiene styrene multi arm block copolymer (Europrene SOL THX 1050, Polymeri Europa/EniChem) |
| Purity ™ VHVI 4 | PetroCanada Group III base oil, Kv100 4 cSt, Viscosity Index 128 |
| Purity ™ VHVI 8 | PetroCanada Group III base oil, Kv100 8 cSt, Viscosity Index 128 |
| Priolube ™ 3970 | Group V ester base oil (trimethylpropane ester from $C_{8-10}$ fatty acids) Kv100 approx 4.4 cSt from Croda International Chemical Co. |
| Yubase 4 | Group III Base stock 4 cSt |
| Yubase 4+ | Group III Base stock 4+ cSt |
| Yubase 6 | Group III Base stock 6 cSt |
| ECH45 | EHC45 ™ is base oil having a VI of about 115 and a $KV_{100}$ of about 4.5 cSt |
| ECH65 | EHC65 ™ is base oil having a VI of about 106 and a $KV_{100}$ of about 6.5 cSt |
| Paratone ™ 68231 | Paratone ™ 68231 is an olefin copolymer viscosity modifier having a $KV_{100}$ of 830 cSt and a viscosity index of about 115, available from Chevron Oronite |
| AMEXOM100 | Group I base oil diluent. |

Styrenic Block Copolymer Viscosity Modifiers

Example 1

Two hydrogenated styrene based radial diblock copolymers (IB—S block copolymer and S-TB block copolymer, described above) were obtained and characterized.

Gel Permeation Chromatography was performed for both block copolymers on an Agilent system at room temperature using a THF mobile phase and a concentration of 1 mg/mL following filtration through 0.22 μm poly(tetrafluoroethylene). Molecular weight was determined using polystyrene standards which covered a range of 250-4,000,000 g/mol. The results are presented in Table A and FIG. 2.

TABLE A

| | Star | | | | | | Arm | | | |
|---|---|---|---|---|---|---|---|---|---|---|
| Name | Mw, kg/mol | Nw arms | Mn, kg/mol | Nn arms | Đ | Peak 1 area, % | Mw, kg/mol | Mn, kg/mol | Đ | Peak 2 area, % |
| IB-S-IB tri-block copolymer | 647 | 7.3 | 601 | 7.0 | 1.08 | 95.2 | 89.1 | 85.8 | 1.04 | 4.77 |
| IB-S block copolymer | 579 | 6.9 | 533 | 6.5 | 1.09 | 95.0 | 84.4 | 81.4 | 1.04 | 4.95 |
| S-IB block copolymer | 522 | 6.7 | 477 | 6.4 | 1.10 | 93.5 | 78.4 | 75.0 | 1.05 | 6.49 |
| SBS block copolymer | 460 | 7.5 | 405 | 6.8 | 1.14 | 91.1 | 61.7 | 59.2 | 1.04 | 8.92 |

Further, in FIG. 2 we see the GPC traces nearly overlay, but S—IB block copolymer is slightly lower molecular weight overall as evidenced by the longer elution time.

S—IB block copolymer has a similar dispersity, D (Mw/Mn), to IB—S block copolymer and slightly lower arm and total molecular weights. The low dispersity implies a similar synthetic route, namely anionic polymerization. The weight- and number-average number of arms (Nw and Nn) are provided based on simple division of the corresponding molecular weights. Note that S—IB block copolymer has directionally fewer number of arms, on average, than IB—S block copolymer.

The two block copolymers were then evaluated for elemental content. Digestive ICP-MS (Inductively Coupled Plasma Mass Spectrometry) was performed by first using microwave assisted nitric, hydrochloric, and hydrofluoric acids to digest the solid polymers. A number of elements were assessed based on controlled calibrant samples with high fidelity/resolution. Table B below contains the digestive ICP-MS results. Note that all metals are separately calibrated and thus have different limits of detection (LOD) and limits of quantification (LOQ). The "<" values indicate the measured value is below the LOD, whereas the "<=" values indicate the measured value is above the LOD but below the LOQ. Unconditional values are above the LOQ.

TABLE B

| Element (ppm) | IB-S block copolymer | S-IB block copolymer |
|---|---|---|
| Al (Aluminum) | 17.0 | 12.0 |
| Ca (Calcium) | 0.98 | 1.02 |

TABLE B-continued

| Element (ppm) | IB-S block copolymer | S-IB block copolymer |
|---|---|---|
| Co (Cobalt) | 26.0 | 0.135 |
| Cr (Chromium) | 0.076 | 0.370 |
| Fe (Iron) | 0.220 | 7.40 |
| Li (Lithium) | 3.65 | 1.00 |
| Mg (Magnesium) | 0.23 | 2.05 |
| Na (Sodium) | 1.60 | 11.5 |
| Ni (Nickel) | 0.570 | 3.65 |
| P (Phosphorus) | 37.0 | 305 |
| S (Sulfur) | <=1.35 | <0.925 |
| Si (Silicon) | <0.230 | 5.05 |

TABLE B-continued

| Element (ppm) | IB-S block copolymer | S-IB block copolymer |
|---|---|---|
| Ti (Titanium) | 0.215 | 0.00 |
| Zn (Zinc) | 0.00 | 0.00 |

Fourier transform infrared spectroscopy (FTIR) was then conducted on compacted films of the two block copolymers to improve the signal-to-noise ratio. The discs were prepared by first compacting the crumb polymers into small discs using a heat press to improve the signal-to-noise ratio. The resulting spectra for each of the materials overlayed closely (FIG. 1), generally indicates a close chemical match.

Glass Transition temperatures (Tg, C) were then measured by differential scanning calorimetry (DSC, 10° C./min ramp rate) on the neat polymers. All temperature rates were 10° C./min. First cool from room temperature to −80° C., First heat cycle from −80° C. to 200° C., Second cool cycle from 200° C. to −80° C., and Second heat cycle from −80° C. to 200° C. Both polymers showed dominant Tg's of about −60° C. The dominant Tg is determined when any glass transition contribution from the styrenic block(s) is/are ignored when determining the Tg of the block copolymers.

The above data show that the two block copolymers, while different in block placement, are very similar in chemical composition and may have small molecular weight differences.

Example 2

The block copolymers were then blended with Yubase™ 4 and further characterized. The data are presented in Table C-1. Additional properties are present in Tables C-2 and C-3.

TABLE C

| Constituents: | Example 1 Mass % | Example 2 Mass % | Example 3 Mass % | Example 4 Mass % | Example 5 Mass % |
|---|---|---|---|---|---|
| IB-S-IB tri-block copolymer | 0.200 | | | | |
| IB-S block copolymer | | 0.200 | | | |
| S-IB block copolymer | | | 0.200 | | |
| SBS block copolymer | | | | 0.200 | |
| Yubase ™ 4 | 99.800 | 99.800 | 99.800 | 99.800 | 100.000 |
| KV150 (cSt) | 2.36 | 2.40 | 2.37 | 2.28 | 2.06 |
| KV100 (cSt) | 4.80 | 5.01 | 4.94 | 4.74 | 4.24 |
| KV80 (cSt) | 6.99 | 7.45 | 7.35 | 7.04 | 6.28 |
| KV40 (cSt) | 21.37 | 23.27 | 22.91 | 21.85 | 19.29 |
| # Stars/Entity* | | | | | |
| 100° C. | 2.5 | 2.5 | 3.1 | 7.3 | |
| 80° C. | 2.6 | 4.3 | 2.1 | 16.7 | |
| 40° C. | 2.7 | 1.9 | 3.5 | 13.6 | |
| # Arms/Entity* | | | | | |
| 100° C. | 17.2 | 16.2 | 19.6 | 49.9 | |
| 80° C. | 18.2 | 28.2 | 13.1 | 114.2 | |
| 40° C. | 18.6 | 12.4 | 22.3 | 93.0 | |
| Intrinsic Visc. (ml/g) low shear | | | | | |
| 150° C. | 87.10 | 98.72 | 90.01 | 63.88 | |
| 100° C. | 79.00 | 108.62 | 98.74 | 70.53 | |
| 80° C. | 67.62 | 111.43 | 101.91 | 72.38 | |
| 40° C. | 64.49 | 123.40 | 112.24 | 79.38 | |
| Intrinsic Visc. (ml/g) high shear | | | | | |
| 150° C. | 40.96 | 47.33 | 38.82 | 32.98 | |
| 100° C. | 23.62 | 26.49 | 22.39 | 22.27 | |
| 80° C. | 24.26 | 27.00 | 21.72 | 19.28 | |
| 40° C. | 34.94 | 12.76 | 5.56 | 70.29 | |
| Rv (nm), Low Shear | | | | | |
| 150° C. | 20.2 | 20.3 | 19.0 | 16.0 | |
| 100° C. | 19.6 | 20.9 | 19.5 | 16.5 | |
| 80° C. | 18.6 | 21.1 | 19.8 | 16.7 | |
| 40° C. | 18.3 | 21.9 | 20.4 | 17.2 | |
| Rv (nm), High shear | | | | | |
| 150° C. | 15.7 | 15.9 | 14.3 | 12.8 | |
| 100° C. | 13.1 | 13.1 | 11.9 | 11.3 | |
| 80° C. | 13.2 | 13.2 | 11.8 | 10.7 | |
| 40° C. | 14.9 | 10.3 | 7.5 | 16.5 | |
| Rh (nm), no shear | | | | | |
| 150° C. | | | | | |
| 100° C. | 26.5 | 28.4 | 28.4 | 32.1 | |
| 80° C. | 25.6 | 34.4 | 25.2 | 42.7 | |
| 40° C. | 25.4 | 27.1 | 31.0 | 41.1 | |
| Shear Compression Ratio | | | | | |
| 150° C. | 2.1 | 2.1 | 2.3 | 1.9 | |
| 100° C. | 3.3 | 4.1 | 4.4 | 3.2 | |
| 80° C. | 2.8 | 4.1 | 4.7 | 3.8 | |
| 40° C. | 1.8 | 9.7 | 20.2 | 1.1 | |
| Radial Compression Percent | | | | | |
| 150° C. | 28.6 | 27.8 | 32.4 | 24.7 | |
| 100° C. | 49.6 | 60.1 | 64.0 | 46.9 | |
| 80° C. | 40.7 | 60.4 | 67.4 | 55.4 | |
| 40° C. | 22.7 | 113.0 | 172.3 | 4.1 | |

*Entity means discrete scattering particles in the field of observation.

TABLE C-2

| Polymer Sample | Nitrogen (ASTM D5762) |
|---|---|
| S-IB block copolymer | <5 μg/g |
| IB-S block copolymer | <5 μg/g |

Example 3

1.4 mm thick films were prepared using the method described above for Surface Roughness evaluation. Pictures of text viewed through the films are shown in FIG. 3. The left image is IB—S block copolymer ("Flat surface") and the right image is S—IB block copolymer ("Orange Peel" bumpy surface).

Example 4

Surface Roughness was evaluated using A Keyence VR-3200 3D Measurement Microscope to evaluate the films as described above. The data are reported in Table D below. Area Depth Profiles were captured by the instrument and Line Depth Profiles were recorded by drawing a representative line across the Area Profiles (see FIGS. 4 and 5). The Surface Roughness and the Line Roughness were both calculated using internal software provide by the manufacturer. The data are reported in Table D.

TABLE D

| Example No. | | Line , Roughness Ra (μm) | Surface Roughness, Sa (μm) |
|---|---|---|---|
| 1 (avg of 3 runs) | IB-S block copolymer | 5.58 | 8.30 |
| 2 (avg of 2 runs) | S-IB block copolymer | 11.1 | 11.0 |
| 3 | IB-S-IB tri-block copol. | 62.5 | 58.5 |

Surface roughness due to so-called "Orange Peel" effects are understood to be a consequence of localized differences in temperature fields across the surface of a film during cooling. The data in Table D may be explained by the inversion of the polystyrene block architecture (S—IB), which causes differences in bulk organization of the polymers leading to anisotropy of temperature fields on cooling.

Example 5

Eight lubricating oil compositions were prepared using Group III base stock (Yubase™ 4+ base stock); styrenic block copolymer viscosity modifier (IB—S block copolymer or S—IB block copolymer); dialkyl fumarate/vinyl acetate copolymer pour point depressant; and one of four different additive blends The four different additive blends were:

Blend 1 contained borated and non-borated PIBSA-PAMs, calcium salicylate detergent; ZDDP derived from primary and secondary alcohols, molybdenum compound(s), antioxidants, and antifoam agent.

Blend 2 contained borated and non-borated PIBSA-PAMs, calcium and magnesium sulfonate detergents; ZDDP derived from primary and secondary alcohols, molybdenum compound(s), anti-oxidants, and anti-foam agent.

Blend 3 contained borated and non-borated PIBSA-PAMs, calcium salicylate and magnesium sulfonate detergents; ZDDP derived from primary and secondary alcohols, molybdenum compound(s), anti-oxidants, and anti-foam agent.

Blend 4 contained PIBSA-PAM, calcium and magnesium sulfonate detergents; ZDDP derived from primary and secondary alcohols, molybdenum compound(s), anti-oxidants, and anti-foam agent.

The blends were characterized and tested for various properties. The results are reported in Table E.

TABLE E

| | Example | | | | | | | |
|---|---|---|---|---|---|---|---|---|
| | 4-1 | 4-2 | 4-3 | 4-4 | 4-5 | 4-6 | 4-7 | 4-8 |
| Blend | Blend 1 | Blend 1 | Blend 2 | Blend 2 | Blend 3 | Blend 3 | Blend 4 | Blend 4 |
| Viscosity modifier (VM) | IB-S block copol. | S-IB block copol. | IB-S block copol. | S-IB block copol. | IB-S block copol. | S-IB block copol. | IB-S block copol. | S-IB block copol. |
| VM solid treat rate*, m % | 1.66 | 1.77 | 1.66 | 1.77 | 1.66 | 1.77 | 1.66 | 1.77 |
| SAE Viscosity Grade | 5W-50 | 5W-50 | 5W-50 | 5W-50 | 5W-60 | 5W-60 | 5W-50 | 5W-50 |
| HTHS150, cP | 4.32 | 4.39 | 4.2 | 4.3 | 5.2 | 5.3 | 4.4 | 4.4 |
| CCS (−30° C.), cSt | 3791 | 3808 | 3297 | 3408 | 7277 | 7360 | 3696 | 3647 |
| KV100, cSt | 19.44 | 19.58 | 18.7 | 19.0 | 24.7 | 24.5 | 20.3 | 20.0 |
| KV40, cSt | 112.4 | 113.9 | 106.5 | 109.7 | 158.3 | 157.5 | 118.7 | 116.1 |
| Viscosity index | 197 | 195 | 196 | 195 | 190 | 188 | 196 | 195 |

*Treat rate amounts are different so as to match KV100 and HTHS150 viscosities.

The blends from Examples 4-1 to 4-8 were then examined by Inductively Coupled Plasma—AES. The data are reported in Table F, along with other data.

TABLE F

| | Example | | | | | | | |
|---|---|---|---|---|---|---|---|---|
| | 4-1 | 4-2 | 4-3 | 4-4 | 4-5 | 4-6 | 4-7 | 4-8 |
| B m % | 0.0077 | 0.0077 | 0.0100 | 0.0100 | 0.0140 | 0.0140 | <0.0001 | <0.0001 |
| Ba m % | <0.0001 | <0.0001 | <0.0001 | <0.0001 | <0.0001 | <0.0001 | <0.0001 | <0.0001 |
| Ca m % | 0.186 | 0.186 | 0.1350 | 0.1350 | 0.1130 | 0.1140 | 0.1230 | 0.1220 |
| Cu m % | <0.0001 | <0.0001 | <0.0001 | <0.0001 | <0.0001 | <0.0001 | <0.0001 | <0.0001 |
| Mg m % | 0.0009 | 0.0009 | 0.0420 | 0.0418 | 0.1120 | 0.1100 | 0.1540 | 0.1530 |
| Mo m % | <0.0001 | 0.0002 | 0.0051 | 0.0049 | 0.0053 | 0.0053 | 0.0054 | 0.0053 |
| P m % | 0.0808 | 0.081 | 0.0800 | 0.0830 | 0.0899 | 0.0898 | 0.1360 | 0.1370 |
| S m % | 0.191 | 0.189 | 0.2210 | 0.2260 | 0.2510 | 0.2480 | 0.3860 | 0.3860 |
| Si m % | 0.0004 | 0.0004 | 0.0007 | 0.0007 | 0.0007 | 0.0007 | 0.0006 | 0.0006 |

TABLE F-continued

| | Example | | | | | | | |
|---|---|---|---|---|---|---|---|---|
| | 4-1 | 4-2 | 4-3 | 4-4 | 4-5 | 4-6 | 4-7 | 4-8 |
| Zn m % | 0.0886 | 0.0881 | 0.0836 | 0.0833 | 0.0910 | 0.0907 | 0.1440 | 0.1440 |
| N m % | 949 | 959 | 977 | 1012 | 1951 | 1940 | 875 | 853 |
| NOACK | 11 | 11.1 | 11.2 | 10.6 | 11.0 | 11.2 | 11.0 | 11.3 |
| SASH | 0.75 | 0.79 | 0.75 | 0.74 | 0.96 | 0.88 | 1.16 | 1.17 |
| TBN | 7.9 | 8.3 | 7.8 | 7.7 | 12.8 | 12.7 | 11.0 | 11.2 |
| Sulphur, ASTM D2622 | 0.184 | 0.188 | 0.200 | 0.197 | 0.207 | 0.204 | 0.308 | 0.310 |
| Pourpoint | −39 | −39 | −36 | −39 | −39 | −36 | −33 | −39 |

Example 5 Engine Testing in Finished Oils

Two lubricating oil compositions were prepared using Group III base stock (Yubase™ 4+ base stock); styrenic block copolymer viscosity modifier (IB—S block copolymer or S—IB block copolymer); dialkyl fumarate/vinyl acetate copolymer pour point depressant; and additive Blend 5. Blend 5 contained borated and non-borated PIBSA-PAMs, PIBSA Ester, calcium salicylate detergents, magnesium salicylate detergent; ZDDP derived from primary and secondary alcohols, molybdenum compound(s), antioxidants, and anti-foam agent.

Formulations 5-A and B were then prepared:

TABLE G

| Formulations | 5-A | 5-B |
|---|---|---|
| Blend 5 | 13.6 | 13.6 |
| IB-S block copolymer | 1.5 | — |
| S-IB block copolymer | — | 1.54 |
| Polyalkyl methacrylate (Viscoplex ™ 1-330) | 0.2 | 0.2 |
| Group III base oil, 4 cSt | 12.0 | 11.96 |
| Shell GTL base stock (Group III) 4 cSt | 57.7 | 57.7 |
| Shell GTL base stock (Group III) 8 cSt | 15.0 | 15.0 |

The VW TDI3 and MB M271Evo tests were utilised to evaluate formulations 5-A and 5-B. These two tests are a wide representation for a piston cleanliness and sludge handling tests and can be seen as useful parameters when considering effects of polymers within the engine.

TABLE H

| IB-S block copolymer Blend 5A | S-IB block copolymer Blend 5B | Δ |
|---|---|---|
| VW TDI3 (Merits) − Error: ±3 Merits | | |
| 59 | 60 | 1 |
| M271Evo (Merits) − Error: ±0.3 Merits | | |
| 7.9 | 9.4 | 1.5 |

The M271 Evo results showed a statistically significant improvement of about 1.5 merits (error in M271Evo±0.3 merits). These results show a clear improvement in the addition of S—IB block copolymer over Infineum IB—S block copolymer for the M271Evo results. The scale of the improvement for the Blend 5 is significant as it has improved an ACEA pass to a MBQL (Mercedes-Benz quality line) pass of greater than 9.2 merits.

Example 6 Comparative

TABLE I

| | Example | | | | | | | |
|---|---|---|---|---|---|---|---|---|
| | 4-1 | 4-2 | 4-3 | 4-4 | 4-5 | 4-6 | 4-7 | 4-8 |
| Blend Viscosity modifier (VM) | Blend 1 IB-S block copol. | Blend 1 S-IB block copol. | Blend 2 IB-S block copol. | Blend 2 S-IB block copol. | Blend 3 IB-S block copol. | Blend 3 S-IB block copol. | Blend 4 IB-S block copol. | Blend 4 S-IB block copol. |
| VM solid treat rate m % | 1.66 | 1.77 | 1.66 | 1.77 | 1.66 | 1.77 | 1.66 | 1.77 |
| SAE Viscosity Grade | 5W-50 | 5W-50 | 5W-50 | 5W-50 | 5W-60 | 5W-60 | 5W-50 | 5W-50 |
| 9 m % carbon black (Haake) Apparent Yield Stress (Pa) | $4.26 \times 10^{1}$ | $3.62 \times 10^{1}$ | $3.84 \times 10^{-2}$ | $3.82 \times 10^{-2}$ | 7.69 | $1.24 \times 10^{1}$ | 0.00* | 2.04 |
| 6 m % carbon black (Haake) Apparent Yield Stress (Pa) | 7.59 | 7.98 | | | 1.64 | 1.71 | | |
| 12 m % carbon black (Haake) Apparent Yield Stress (Pa) | | | $1.05 \times 10^{1}$ | $1.06 \times 10^{1}$ | | | $6.23 \times 10^{1}$ | $7.74 \times 10^{1}$ |

TABLE I-continued

| | Example | |
|---|---|---|
| | 4-9 | 4-10 |
| Blend | Blend 2 | Blend 2 |
| Viscosity modifier (VM) | IB-S block copol. | S-IB block copol. |
| VM solid treat rate m % | 0.54 | 0.57 |
| SAE Viscosity Grade | 0W-20 | 0W-20 |
| 9 m % carbon black (Haake Apparent Yield Stress (Pa) | 2.80E−02 | 1.68E−02 |

*There is not necessarily a lower limit for soot dispersancy in Apparent Yield Stress terms, as a minimum measured APY value of 0.00 Pa reflects a the lower limit of the model fit parameter for a highly soot-dispersant composition.

The soot handling data in the experiments in Table I show roughly equivalent S-TB block copolymer performance in soot handling as compared to TB-S block copolymer, however the S—IB block copolymer blends do show unexpected M271Evo improvement over TB-S block copolymer blends.

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. The term "comprising" is considered synonymous with the term "including." Likewise, whenever a composition, an element, or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

What is claimed is:

1. A lubricating oil composition comprising or resulting from the admixing of:

(i) at least 50 mass % of one or more base oils, based upon the weight of the lubricating oil composition;

(ii) one or more dispersants;

(iii) one or more detergents; and (iv) one or more styrenic block copolymers having:

a) a radial structure where one or more blocks derived from conjugated diene monomers are distal to the radial center and one more blocks derived from vinyl aromatic monomers that are proximal to the radial center;

b) line roughness, Ra, of 7 μm or more, as determined by Keyence surface analysis of the neat polymer; and c) an intrinsic viscosity, [η], measured at a shear rate of $2\times10^6$ $s^{-1}$ at 40° C. that is less than the intrinsic viscosity measured at a shear rate of $2\times10^6$ $s^{-1}$ at 80° C., as determined by Ultra Shear Viscometry analysis on a blend of 99.8 mass % of Group III base stock having a viscosity index of greater than 120 and a $KV_{100}$ of about 4.0 cSt and 0.2 mass % copolymer.

2. The lubricating composition of claim 1 wherein the styrenic block copolymer has a hydrodynamic radius (Rh) at 80° C. that is less than hydrodynamic radius at 40° C. and the hydrodynamic radius at 100° C., as determined by Dynamic Light Scattering analysis on a blend of 99.8 mass % of Group III base stock having a viscosity index of greater than 120 and a $KV_{100}$ of about 4.0 cSt and 0.2 mass % copolymer.

3. The lubricating composition of claim 1 wherein the styrenic block copolymer has a shear compression ratio at 40° C. that is at least three times greater than the shear compression ratio at 100° C., as determined by ASTM D445 in combination with Ultra Shear Viscometry on a blend of 99.8 mass % of Group III base stock having a viscosity index of greater than 120 and a $KV_{100}$ of about 4.0 cSt and 0.2 mass % copolymer.

4. The lubricating composition of claim 1 wherein the styrenic block copolymer has a hydrodynamic radius (Rh) at 80° C. that is less than hydrodynamic radius at 40° C. and the hydrodynamic radius at 100° C., as determined by Dynamic Light Scattering analysis on a blend of 99.8 mass % of Group III base stock having a viscosity index of greater than 120 and a $KV_{100}$ of about 4.0 cSt and 0.2 mass % copolymer; and the styrenic block copolymer has a shear compression ratio at 40° C. that is at least three times greater than the shear compression ratio at 100° C., as determined by ASTM D445 in combination with Ultra Shear Viscometry analysis on a blend of 99.8 mass % of Group III base stock having a viscosity index of greater than 120 and a $KV_{100}$ of about 4.0 cSt and 0.2 mass % copolymer.

5. The lubricating composition of claim 1 wherein the detergent comprises calcium detergent.

6. The lubricating composition of claim 1 wherein the detergent comprises calcium salicylate and or magnesium sulfonate detergent.

7. The lubricating composition of claim 4 wherein the detergent comprises magnesium salicylate and or magnesium sulfonate detergent.

8. The lubricating composition of claim 1 wherein the dispersant comprises PIBSA-PAM and or borated PIBSA-PAM.

9. The lubricating composition of claim 1, further comprising antioxidant and or molybdenum containing compound.

10. The lubricating composition of claim 1, wherein the styrenic block copolymer has a Radial Compression Percent at 40° C. of 120 or more.

11. The lubricating composition of claim 1, wherein the one or more blocks derived from conjugated diene are derived from butadiene and or isoprene and the one or more blocks derived from vinyl aromatic are derived from polystyrene.

12. The lubricating composition of claim 1, wherein the block copolymer is partially or fully hydrogenated.

13. The lubricating composition of claim 1, wherein the one or more blocks derived from conjugated diene monomers are at least 90% hydrogenated.

14. The lubricating composition of claim 1, wherein the styrenic block copolymers contain less than 5 μg/g of nitrogen.

15. The lubricating composition of claim 1, wherein the styrenic block copolymers prior to hydrogenation are not functionalized with a nitrogen containing compound.

16. The lubricating oil composition of claim 1, where the lubricating oil composition is absent phenolic antioxidant.

17. The lubricating oil composition of claim 1, where the lubricating oil composition has an SAE viscosity grade of 20W-X, 15W-X, 10W-X, 5W-X, or 0W-X, where X represents any one of 8, 12, 16, 20, 30, 40, and 50.

18. The lubricating oil composition of claim 1, where the lubricating oil composition exhibits greater than 9.2 credits in sludge handling properties as measured by the MB M271 EVO test performed according to CEC L-107 M27 EVO Sludge Deposit Test.

19. The lubricating oil composition of claim 1, further comprising one or more styrenic block copolymers having a radial structure where one or more blocks derived from conjugated diene monomers are proximal to the radial center and one more blocks derived from vinyl aromatic monomers that are distal to the radial center.

20. The lubricating oil composition of claim 1, where one or more styrenic block copolymers are provided to the composition as a viscosity modifier concentrate.

21. A method of lubricating an internal combustion engine during operation of the engine comprising:

(i) providing to a crankcase of the internal combustion engine the lubricating composition of claim 1;

(ii) providing a fuel in the internal combustion engine; and (iii) combusting the fuel in the automotive internal combustion engine.

22. The method of claim 21, wherein the fuel is one of more of hydrocarbon fuel, renewable fuel, hydrogen fuel, or any blend thereof.

23. The method of claim 21, wherein the engine is a diesel engine.

24. The method of claim 21, wherein the engine is a gasoline engine.

* * * * *